US012773053B2

(12) United States Patent
Juchniewicz

(10) Patent No.: US 12,773,053 B2
(45) Date of Patent: Oct. 27, 2026

(54) INFANT CARE APPARATUS

(71) Applicant: MONAHAN PRODUCTS, LLC, Rockland, MA (US)

(72) Inventor: Richard Juchniewicz, Pittsburgh, PA (US)

(73) Assignee: MONAHAN PRODUCTS, LLC, Rockland, MA (US)

( * ) Notice: Subject to any disclaimer, the term of this patent is extended or adjusted under 35 U.S.C. 154(b) by 868 days.

(21) Appl. No.: 17/662,024

(22) Filed: May 4, 2022

(65) Prior Publication Data

US 2022/0354255 A1 Nov. 10, 2022

Related U.S. Application Data

(60) Provisional application No. 63/184,625, filed on May 5, 2021.

(51) Int. Cl.
*A47D 13/10* (2006.01)
*A47C 3/025* (2006.01)

(52) U.S. Cl.
CPC ..... *A47D 13/105* (2013.01); *A47C 3/0251* (2018.08); *A47C 3/0255* (2013.01)

(58) Field of Classification Search
CPC ..... A47D 13/105; A47D 9/057; A47D 9/02; A47D 9/053; A47D 9/04; A47C 3/0251; A47C 3/0255
See application file for complete search history.

(56) References Cited

U.S. PATENT DOCUMENTS 4,970,740 A * 11/1990 Crawford ..... A47D 9/02 5/103
6,286,844 B1 * 9/2001 Cone, II ..... B62B 9/28 280/658
7,255,393 B2 * 8/2007 Flanagan ..... A47D 13/105 472/105
9,433,303 B2 * 9/2016 Zhong ..... A47D 9/057
2002/0113469 A1 * 8/2002 Stern ..... A47D 1/10 297/256.16

(Continued)

FOREIGN PATENT DOCUMENTS

CN 105029963 A * 11/2015

OTHER PUBLICATIONS

International Search Report PCT/US22/72144 Jul. 22, 2022.

*Primary Examiner* — Adam C Ortiz
(74) *Attorney, Agent, or Firm* — Perman & Green, LLP

(57) ABSTRACT

An infant care apparatus including a base, a drive, an infant support, and a controller. The a drive is coupled to the base and has a first electromechanical driver defining a first degree of freedom forming a first axis of motion of a movable infant load seat surface dependent from and movable relative to the base. The infant support is removably coupled to the movable infant load seat surface. The drive is a distributed drive distributed to the base and the infant support, and includes a second electromechanical driver integral with the infant support that defines a second degree of freedom forming a second axis of motion of the infant support. The controller is communicably coupled to the distributed drive and is configured so as to move, via the first and second electromechanical drivers, the infant support relative to the base.

40 Claims, 54 Drawing Sheets

(56) References Cited

U.S. PATENT DOCUMENTS

| | | | | |
|---|---|---|---|---|
| 2006/0025226 | A1* | 2/2006 | Nakano | A63B 69/04 472/100 |
| 2007/0205646 | A1* | 9/2007 | Bapst | A47D 9/057 297/261.1 |
| 2008/0143155 | A1* | 6/2008 | Arnold | A47D 1/10 297/217.3 |
| 2008/0179928 | A1* | 7/2008 | Chen | A47D 13/10 297/260.1 |
| 2008/0217974 | A1* | 9/2008 | Velderman | A47D 13/107 297/256.16 |
| 2010/0052387 | A1* | 3/2010 | Hopke | A47D 9/057 297/260.2 |
| 2010/0201171 | A1* | 8/2010 | Velderman | A47D 9/057 297/260.2 |
| 2014/0315650 | A1* | 10/2014 | Pyrce | A47D 9/057 472/119 |
| 2015/0245719 | A1* | 9/2015 | Zhong | A47D 9/057 297/260.1 |
| 2016/0192787 | A1 | 7/2016 | Perrin et al. | |
| 2016/0345751 | A1* | 12/2016 | Mountz | A47D 13/105 |
| 2017/0280891 | A1* | 10/2017 | Mountz | A47D 1/10 |
| 2017/0367493 | A1* | 12/2017 | Mountz | A47D 13/105 |
| 2018/0296006 | A1* | 10/2018 | Robbins | A47D 9/057 |
| 2018/0325280 | A1* | 11/2018 | Paperno | A47D 9/02 |
| 2019/0246797 | A1* | 8/2019 | Shih | A47C 3/0255 |
| 2019/0247611 | A1* | 8/2019 | Karp | A61M 21/02 |
| 2021/0100368 | A1 | 4/2021 | Juchniewicz | |
| 2021/0177160 | A1* | 6/2021 | Watanabe | A47D 13/10 |
| 2022/0395757 | A1* | 12/2022 | Shen | A47D 13/105 |
| 2023/0124305 | A1* | 4/2023 | Li | A47D 9/057 297/273 |

* cited by examiner

NO RECLINE

RECLINE

INFANT CARE APPARATUS

CROSS-REFERENCE TO RELATED APPLICATIONS

This application is a non-provisional of and claims the benefit of U.S. provisional patent application No. 63/184,625 filed on May 5, 2021, the disclosure of which is incorporated herein by reference in its entirety.

BACKGROUND

1. Field

The disclosed embodiment relates generally to an infant care apparatus and, more particularly, to an infant care apparatus having an occupant area that is movable by a drive mechanism.

2. Description of Related Art

Baby swings, bouncy seats, cradles, and bassinets have been used to hold, comfort, and entertain infants and babies for many years. Prior art bouncy seats are normally constructed with a wire frame that contains some resistance to deformation that is less than or equal to the weight of the child in the seat. Thus, when the child is placed in the seat, his or her weight causes a slight and temporary deformation in the wire structure that is then counteracted by the wire frame's resistance to deformation. The end result is that the child moves up and down slightly relative to the floor. This motion can be imparted to the seat by a caregiver for the purpose of entertaining or soothing the child.

Baby swings normally function in much the same way as swing sets for older children; however, the baby swing usually has an automated power-assist mechanism that gives the swing a "push" to continue the swinging motion in much the same way a parent will push an older child on a swing set to keep them swinging at a certain height from the ground.

There are some products that have recently entered the market that defy easy inclusion into either the bouncy or swing category. One such product includes a motorized motion that can move the infant laterally, but only has a single degree of motorized freedom and is thus limited in the motion profiles that can be generated. While the seat can be rotated so that the baby is moved back and forth in a different orientation, there remains only one possible motion profile. There are other products that provide a two degree of freedom motion; however, the drive systems for these products is complex and expensive to manufacture.

A need exists for a motorized infant support that is capable of simultaneous or independent movement in at least two directions and that has a drive mechanism with less complexity and lower cost than the conventional drive mechanisms noted above.

DETAILED DESCRIPTION

Figure 1:
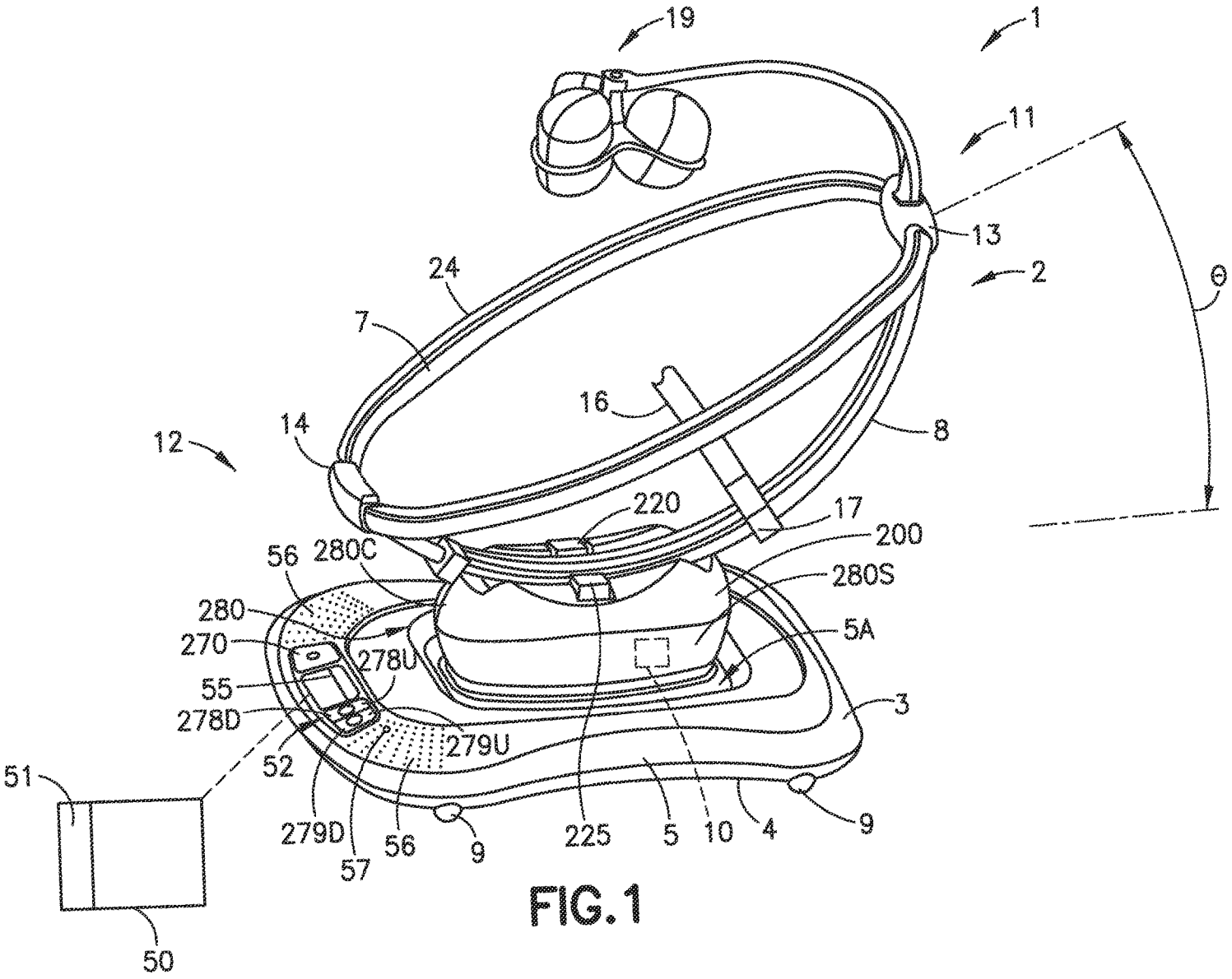
FIG. 1 is a perspective view of an infant care apparatus in accordance with aspects of the disclosed embodiment.

For purposes of the description hereinafter, the terms "upper", "lower", "right", "left", "vertical", "horizontal", "top", "bottom", "lateral", "longitudinal", and derivatives thereof shall relate to the aspects of the disclosed embodiment as it is oriented in the drawing figures. However, it is to be understood that the aspects of the disclosed embodiment may assume alternative variations and step sequences, except where expressly specified to the contrary. It is also to be understood that the specific devices and processes illustrated in the attached drawings, and described in the following specification, are simply exemplary of the aspects of the disclosed embodiment. Hence, specific dimensions and other physical characteristics related to the aspects of the disclosed embodiment disclosed herein are not to be considered as limiting.

Referring to FIGS. 1 and 1A-1E an infant care apparatus in accordance with aspects of the disclosed embodiment is illustrated. Although the aspects of the disclosed embodiment will be described with reference to the drawings, it should be understood that the aspects of the disclosed embodiment can be embodied in many forms. In addition, any suitable size, shape, or type of element or material could be used.

The aspects of the disclosed embodiment described herein provide for an infant care apparatus 1 with, for example, a hemispherical or hemi-spheroid shaped base. The hemispherical or hemi-spheroid shaped base has an electromechanical drive mechanism (with two or at least three independently controllable actuators) that provides the infant care device with at least an inverted pendulum motion path (see FIG. 17A) and/or at least a two degree of freedom inverted pendulum motion path (see FIGS. 17B-17C) as will be described herein. The aspects of the disclosed embodiment described herein also provide the infant care apparatus 1 with, for example, a rocker base having an electromechanical drive mechanism (with at least two independently controllable actuators) that provides the infant care apparatus 1 with at least an inverted pendulum motion path. In the aspects of the disclosed embodiments, the inverted pendulum motion path and/or the two degree of freedom inverted pendulum motion path may be combined with other axial motion paths (e.g., linear motion paths) or planar motion paths (e.g., rotational motion paths) as described herein to effect multi-axis motion of an infant support 2 of the infant care apparatus 1. In accordance with aspects of the disclosed embodiment, the infant support 2 is separable from a base 3 of the infant care apparatus 1 and a drive mechanism 10 of the infant care apparatus 1 may be distributed between the base 3 and the infant support 2 such that when separated the infant support 2 provides at least one degree of freedom movement to the infant support 2 and when coupled to the base 3 the combination of the base 3 and the infant support 2 provide at least two degree of freedom movement to the infant support 2.

In accordance with aspects of the disclosed embodiment, the infant care apparatus 1 generally includes a base 3, an infant support 2, and an infant support coupling 200 (or infant support receiver coupling 200C) arranged so as to releasably couple the infant support 2 to the base 3. The infant support 2 includes a mating support member 8, 8R which is configured to be engaged with the infant support coupling 200 (or infant support receiver coupling 200C) as will be described in greater detail below.

Figure 2A:
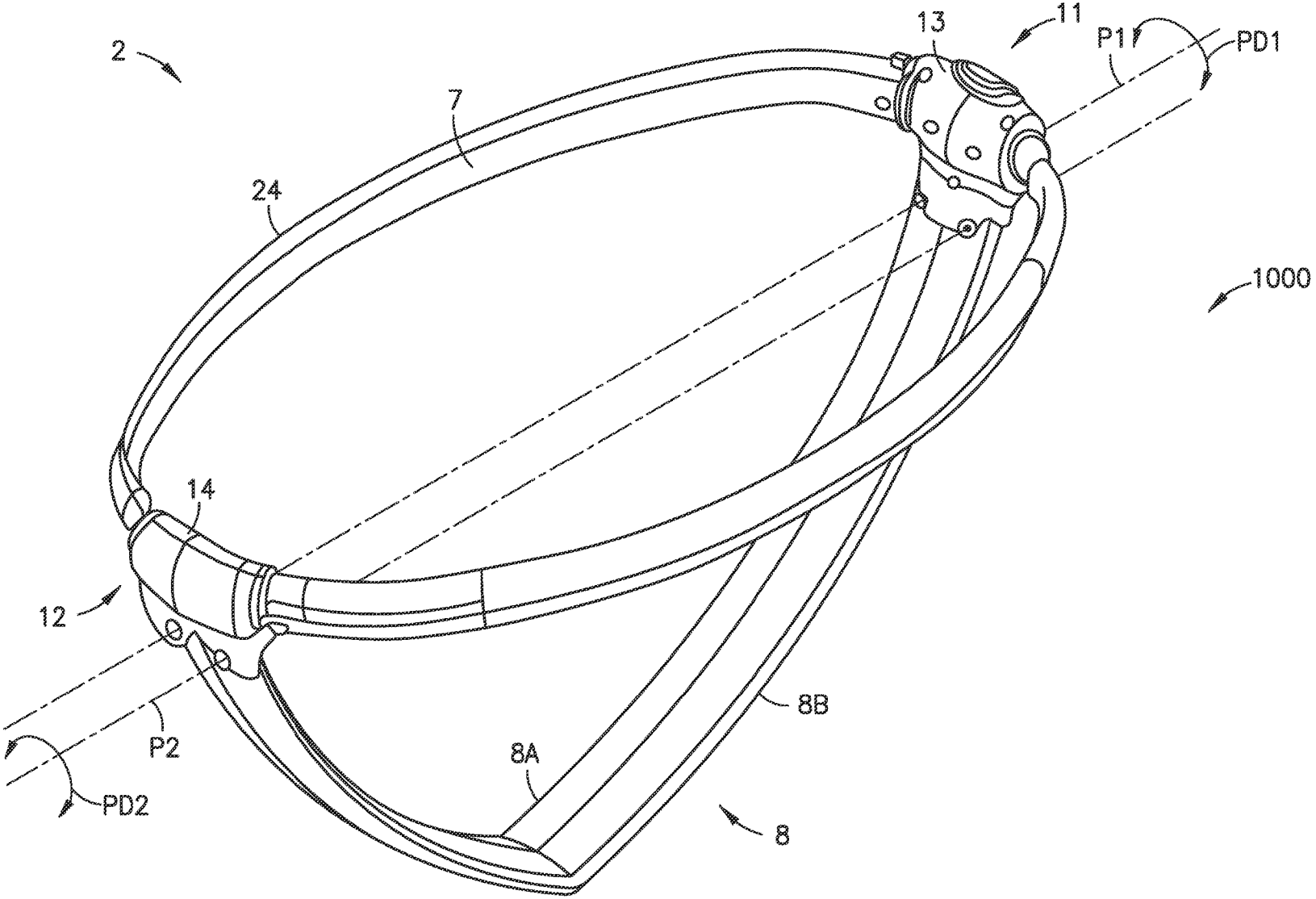
FIG. 2A is a perspective view of a portion of the infant care apparatus of FIG. 1 in accordance with aspects of the disclosed embodiment.
Figure 2B:
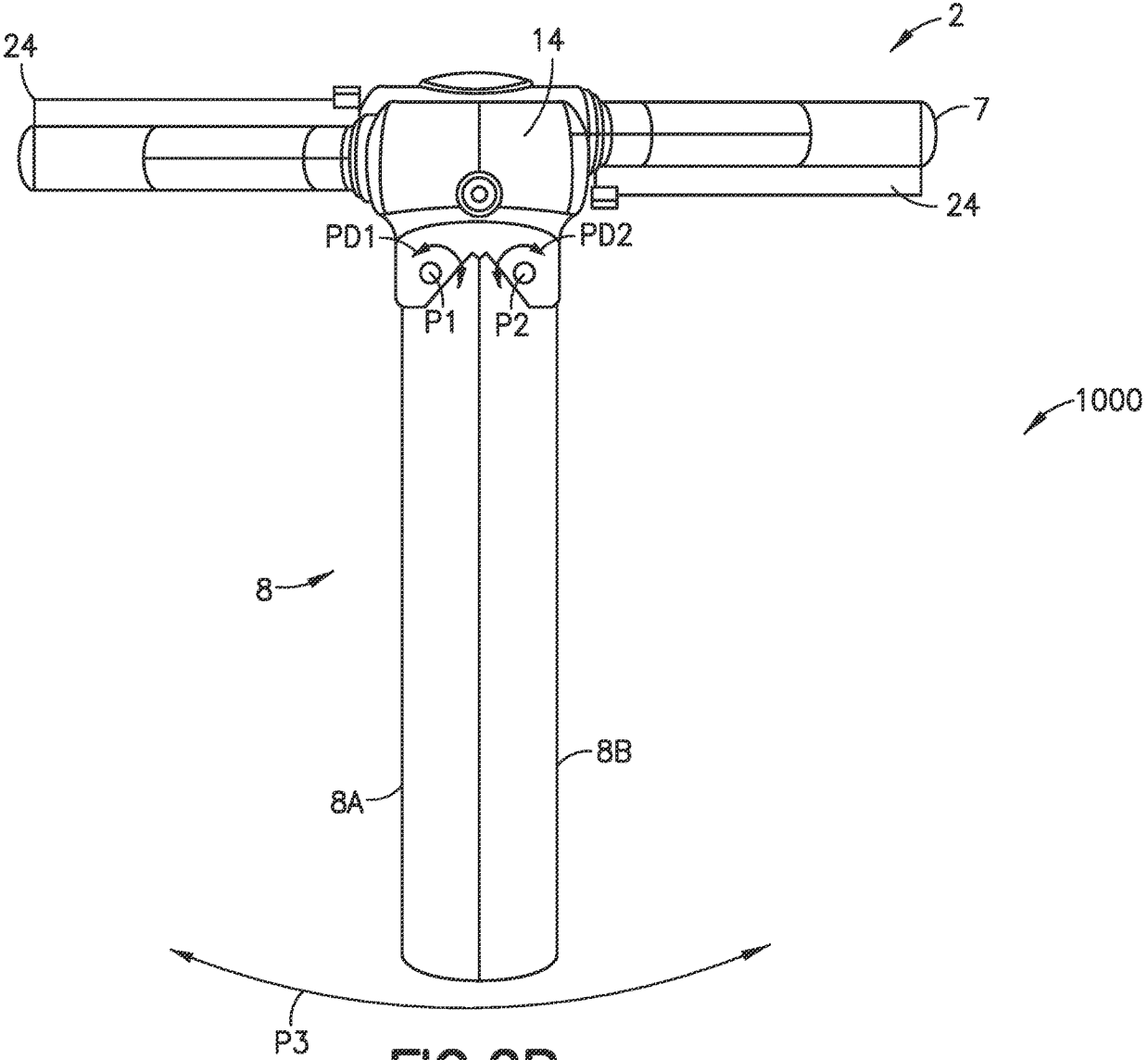
FIG. 2B is a side view of a portion of the infant care apparatus of FIG. 1 in accordance with aspects of the disclosed embodiment.

In one aspect, the infant support 2 is an infant seat 7; however, in other aspects the infant support may be a bed (such as a bassinet), where a suitable example of the bed can be found in U.S. patent application Ser. No. 17/025,674 titled Infant Care Apparatus and filed on Sep. 18, 2020. As illustrated in FIGS. 1 and 2A, the infant seat 7 is illustrated as being elliptical in shape; however, the infant seat 7 may be any other suitable shape, such as, square, rectangular, circular, etc. A suitable example of the infant seat can be found in U.S. Pat. No. 10,231,555 issued on Mar. 19, 2019, the disclosure of which is incorporated herein by reference in its entirety.

The infant seat 7 includes the mating support member or frame 8, 8R which is configured to support at least the weight of an infant or baby. In some aspects, as will be described herein, the mating support member or frame 8 forms a rocker 2R with rocker rails 2610R, 2611R, which in one or more aspects fixed relative to the seat 7. In some aspects, the infant seat 7 includes any suitable mobile 19 that may be fixed or releasably coupled to the infant seat 7 in any suitable manner. In one aspect, the infant seat 7 has an upper end 11 and a lower end 12. The infant seat 7 is configured to receive a fabric or other type of material so as to form a seating portion 15 for an infant or baby. The seating portion 15 may be coupled to the infant seat 7 using any suitable fastening mechanism, such as zippers 24. Here, zippers 24 are shown for exemplary purposes but in other aspects, the fastening mechanism can be hook and loop fabric, buttons, or any other suitable fastening mechanism. In one aspect, the seating portion 15 may further include straps 16 to secure the infant or baby to the seating portion 15. The straps 16 are coupled to the mating support member 8, 8R in any suitable manner, such as, with, e.g., clips, rivets, buttons, etc. provided on strap securing members 17. The straps 16 are fed through slots 26 provided in the seating portion 15 to connect into a crotch support 25 of the seating portion 15 to secure the infant or baby. In one aspect, the seating portion 15 and the straps 16 may be easily removed by a user for, e.g., cleaning or replacement. The straps 16, in one or more aspects, form a five-point harness (e.g., with two shoulder straps, two waist straps, and a submarine strap—see FIGS. 1B and 1C) for securing the infant within the infant seat 7; while in other aspects, the straps 16 may form a harness with any suitable number of anchor points/straps, such as a three point harness (e.g., with two waist straps and a submarine strap), for securing the infant within the infant seat 7.

Figure 13A:
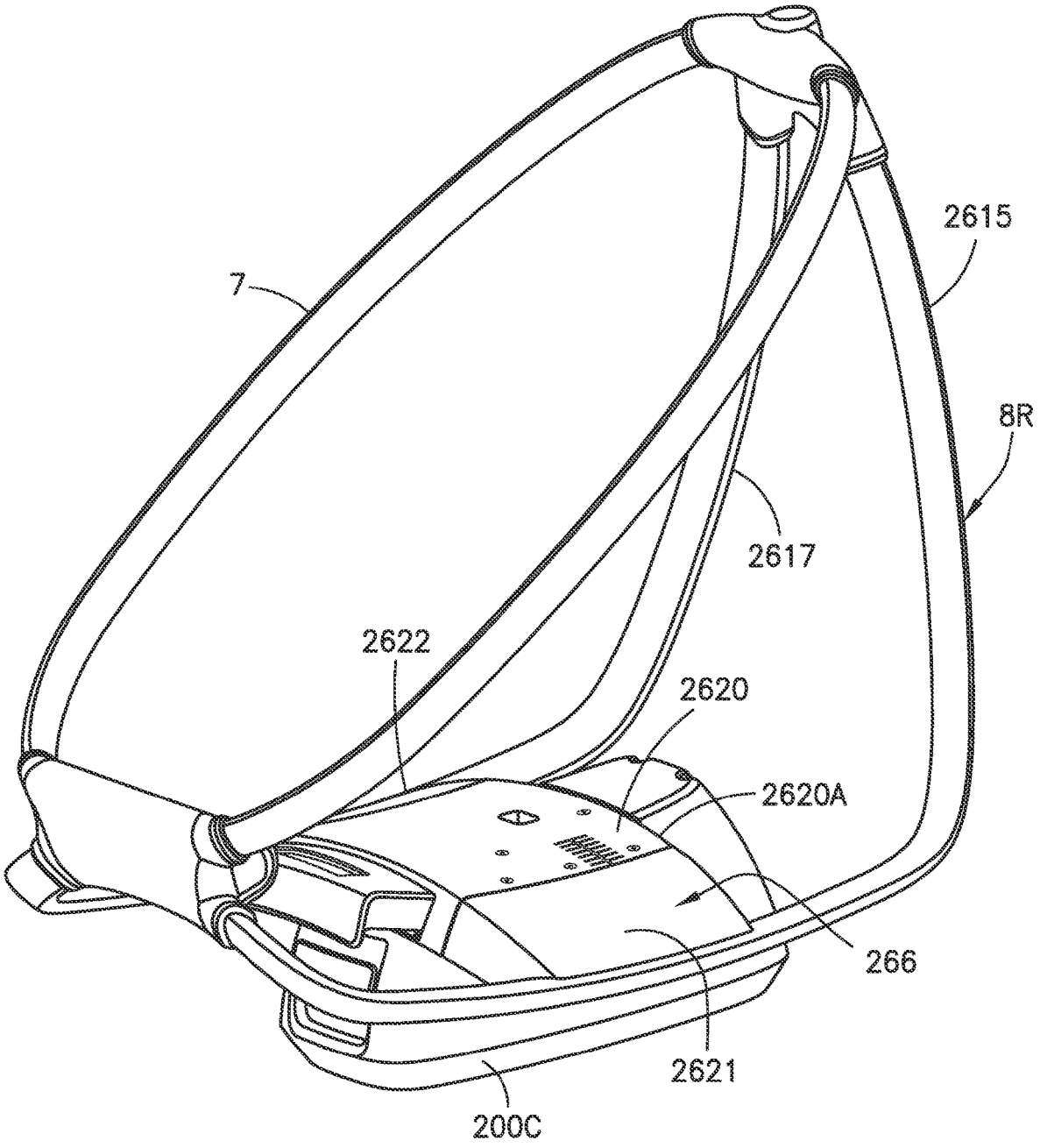
FIG. 13A is a perspective view of a portion of the infant care apparatus of FIG. 1C in a first orientation in accordance with aspects of the disclosed embodiment.
Figure 13B:
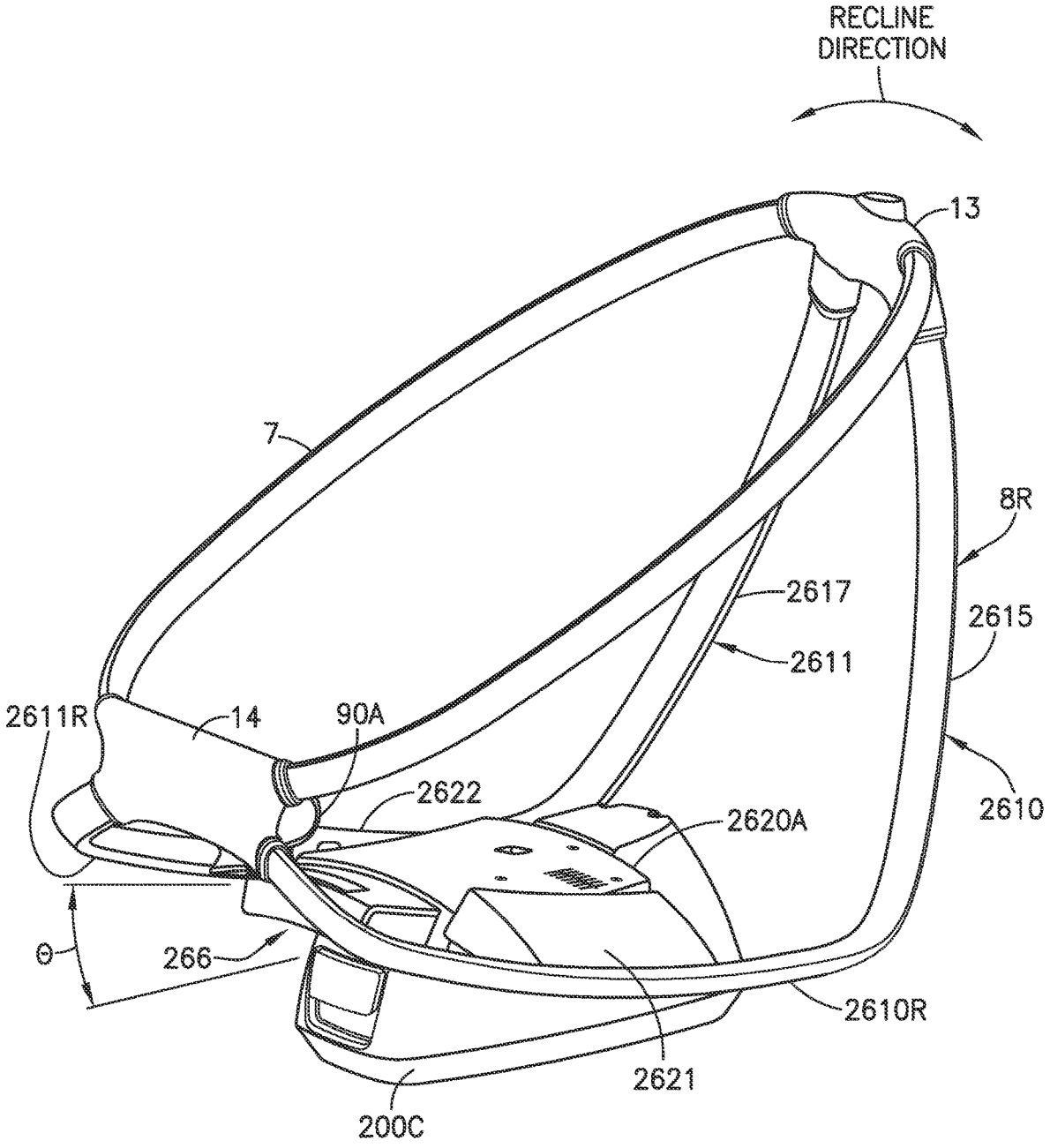
FIG. 13B is a perspective view of a portion of the infant care apparatus of FIG. 1C in a second orientation in accordance with aspects of the disclosed embodiment.

Referring also to FIGS. 1C, 1D and 2A-2D, the mating support member 8, 8R is connected to an upper end 11 of the infant seat 7 by an upper connector 13 and to a lower end 12 of the infant seat 7 by a lower connector 14. The mating support member 8, 8R has any suitable shape so that when coupled to the infant support coupling 200 (or infant support receiver coupling 200C), the mating support member 8, 8R orients the infant seat 7 in a predetermined position. For example, in one or more aspects, the mating support member 8, 8R may have a longitudinal axis extending between the upper end 11 and the lower end 12 of the infant seat 7, where the mating support member 8 forms an arc between the upper end 11 and the lower end 12 of the infant seat 7. Accordingly, the infant seat 7, with the mating support member 8, forms a cradle. The arc may allow for adjusting an angle θ (see FIG. 1) of the infant seat 7 or cradle relative to the base 3. In other aspects, the mating support member 8 may have arcuate portions (see FIG. 2A) coupled to each other so that the arcuate portions set the angle θ. In still other aspects, the mating support member 8R includes an articulated span member 266 (that will be further described herein) so that the articulated span member 266 sets the angle θ (see FIGS. 1C, 13A, and 13B).

Figure 2C:
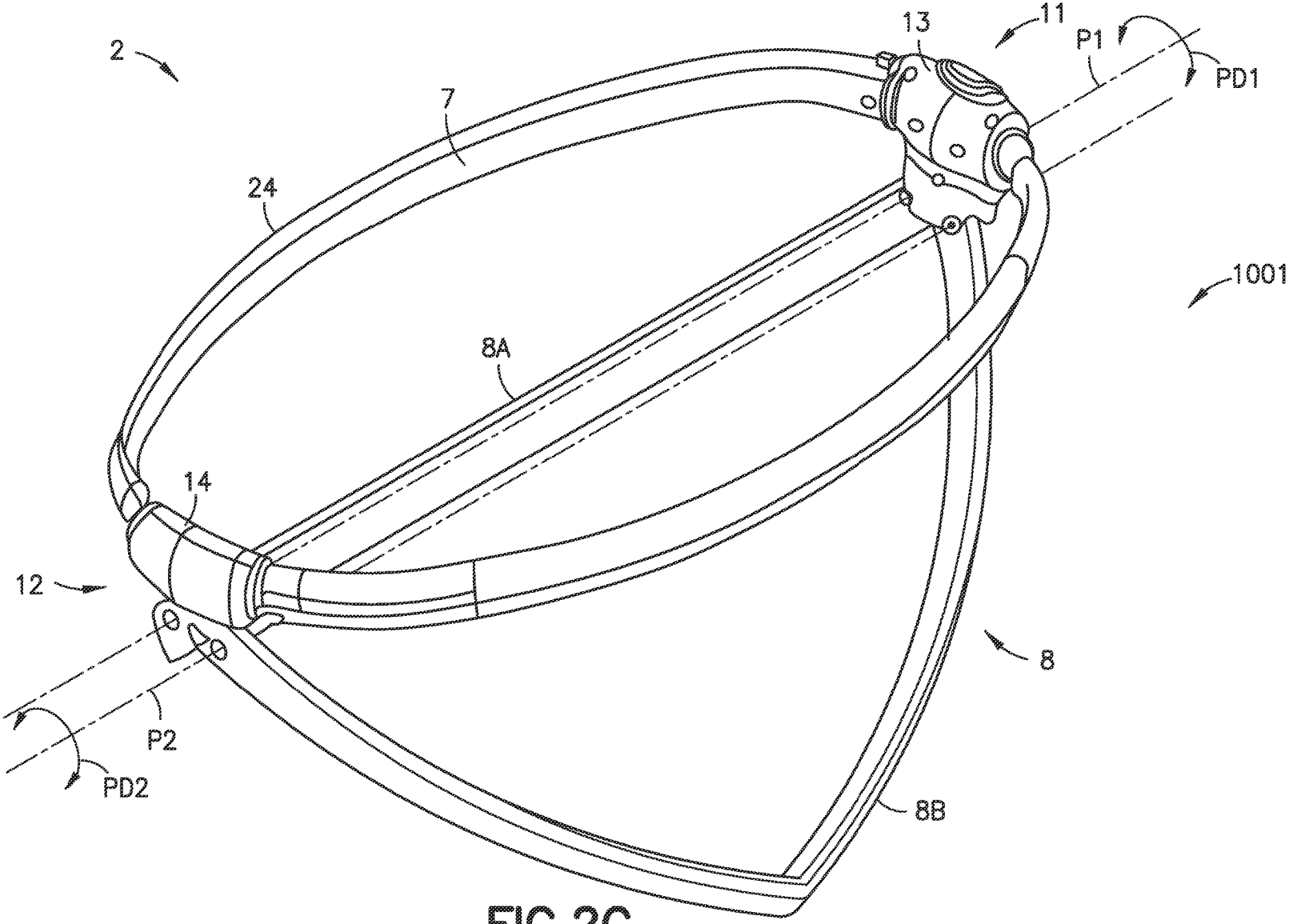
FIG. 2C is a perspective view of a portion of the infant care apparatus of FIG. 1 in accordance with aspects of the disclosed embodiment.
Figure 2D:
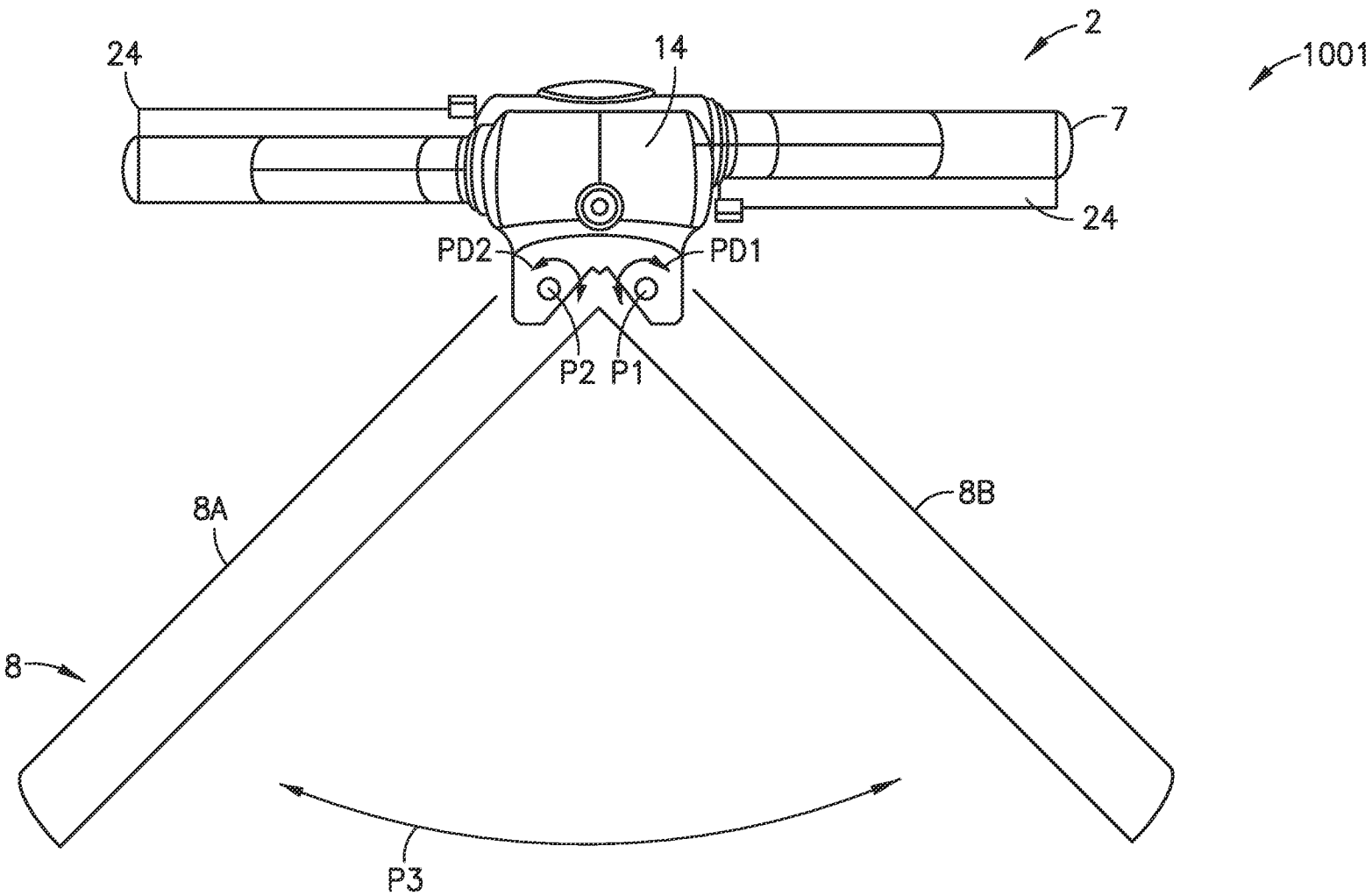
FIG. 2D is a side view of a portion of the infant care apparatus of FIG. 1 in accordance with aspects of the disclosed embodiment.
Figure 2E:
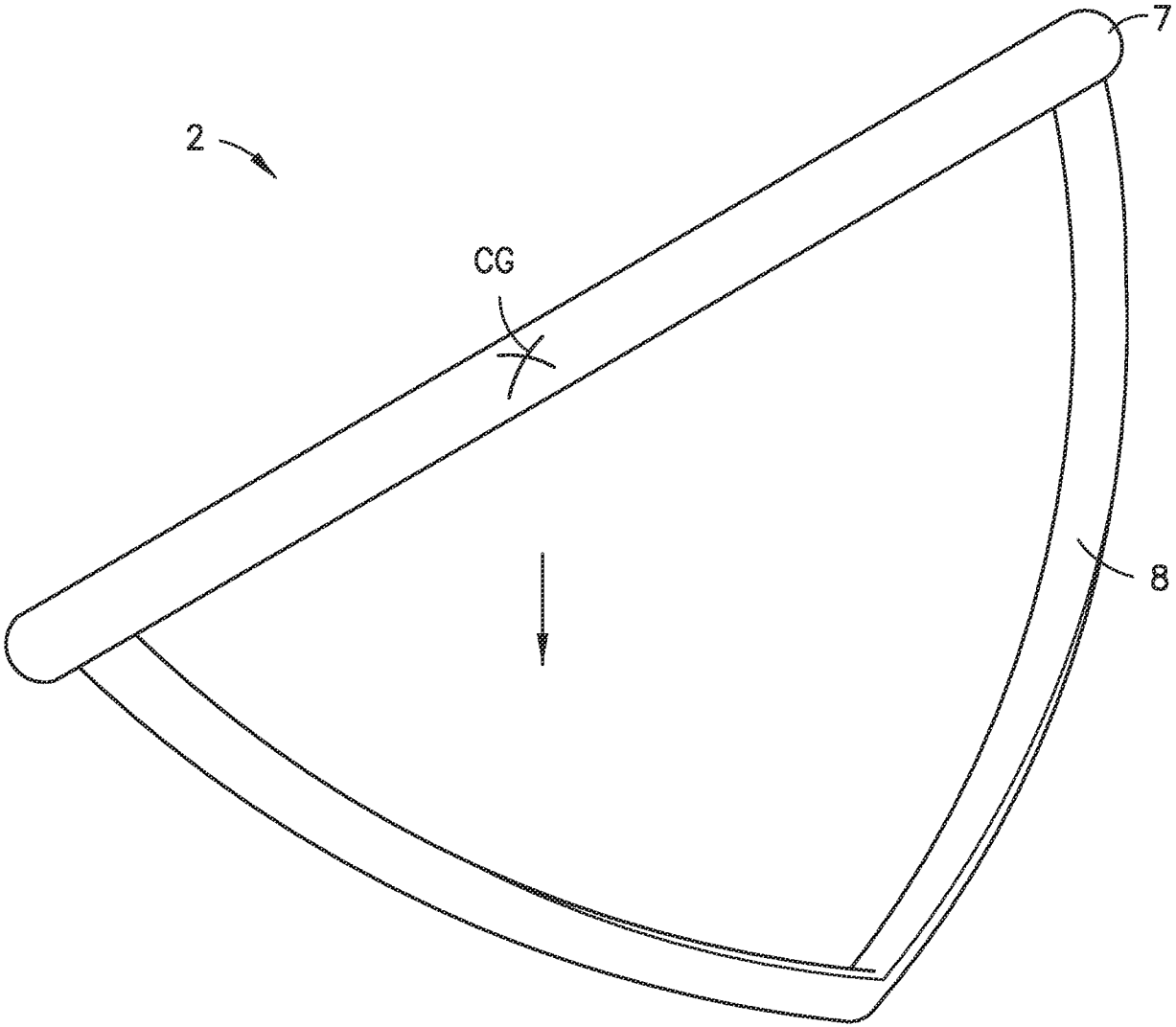
FIG. 2E is a side view of a portion of the infant care apparatus of FIG. 1 in accordance with aspects of the disclosed embodiment.

In one aspect, referring to FIGS. 2A-2E, the mating support member 8 is a bisected or divided support that includes two support tubes 8A, 8B arranged side by side along the longitudinal axis of the mating support member 8. The two support tubes 8A, 8B are pivotably coupled to the upper end 11 and lower end 12 of the infant seat 7 so as to pivot relative to one another in direction P3. The two support tubes 8A, 8B may pivot from a first position 1000 (FIGS. 2A and 2B), where the two support tubes 8A, 8B are positioned together to form a mountable base (mountable to the infant support coupling 200), to a second position 1001 (FIGS. 2C and 2D). In the second position 1001, the two support tubes 8A, 8B are pivoted apart from one another so as to form, e.g., support legs which are configured to independently support at least the weight of the infant support 2 and an infant or baby placed therein, such as, on a floor surface. For example, support tube 8A may pivot about axis P1 in direction PD1 from the first position 1000 to the second position 1001. Support tube 8B may pivot about axis P2 in direction PD2 from the first position 1000 to the second position 1001. In one aspect, where the mating support member 8 has 2 arcuate portions, the center of gravity CG (FIG. 2E) of the infant is positioned over the two arcuate portions so that the infant seat 7 is stably supported on the arcuate portion so as to cradle and rock with a predetermined range of motion without unstable transition to the other arcuate portion. Any suitable clips, snaps, etc. may be provided to releasably couple the support tube 8A and support tube 8B together in the first position 1000.

Figure 1A:
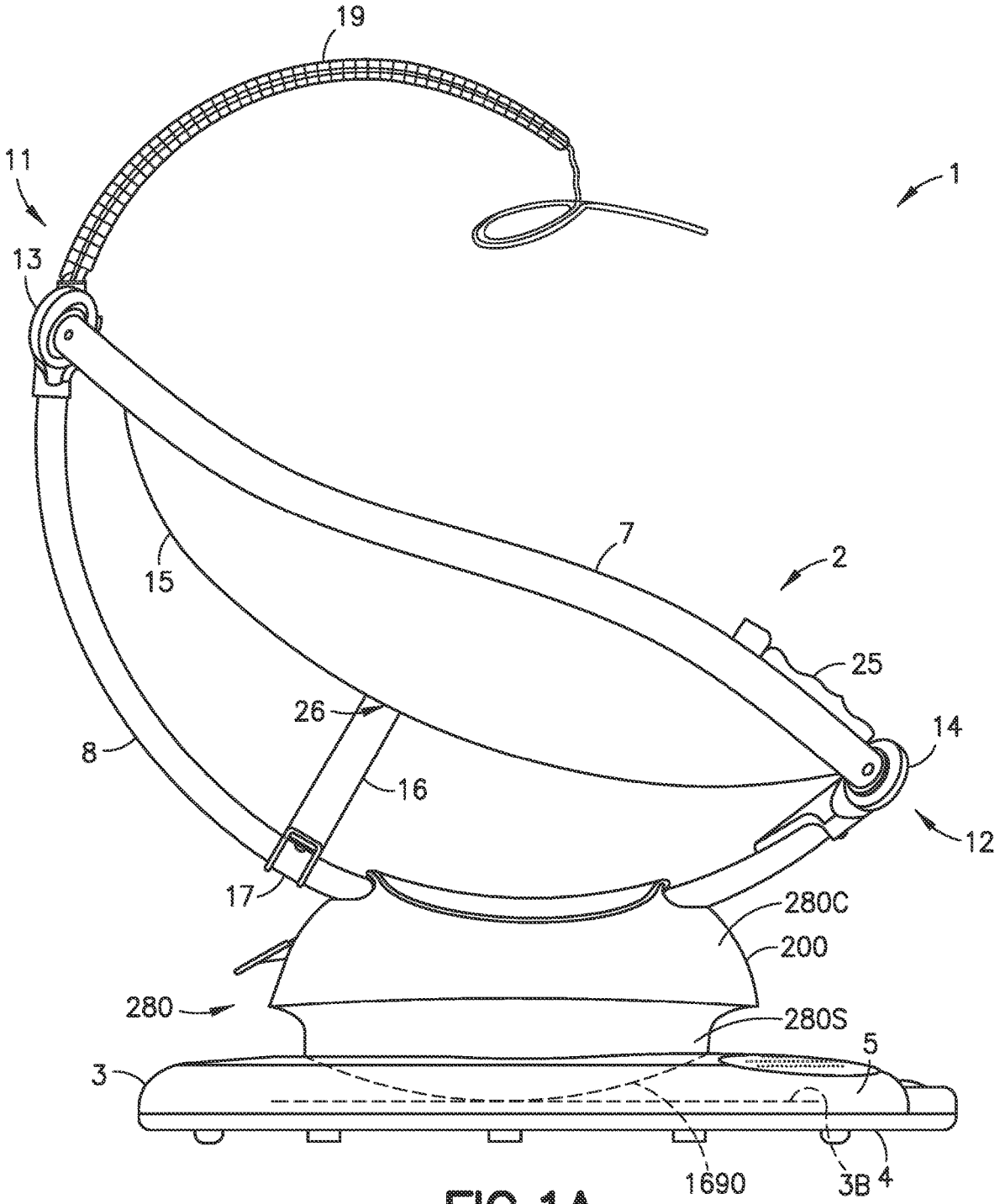
FIG. 1A is a side view of the infant care apparatus of FIG. 1 in accordance with aspects of the disclosed embodiment.
Figure 1B:
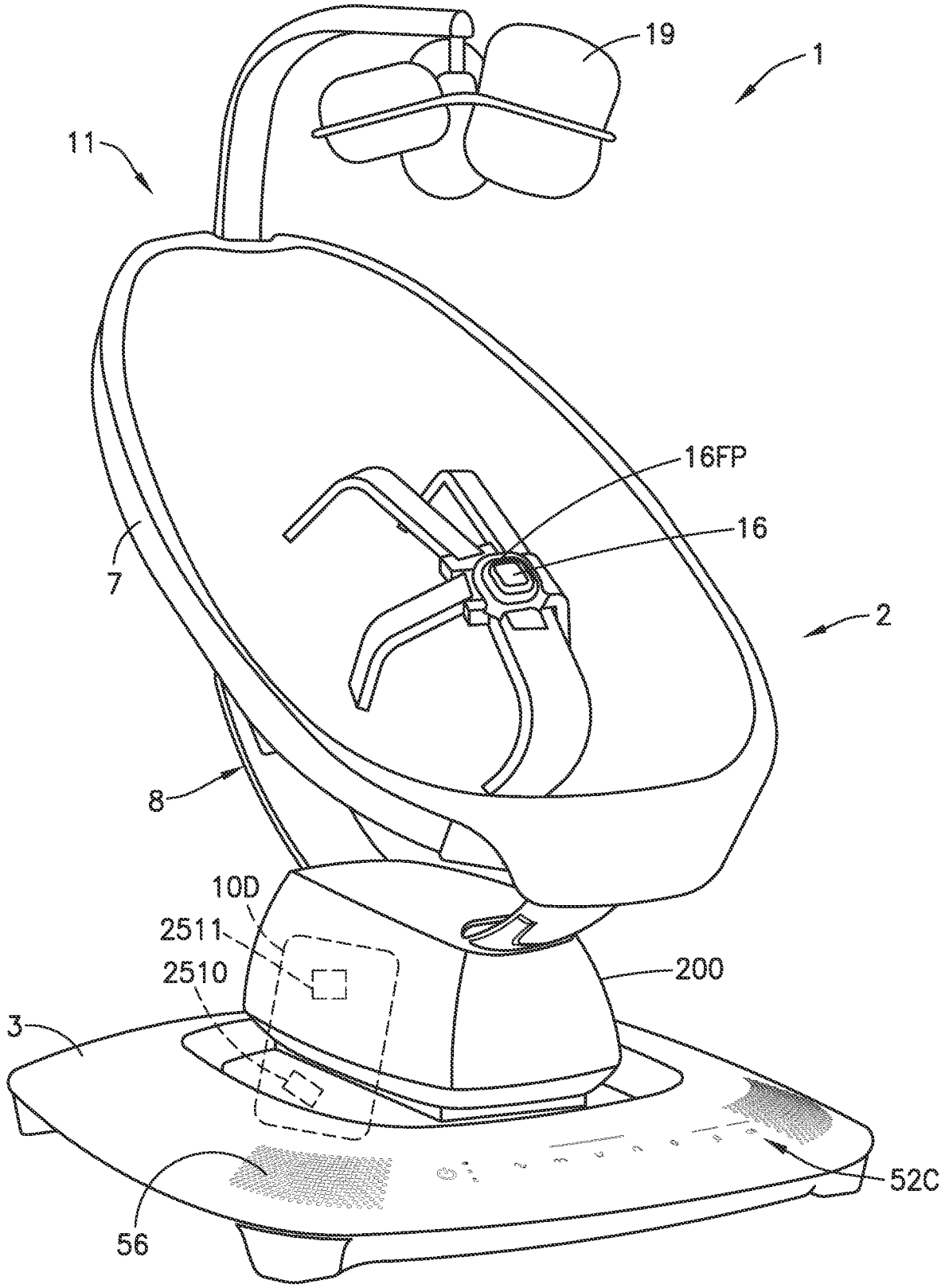
FIG. 1B is a perspective view of an infant care apparatus in accordance with aspects of the disclosed embodiment.
Figure 1C:
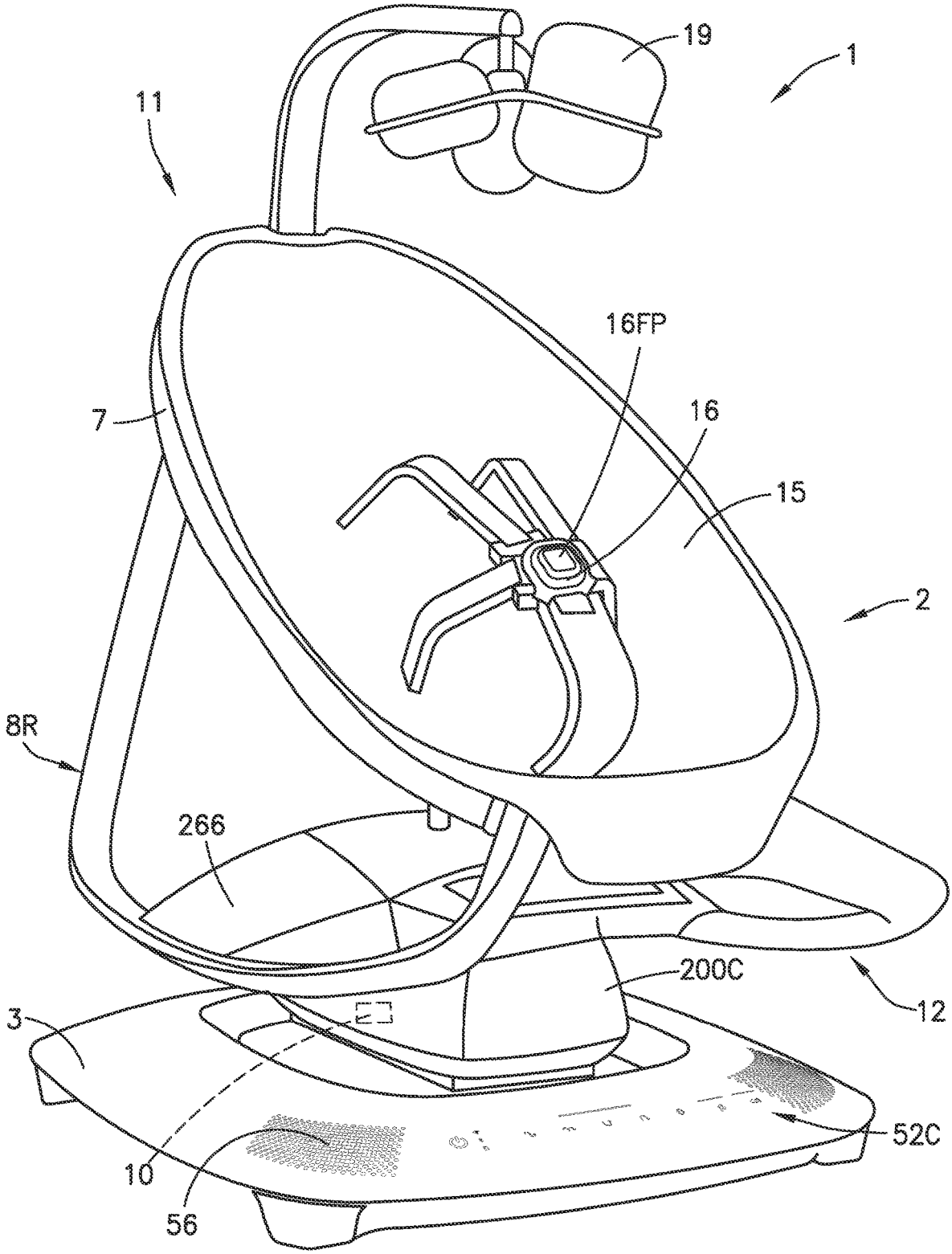
FIG. 1C is a perspective view of an infant care apparatus in accordance with aspects of the disclosed embodiment.
Figure 1D:
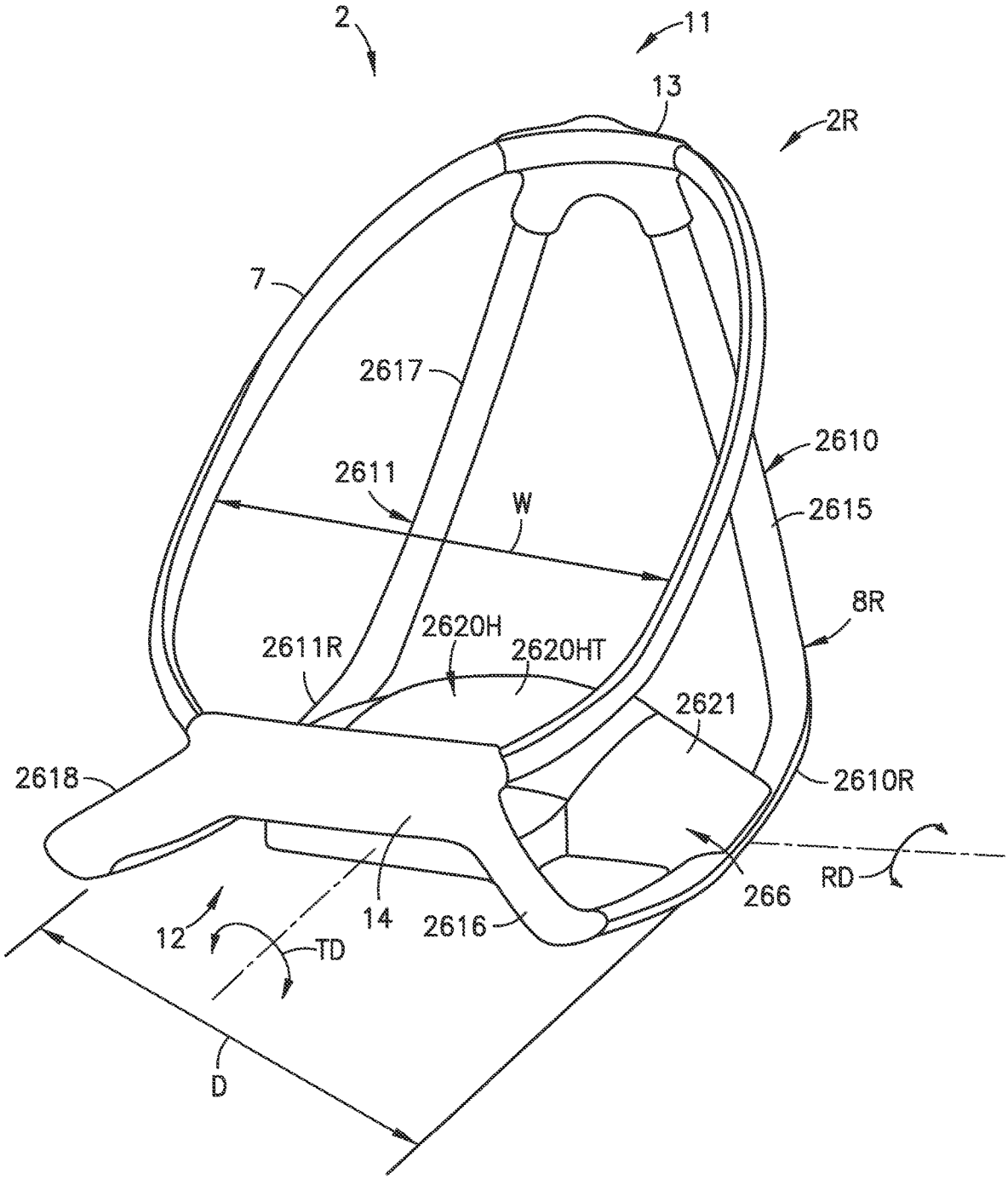
FIG. 1D is a perspective view of a portion of the infant care apparatus of FIG. 1C in accordance with aspects of the disclosed embodiment.
Figure 1E:
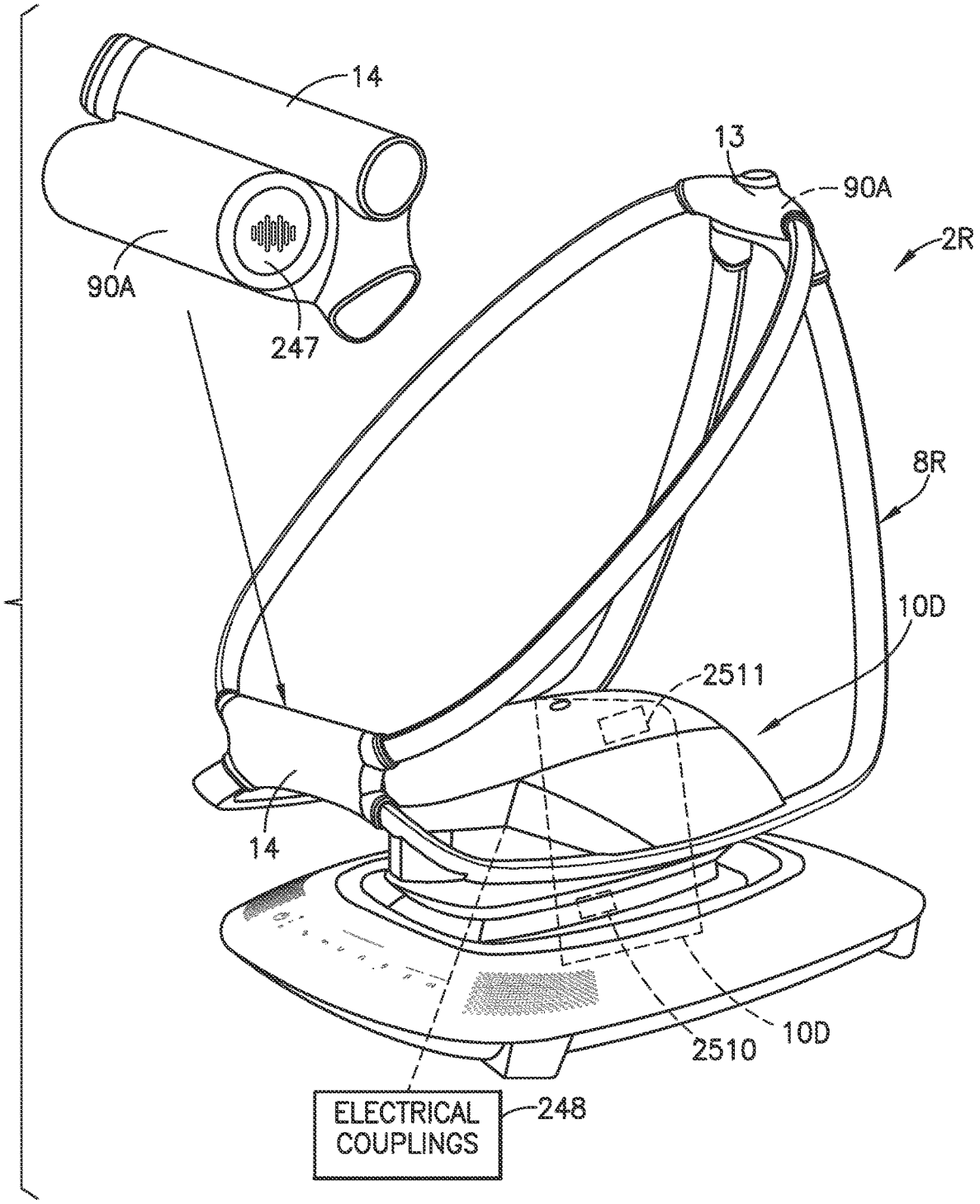
FIG. 1E is a perspective view of a portion of the infant care apparatus of FIG. 1C in accordance with aspects of the disclosed embodiment.

Referring to FIGS. 1C-1E, the mating support member 8R includes supports 2610, 2611. Each of the supports 2610, 2611 includes a rocker portion 2610R, 2611R (also referred to herein as rocker rails) and stretcher portions 2615-2618.

Here the rocker portions 2610R, 2611R are coupled to the upper end 11 of the infant seat 7 at the upper connector 13 by a respective stretcher portion 2615, 2617. The rocker portions 2610R, 2611R are also coupled to the lower end 12 of the infant seat 7 at the lower connector 14 by respective stretcher portion 2616, 2618. The rocker portions 2610R, 2611R have an arcuate shape so as to form a cradle with the infant seat 7 that has a center of gravity CG (substantially similar to that shown in FIG. 2E) that is positioned over the rocker portions (or rocker rails) 2610R, 2611R so that the infant seat 7 is stably supported on the rocker portions 2610R, 2611R so as to cradle and rock with a predetermined range of motion without unstable transition to the stretcher portions 2615-2618. In this aspect, the supports 2610, 2611 extend upper end 11 and lower end 12 of the infant seat so that the rocker portions 2610R, 2611R are separated from each other by a predetermined distance D. The predetermined distance D is any suitable distance that provides for stable support of the infant seat 7 in a direction TD that is transverse to a rocking direction RD of the infant seat 7. For exemplary purposes only, the distance D may be substantially equal to or greater than a width W of the infant seat; while in other aspects the distance D may be less than the width W of the infant seat 7. The articulated span member 266, which will be described in greater detail below, is coupled to each of the rocker portions 2610R, 2611R and spans the distance D between the rocker portions 2610R, 2611R. The articulated span member 266 provides for coupling the infant seat 7 to the base 3 and for adjusting the angle θ of the infant seat 7 when the infant seat 7 is coupled to the base 3.

Figure 14A:
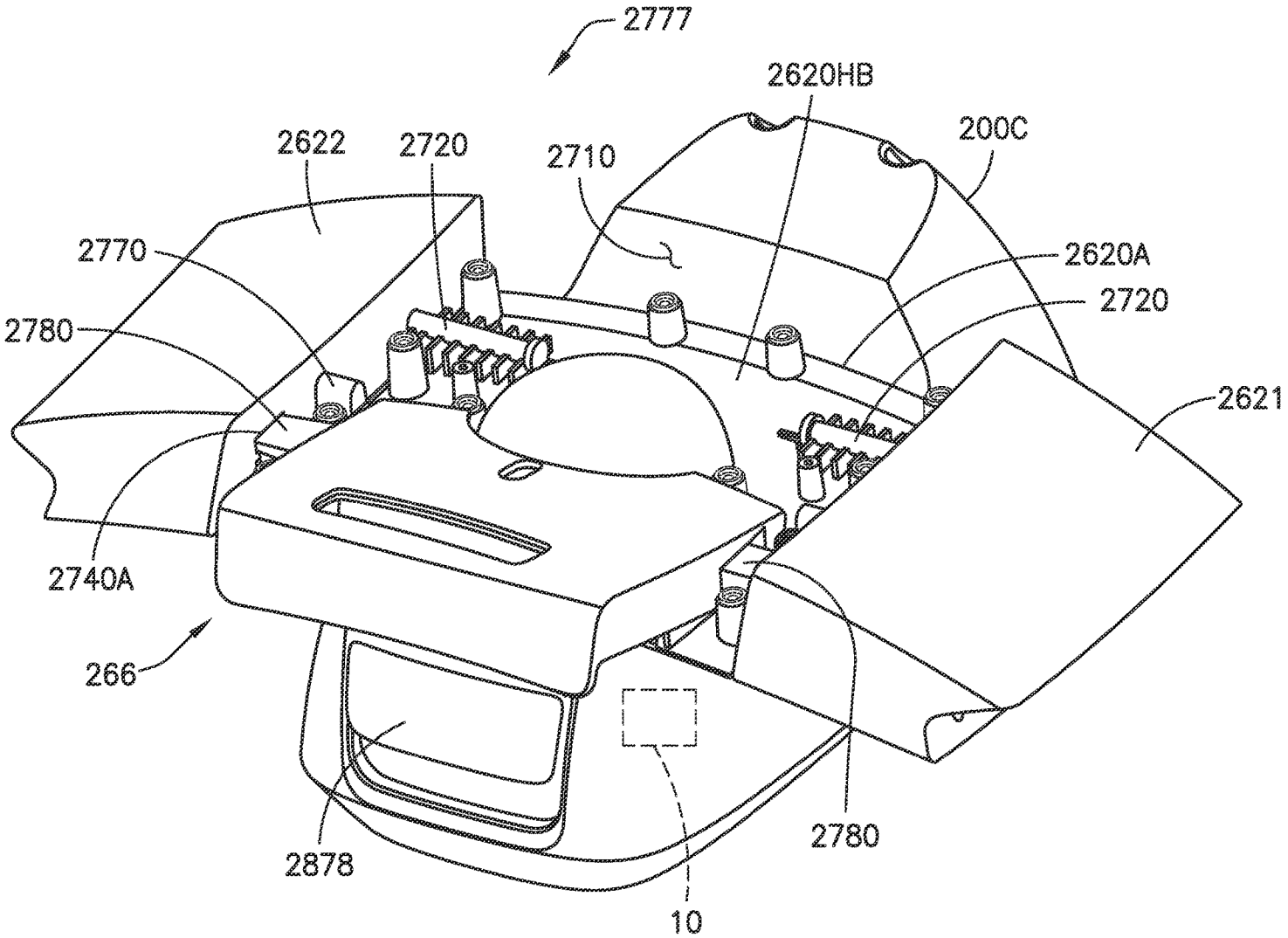
FIG. 14A is a perspective view of a portion of the infant care apparatus of FIG. 1C in the first orientation of FIG. 13A in accordance with aspects of the disclosed embodiment.
Figure 14B:
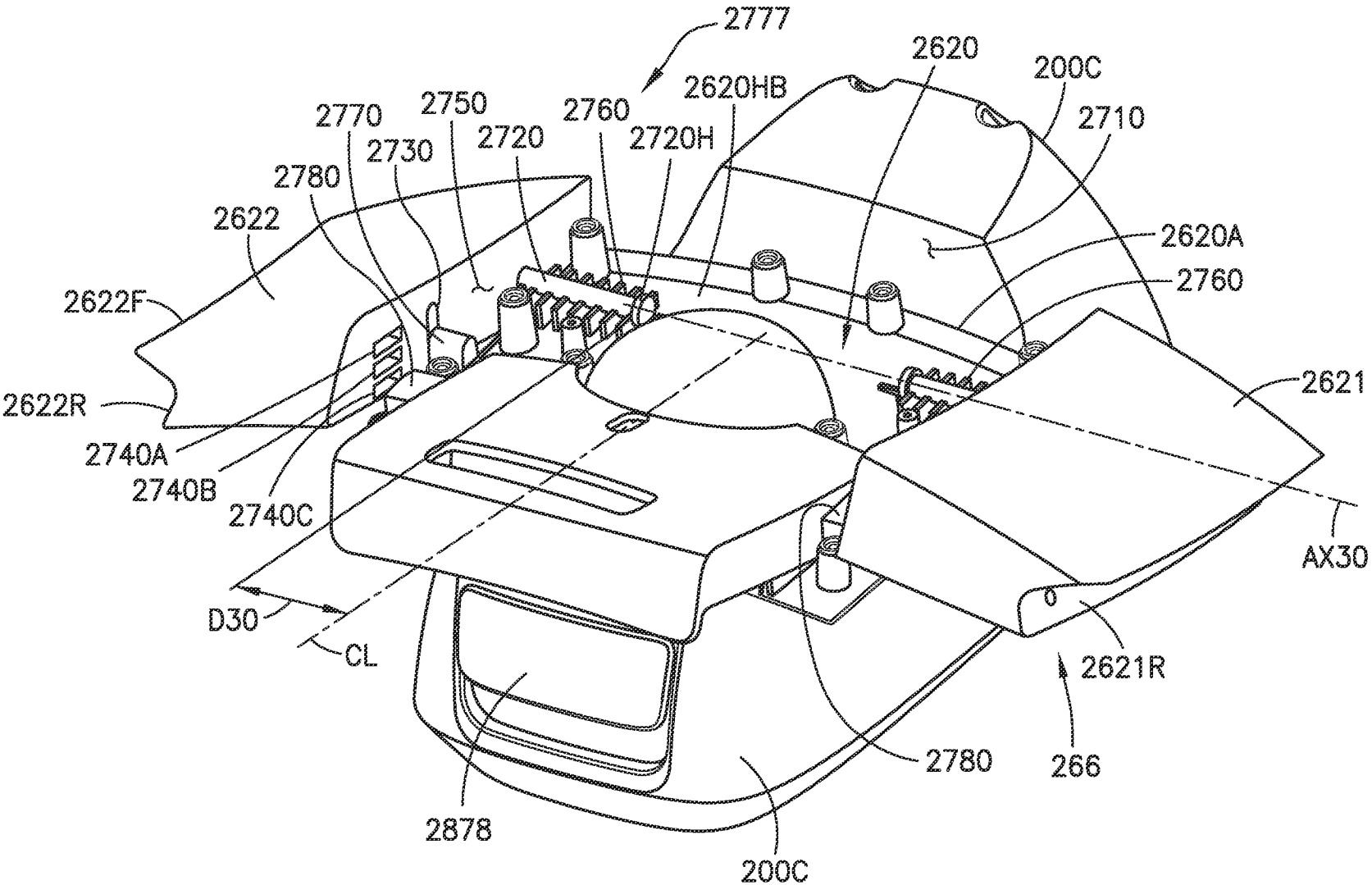
FIG. 14B is a perspective view of the portion of the infant care apparatus of FIG. 14A in the second orientation of FIG. 13B in accordance with aspects of the disclosed embodiment.
Figure 14C:
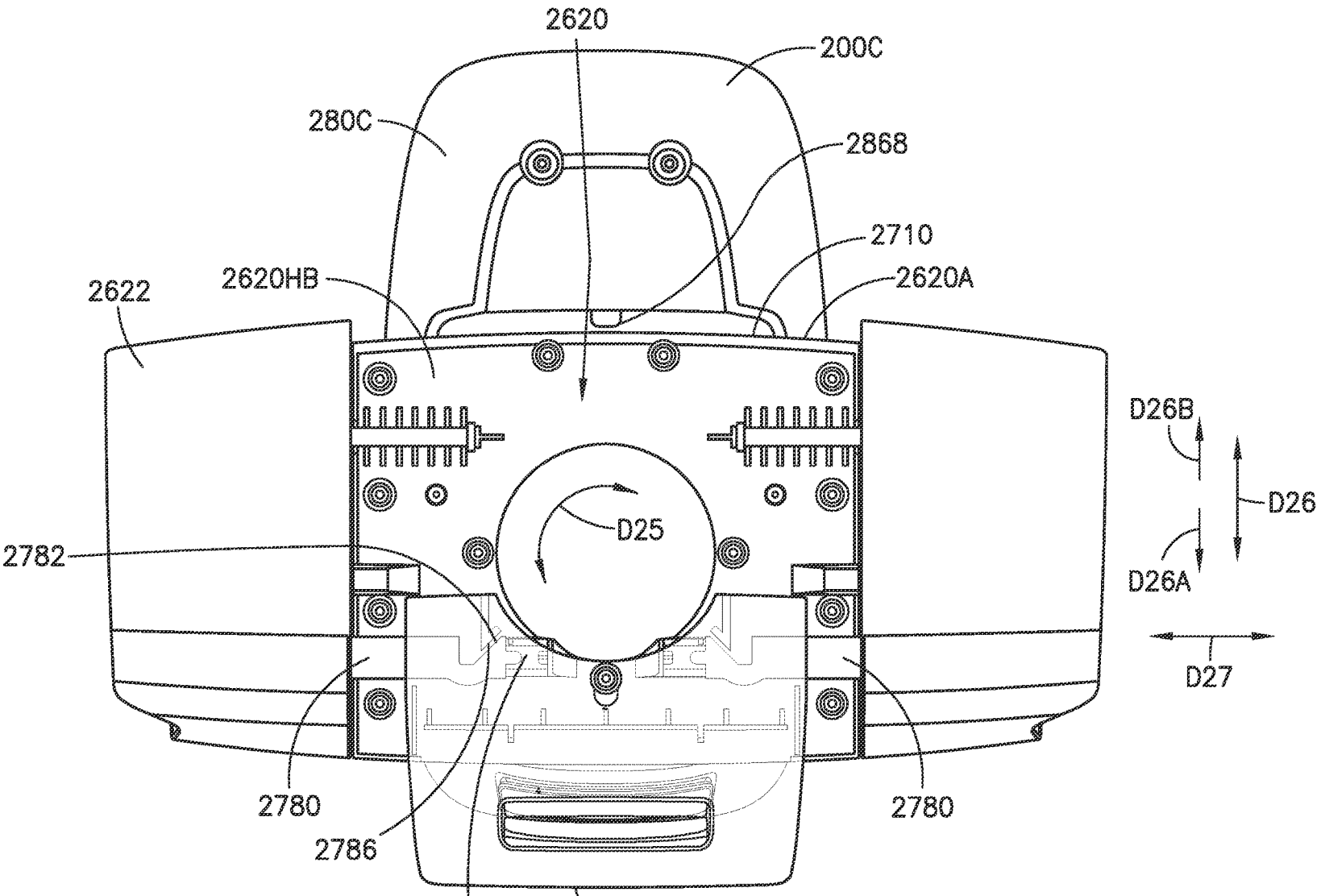
FIG. 14C is a schematic plan illustration of the portion of the infant care apparatus of FIG. 14A in accordance with aspects of the disclosed embodiment.

Referring to FIGS. 1C, 1D, 13A-14C, the articulated span member 266 (also referred to herein as an infant support coupling 266) includes a base 2620 (which only a portion of which is illustrated in FIGS. 14A-14C) and articulating supports 2621, 2622. The infant support coupling or span member 266 is arranged to releasable couple the infant support 2 and the base 3 so as to mount and dismount the infant support 2 to the base 3, wherein the infant support coupling 266 depends from the rocker rails (or rocker portion) 2610R, 2611R and has an integral recline adjustment mechanism 2777 of the rocker 2R. The base 2620 is configured to couple with the infant support receiver coupling 200C as described herein and has an actuable grip 2888 that engages the infant support coupling 266, the grip 2888 being configured to actuate between a closed position and an open position to capture and release the infant support 2 to the base 2620, wherein the grip actuation is separate and distinct from recline adjustment of the rocker 2R. The articulating supports 2621, 2622 form a part of the recline adjustment mechanism 2777 and each have a rocker coupling surface 2621R, 2622R that mates with a respective rocker portion 2610R, 2611R in any suitable manner (e.g., such as with any suitable fasteners) so that the infant seat 7 is suspended by the articulated span member 266 when the infant seat 7 (including the articulated span member 266) is coupled to the infant support receiver coupling 200C. Each of the articulating supports 2621, 2622 is rotatably coupled to the base 2620 so as to be indexable in rotation to adjust the angle θ of the infant seat 7 when the infant seat 7 is coupled to the base 3. Coupling of the articulating supports 2621, 2622 with the base 2620 of the articulated span member 266 will be described with respect to articulating support 2622; however, it should be understood that the coupling between articulating support 2621 and the base 2620 is substantially similar (but opposite in hand) and like reference numerals will be used with respect to the coupling of the articulating supports 2621, 2622 with the base 2620. It is also noted that the configuration of the base 2620 and articulating supports 2621, 2622 described herein are exemplary and that the base 2620 and articulating supports 2621, 2622 may have any suitable configurations that effect coupling of the articulated span member 266 to the rocker portions 2610R, 2611R and the infant support receiver coupling 200C.

In accordance with one or more aspects of the disclosed embodiment, the recline adjustment mechanism 2777 will be described. The recline adjustment mechanism 2777 is disposed to adjust at least one of rocker rail incline and seat incline with respect to the base 2620. The recline adjustment mechanism 2777 also has an adjustment handle 2785, separate and distinct from a grip actuation handle 2878 (also referred to as a cam lever) configured to actuate the actuable grip 2888. For exemplary purposes, the articulating support 2622 includes a frame 2622F that forms the rocker coupling surface 2622R. The frame 2622F has any suitable shape and size for coupling the respective rocker portion 2611R to the base 2620. The frame 2622F includes a base interface surface 2750 that faces the base 2620 when the articulating support 2622 is coupled to the base 2620. A pivot pin 2720 extends from the frame 2622F so as to protrude from the base interface surface 2750, where the pivot pin 2720 is coupled to the frame 2622F in any suitable manner (e.g., such as with any suitable fasteners or integrally formed therewith). The interface surface 2750 includes a guide slot 2730 and at least two pivot stop apertures 2740A-2740C (three are shown for exemplary purposes), where the pivot stop apertures 2740A-2740C are substantially radially arranged about a pivot axis AX30 at any suitable predetermined angular intervals formed at least in part by the pivot pin 2720.

The base 2620 includes a housing 2620H that includes a housing bottom 2620HB and a housing top 2620HT that are coupled to each other in any suitable manner, such as with any suitable fasteners. The housing 2620H forms a bearing 2760 (part of which is illustrated in FIGS. 14A-14C) that receives the pivot pin 2720 and locates the pivot pin 2720 (and the articulating support 2622) relative to the base 2620. For example, the bearing 2760 forms, with the pivot pin 2720, the pivot axis AX30 and sets a lateral distance D30 of the pivot pin from, for example, a centerline CL of the base 2620. For example, the pivot pin 2720 includes a head 2720H that is laterally held captive by the bearing 2760 so as to control the lateral distance D30 and provide a running clearance between the base interface surface 2750 and the housing 2620H. In the example shown the bearing 2760 is integrally formed with the housing bottom 2620HB and a housing top 2620HT; however, in other aspects, the bearing 2760 may have any suitable configuration and be coupled to the housing 2620H in any suitable manner.

The housing 2620H includes a pivot guide 2770 that extends from one or more of the housing bottom 2620HB and housing top 2620HT. The pivot guide 2770 extends through the guide slot 2730 and guides, through interface with the guide slot 2730, pivoting movement of the articulating support 2622 about the pivot axis AX30. It is noted that the guide slot 2730 has a length that limits the rotation of the articulating support 2622 about the pivot axis AX30 to any suitable angular range of rotation so as to prevent undesired tipping of the infant seat 7 beyond a predetermined rotation range when the infant seat is coupled to the base 3.

The base 2620 includes pivot-lock arms 2780 that are configured to extend into and retract from the pivot stop apertures 2740A-2740C for adjusting the angle θ of the infant seat 7 when the infant seat 7 is coupled to the base 3. Each pivot-lock arm 2780 is slidably mounted to the housing 2620H so as to reciprocate in direction D27. Any suitable resilient member 2781 (such as a coil spring, resilient foam, etc.) is provided within the housing 2620H and is configured to bias the respective pivot-lock arm 2780 to an extended position (i.e., towards the respective articulating support 2621, 2622) and into one of the pivot stop apertures 2740A-2740C. It is noted that while the pivot-lock arms 2780 and the pivot stop apertures 2740A-2740C are illustrated as having a rectangular cross section, in other aspects, the pivot-lock arms 2780 and the pivot stop apertures 2740A-2740C may have any suitable cross-section.

Actuation of the pivot-lock arm 2780 from the extended position (e.g., extending through one of the pivot stop apertures 2740A-2740C—shown in FIG. 14A) to a retracted position (shown in FIGS. 14B and 14C) for allowing pivoting movement of the infant seat 7 relative to the base 3 is provided by handle 2785. The handle 2785 is movable coupled to the base 2620 so as to move substantially in direction D26. Here each pivot-lock arm 2780 includes a cam surface 2782 and the handle 2785 includes a mating cam surface 2786 such that movement of the handle 2785 in direction D26A causes mating cam surface 2786 to engage cam surface 2782 thereby moving the pivot-lock arms 2780 in direction D27 towards the centerline CL of the base 2620 (against the bias provided by resilient member 2781) to retract the pivot-lock arms 2780 from the pivot stop aperture 2740A-2740C. Retracting the pivot-lock arms 2780 from the pivot stop aperture 2740A-2740C provides for rotational movement of the articulating supports 2621, 2622 about the pivot axis AX30 for adjusting the angle the angle θ of the infant seat 7 relative to the base 3. Movement of the handle 2785 in direction D26B disengages mating cam surface 2786 from cam surface 2782 such that the bias from the resilient members 2871 moves the pivot-lock arms 2780 away from the centerline CL of the base 2620 and extends the pivot-lock arms 2780 into a respective one of the pivot stop apertures 2740A-2740C. Extension of the pivot-lock arms 2780 into the respective pivot stop aperture 2740A-2740C arrests/prevents rotational movement of the articulating supports 2621, 2622 (and the infant seat 7) relative to the base 3 and sets/locks the angle θ to a predetermined infant seat recline angle that corresponds with a selected pivot stop aperture 2740A-2740C (e.g., a lockable recline position of the infant seat 7 is provided). In one or more aspects, the handle 2785 is biased in direction D26B through interface between cam surface 2782 and mating cam surface 2786 and the biasing force of the resilient members 2781. In other aspects, the handle 2785 is biased in direction D26B with any suitable biasing member (e.g., springs, resilient foam, etc.).

Referring to FIGS. 1, 1A, and 1C, the base 3 of the infant care apparatus 1 includes a bottom support housing 4, a top enclosure 5 positioned over and at least partially covering the bottom support housing 4 a housing 280 including a cover 280C and a skirt 280S, and a housing base 281. In one aspect, the housing 280 is configured to house the infant support coupling 200. The infant support coupling 200 is disposed in the housing such that the housing cover 280C at least partially encloses the infant support coupling 200 and the skirt 280S extends from the housing cover 280C so as to circumscribe or surround at least a portion of the drive mechanism 10 that extends through a surface 5A of the top enclosure 5. The housing base 281 is configured to couple the infant support coupling 200 to the drive mechanism 10 (FIG. 14) as will be further described herein. The top enclosure 5 includes the surface 5A which at least partially covers an opening through which the drive mechanism 10, supported on the bottom support housing 4, extends as will be further described herein. The surface 5A may be an articulated surface configured so that the opening formed therein moves with the drive mechanism 10.

In one aspect, the base 3 may have fixed or detachable legs 9. In one aspect, the legs 9 may be adjustable to raise or lower a height of the infant care apparatus 1 relative to, e.g., a floor surface or table on which the infant care apparatus 1 is placed. The legs 9 include feet 9A that are contoured or otherwise shaped and sized so that the legs 9 slide easily across a floor surface. For example, the feet 9A may have curved edges to substantially avoid snagging of the feet 9A on the flooring surface as the infant care apparatus 1 slides across the floor surface under the influence of an external motive force. In one aspect, the base 3 may further include a storage basket 18 provided to storage infant or baby gear, accessories, etc. The storage basket 18 may be mounted to the legs 9 or any other suitable portion of the infant care apparatus 1. In one aspect, the base 3 may include a portable music player dock 55, with speakers 56 and an input jack 57, for playing music or other pre-recorded sounds.

Referring now to FIGS. 1, 3, 4, 5A-5F, and 6 the mating support member 8 of the infant support 2 is configured so as to be releasably coupled to the base 3. Coupling of the infant support 2 is described herein with respect to the infant seat 7, however, it should be understood that in some aspects, the infant bed 6 may be coupled to the base 3 in a substantially similar manner using the mating support member 8 shown in FIGS. 1 and 1A. As noted above, the infant care apparatus 1 includes the infant support coupling 200 arranged so as to releasably couple the mating support member 8 of the infant support 2 to the base 3. The infant support coupling 200 includes a movable support 210 and automatically actuable grip members 220, 225 such as on placement of the infant seat 7 onto the infant support coupling 200.

Figure 3:
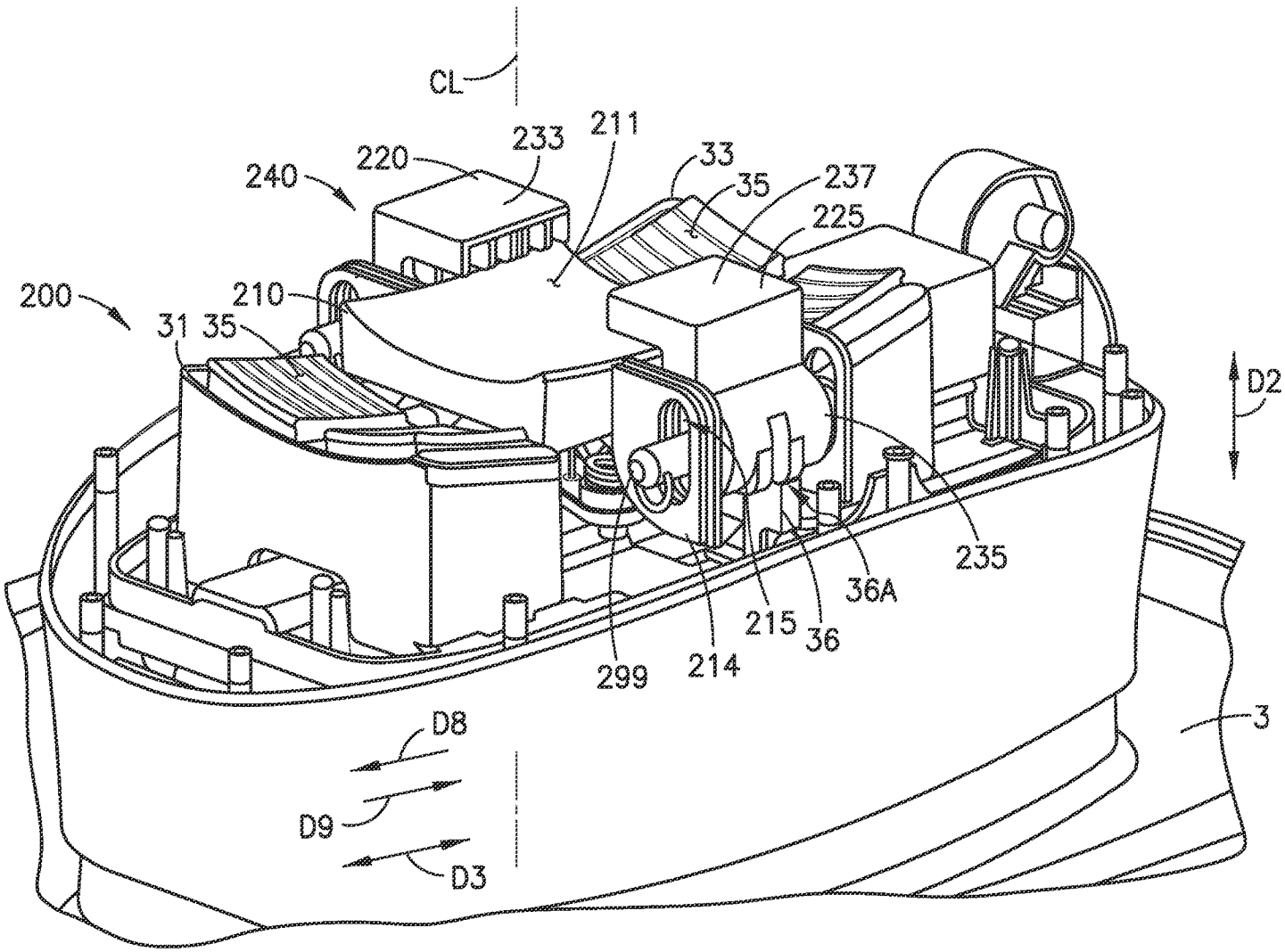
FIG. 3 is a perspective view of a portion of the infant care apparatus of FIG. 1 and/or FIG. 1 in accordance with aspects of the disclosed embodiment.
Figure 4:
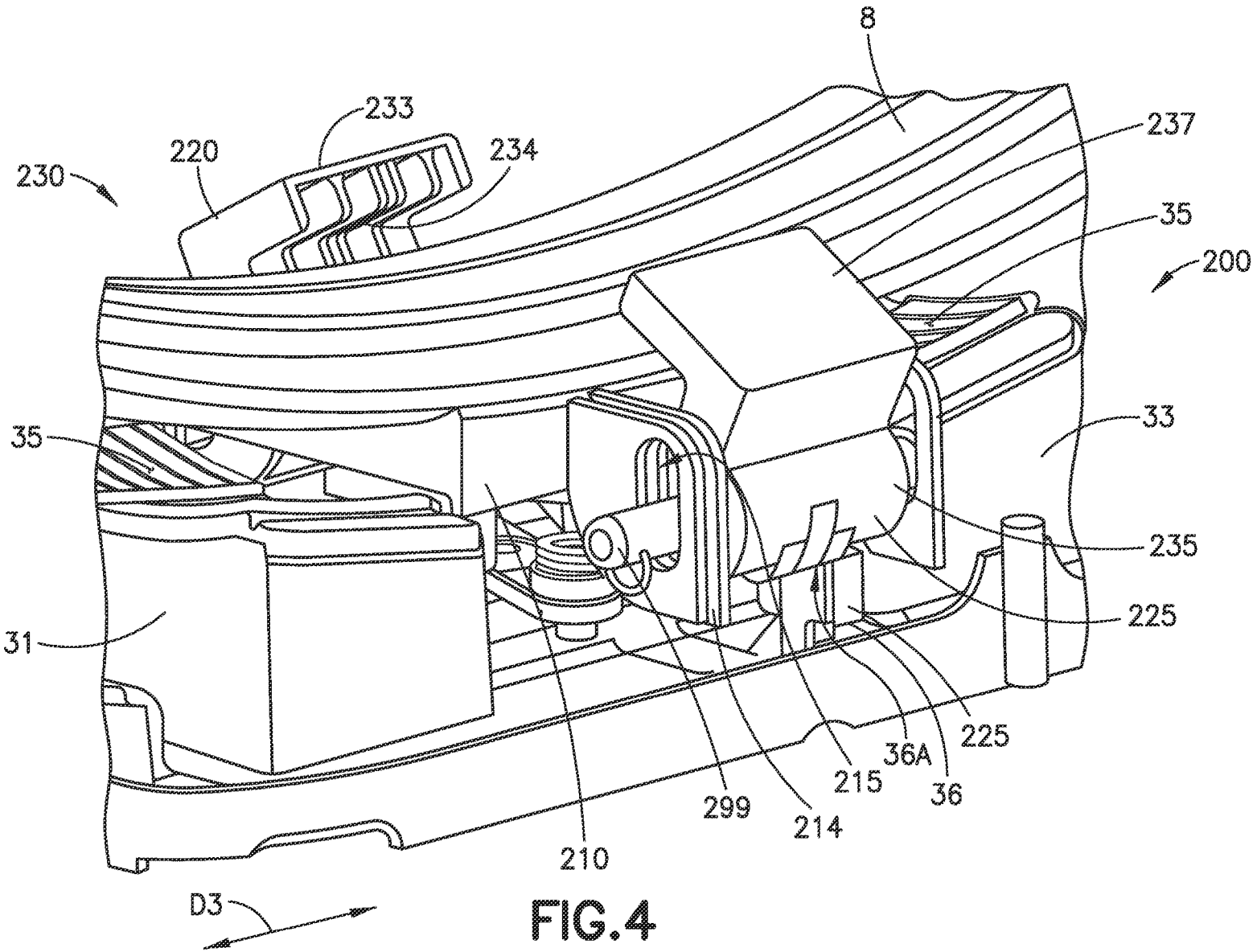
FIG. 4 is a perspective view of a portion of the infant care apparatus of FIG. 1 and/or FIG. 1 in accordance with aspects of the disclosed embodiment.
Figure 5A:
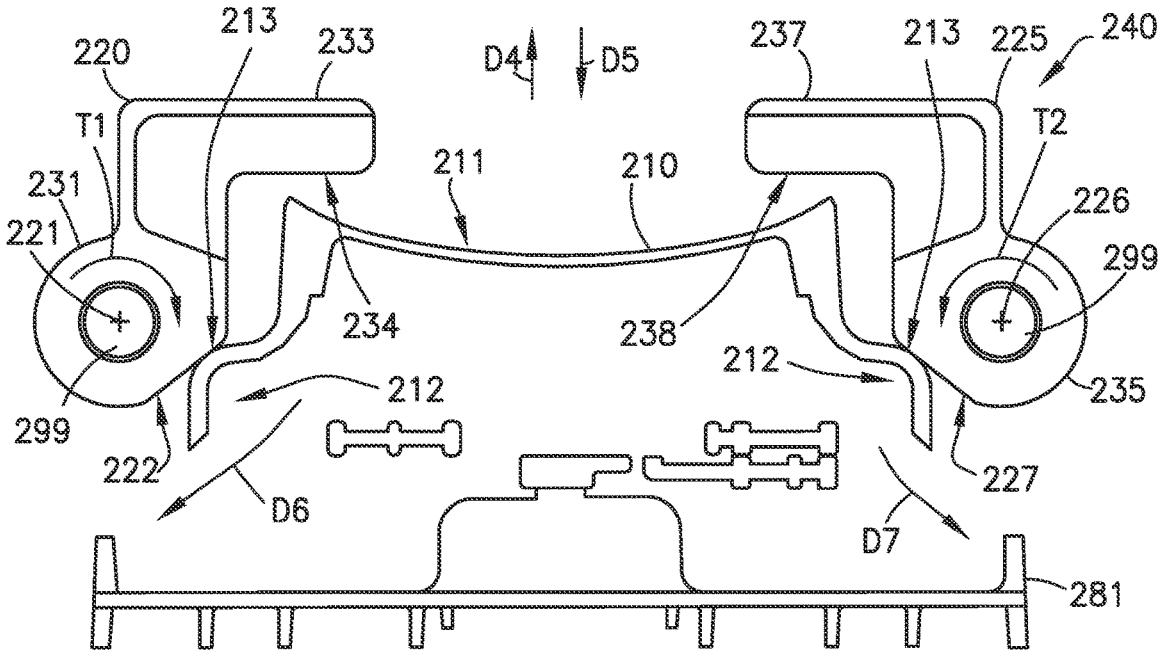
FIGS. 5A-5F are cross-sectional views of a portion of the infant care apparatus of FIG. 1 and/or FIG. 1 in accordance with aspects of the disclosed embodiment.
Figure 5B:
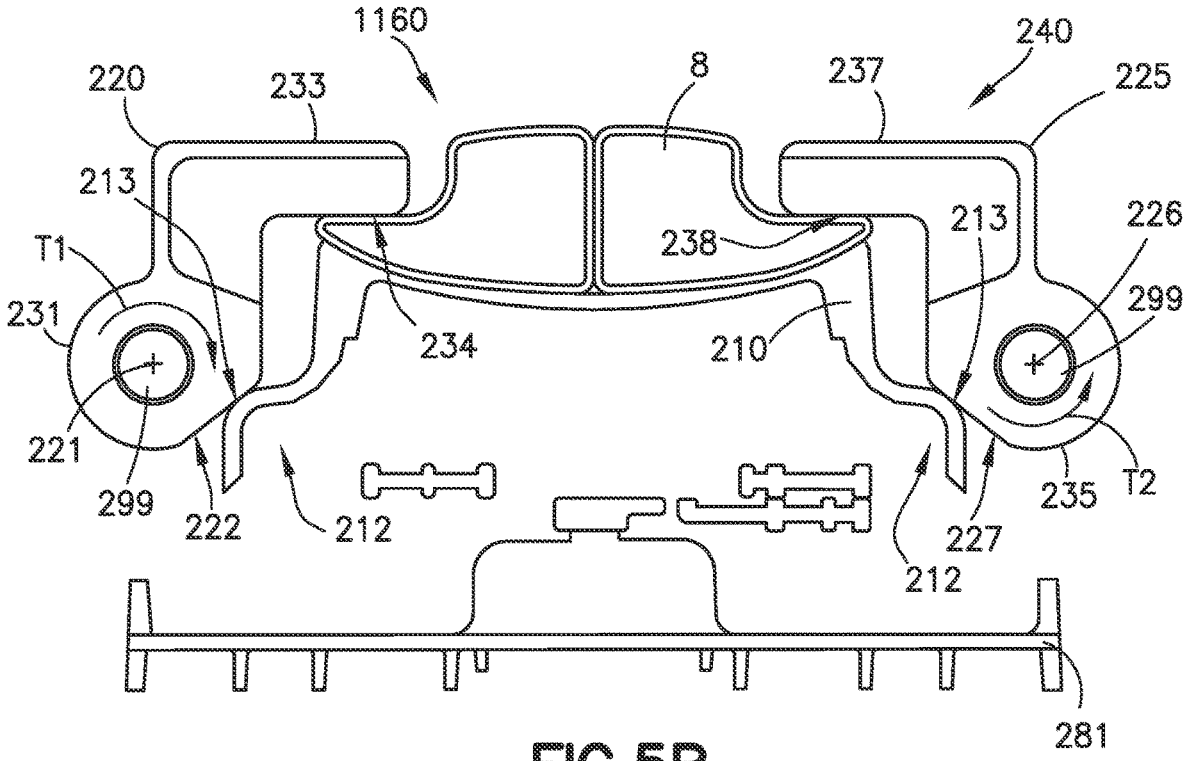
Figure 5C:
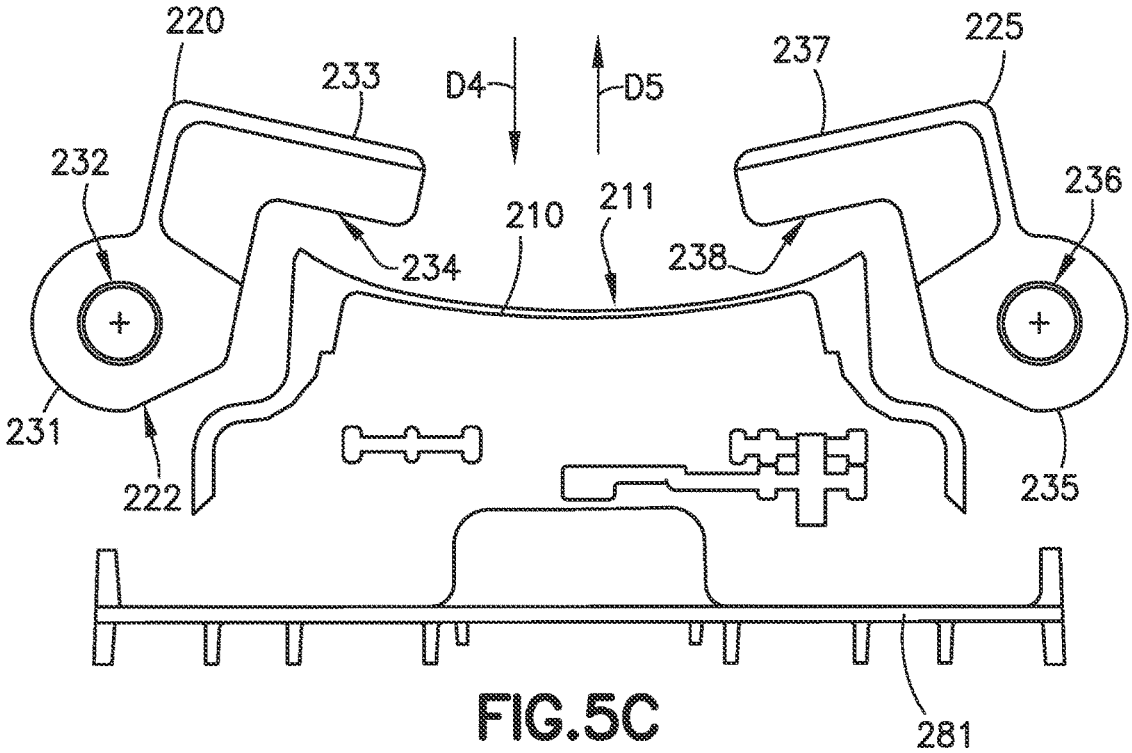
Figure 5D:
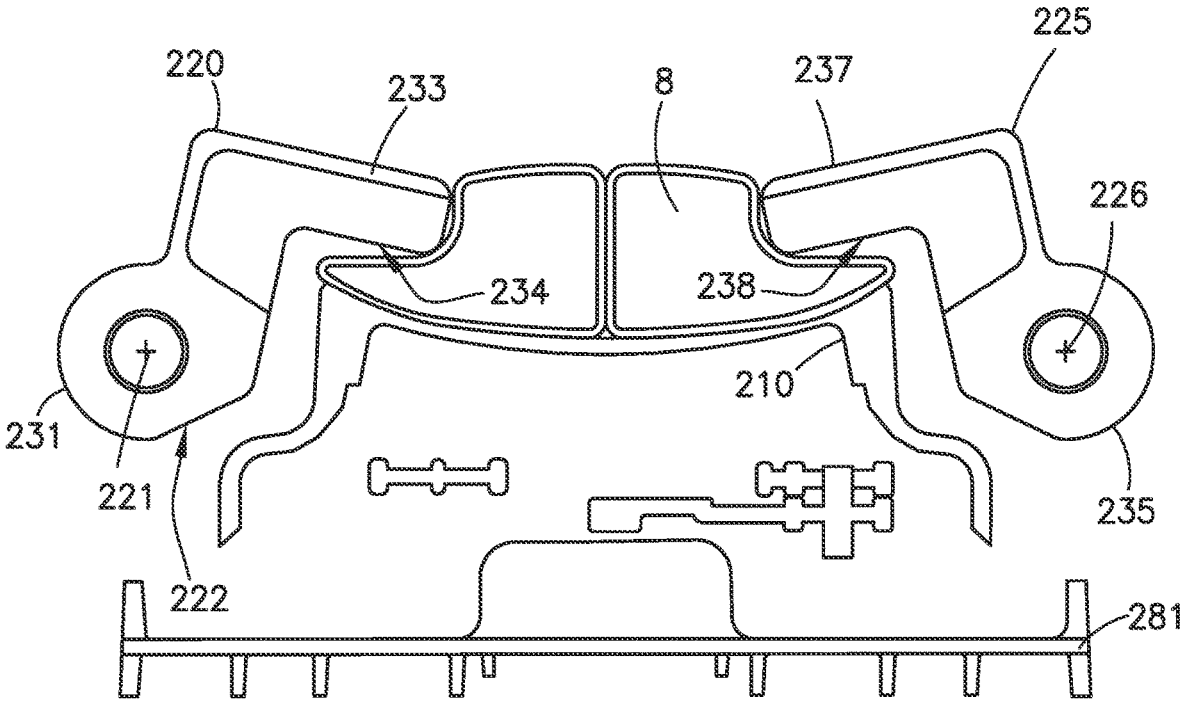
Figure 5E:
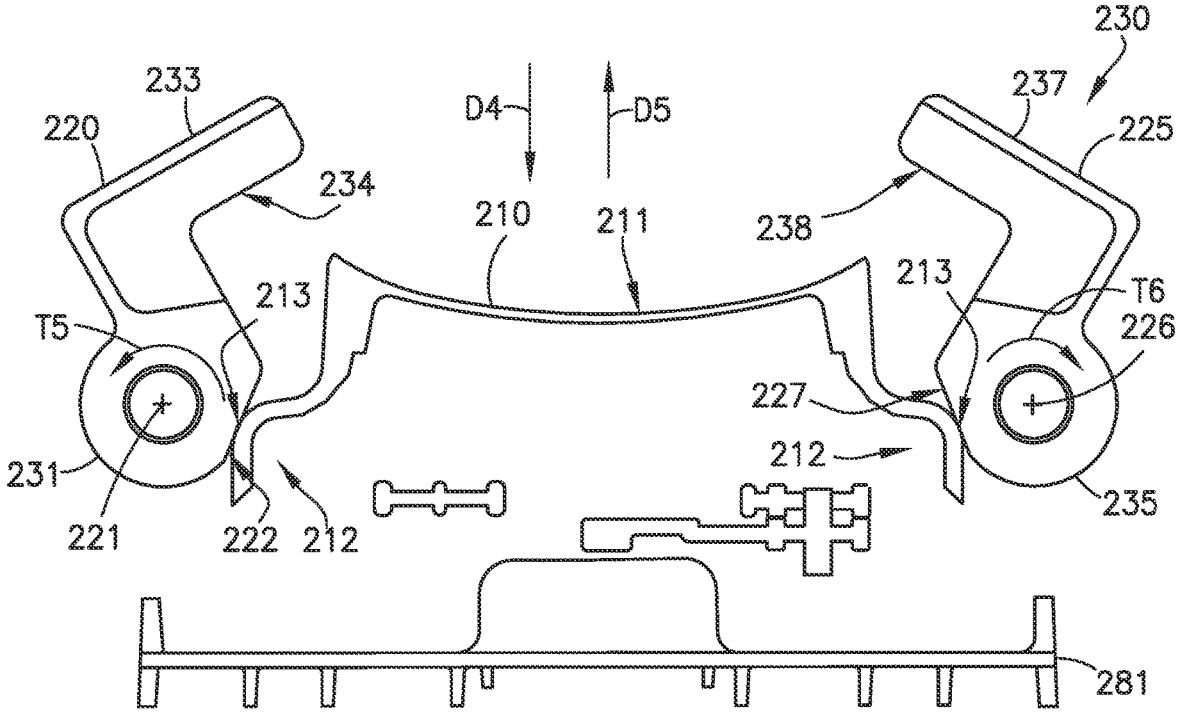
Figure 5F:
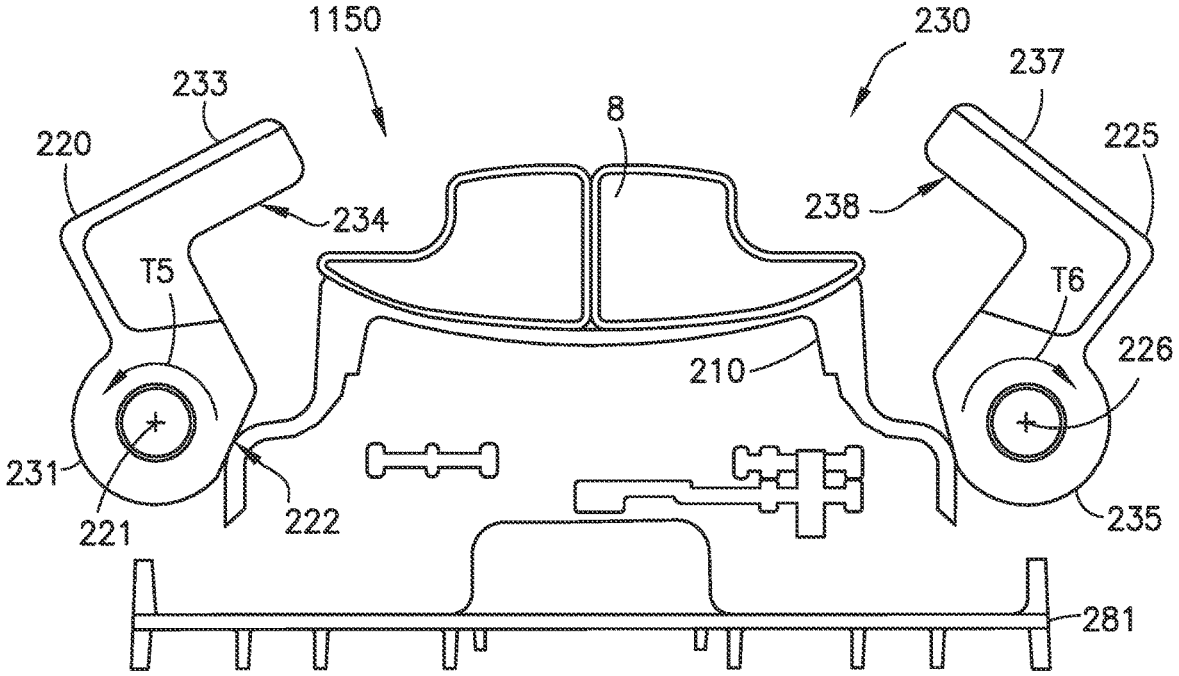
Figure 6:
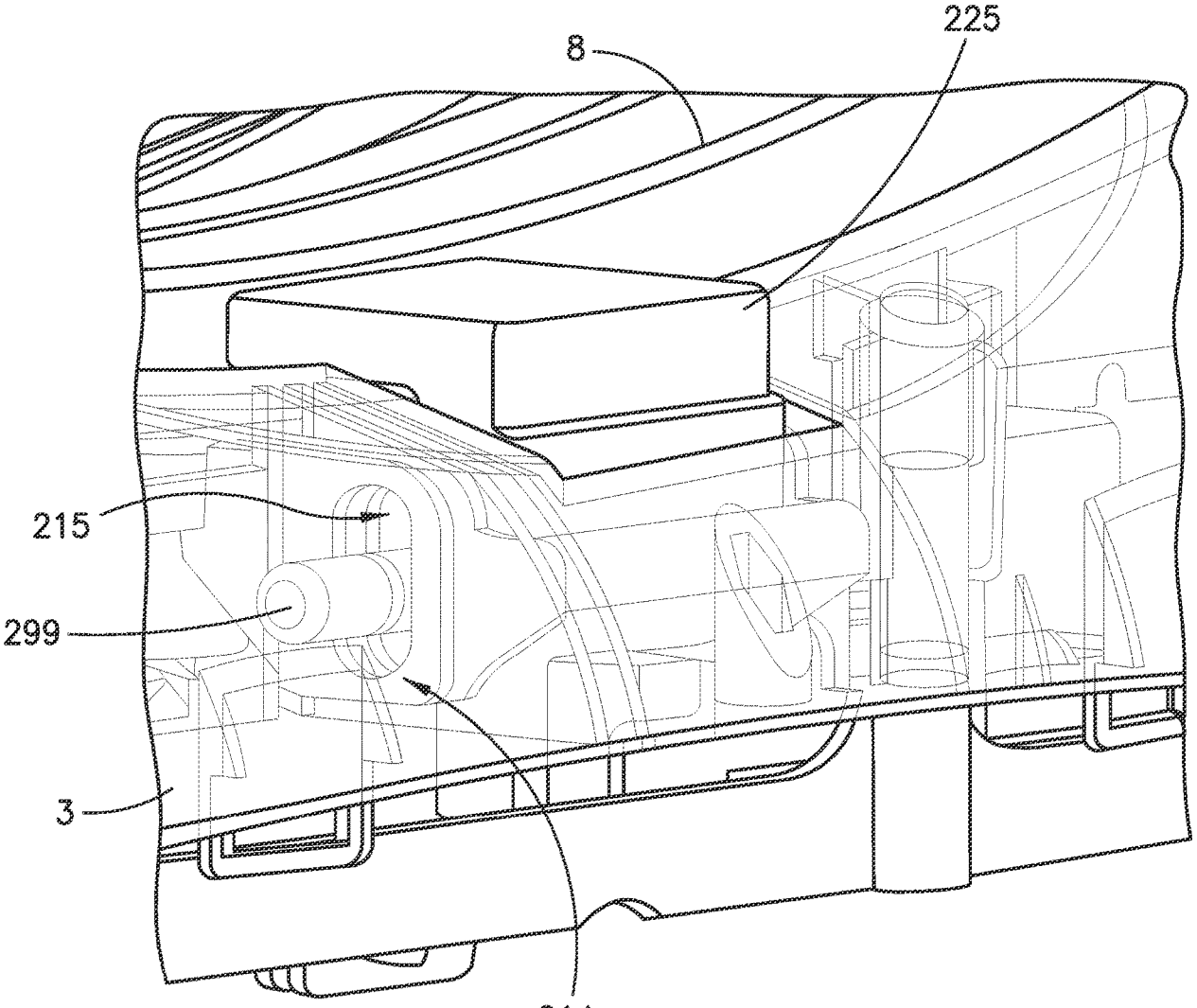
FIG. 6 is a perspective view of a portion of the infant care apparatus of FIG. 1 and/or FIG. 1 in accordance with aspects of the disclosed embodiment.
Figure 7B:
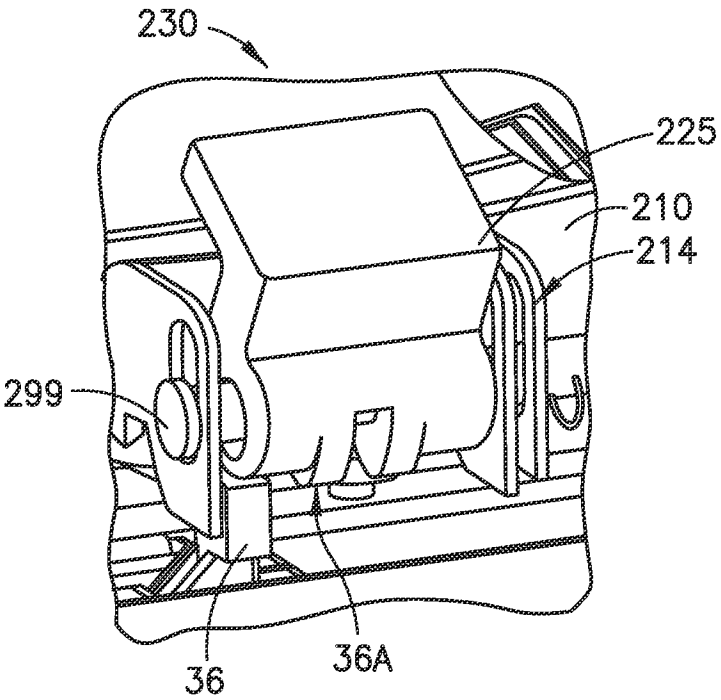
FIGS. 7A and 7B are perspective views of a portion of the infant care apparatus of FIG. 1 and/or FIG. 1 in accordance with aspects of the disclosed embodiment.
Figure 7A:
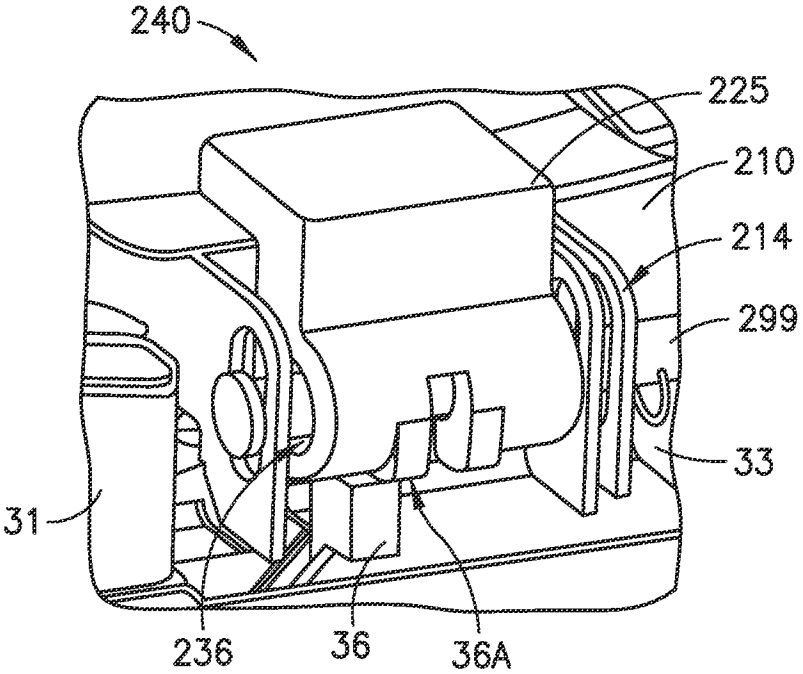

With particular reference to FIGS. 3 and 4, the movable support 210 is movably connected to the base 3 in any suitable manner so as to move in direction D2. The movable support 210 is disposed so as to form a support seat 211 that engages and supports the mating support member 8 of the infant support 2. The movable support 210 includes ribs 214 which couple to the base 3. The ribs 214 include a slotted hole 215 through which a pin 299 is inserted to constrain motion of the movable support 210 in direction D2. The slotted hole 215 has an elongated shape so that the movable support 210 may move between a first raised position 1150 (FIG. 5F) and a second lowered position 1160 (FIG. 5B) in direction D2 as will be described in greater detail below. The movable support 210 further includes a camming mechanism 212 (see, at least FIG. 5A) having camming surfaces 213 which are configured to interface with the automatically actuable grip members 220, 225 so as to automatically actuate the automatically actuable grip members 220, 225 between a clamped or closed position 240 (FIG. 5A) and an unclamped or open position 230 (FIG. 5F).

Figure 8B:
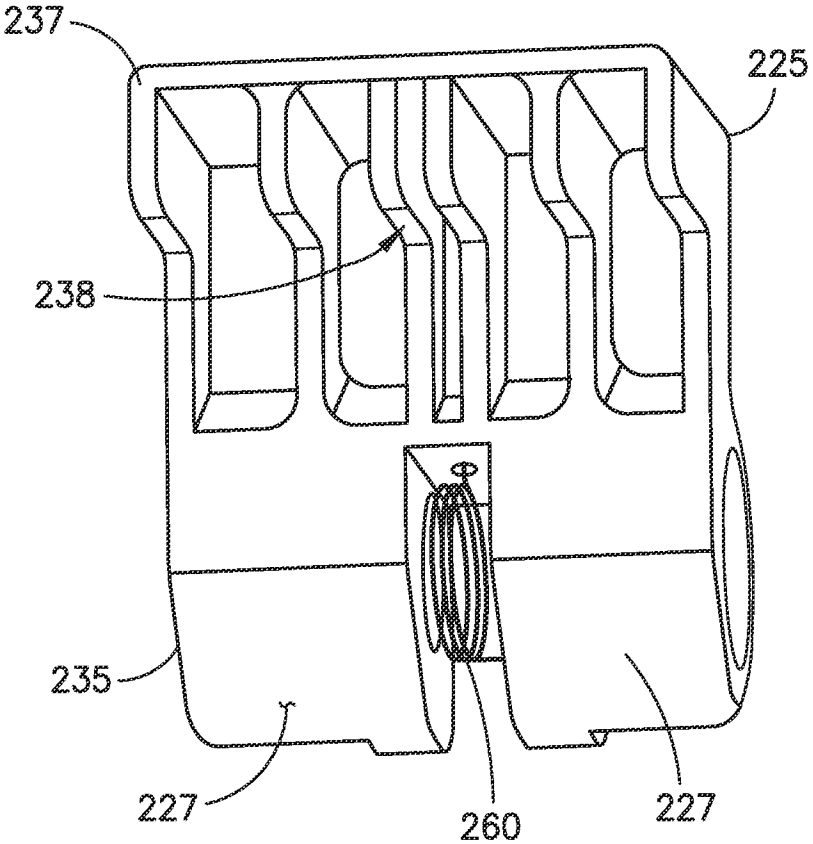
FIG. 8B is a front perspective view of a portion of the infant care apparatus of FIG. 1 and/or FIG. 1 in accordance with aspects of the disclosed embodiment.
Figure 8A:
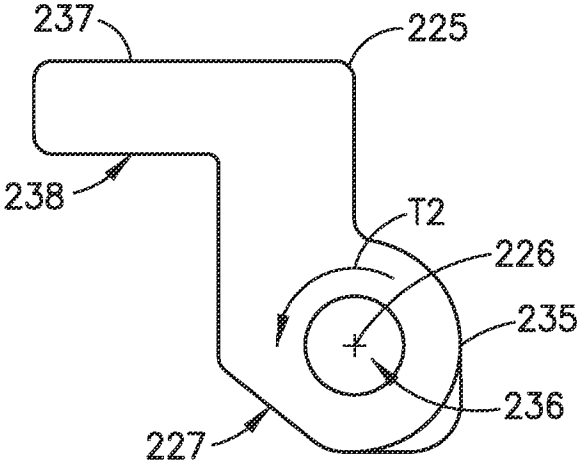
FIG. 8A is a side view of a portion of the infant care apparatus of FIG. 1 and/or FIG. 1 in accordance with aspects of the disclosed embodiment.
Figure 8C:
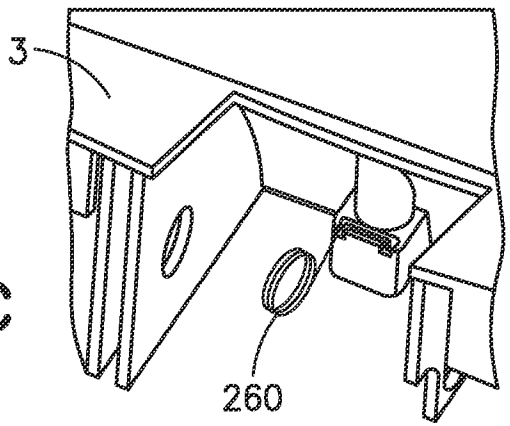
FIG. 8C is a perspective view of a portion of the infant care apparatus of FIG. 1 and/or FIG. 1 in accordance with aspects of the disclosed embodiment.

Referring to FIGS. 1, 3, 4, 5A-5F, 6, 7A-7B, and 8A-8C, the automatically actuable grip members 220, 225 each include a base 231, 235 with an aperture 232, 236, through which a respective pin 299 extends, and cam follow surfaces 222, 227. Clamp arms 233, 237 extend from the base 231, 235 and include gripping surfaces 234, 238. The automatically actuable grip members 220, 225 are coupled to a respective pin 299 so as to rotate relative to both the movable support 210, and the base 3 between the open position 230 and the closed position 240 (as seen best in FIGS. 5A-5F). In one aspect, the automatically actuable grip members 220, 225 are coupled to their respective pin 299 so as to freely rotate relative to the pin 299; while in other aspects, the automatically actuable grip members 220, 225 and the respective pin 299 may rotate as a unit relative to the slotted hole 215 and the movable support 210. The automatically actuable grip members 220, 225 are disposed with respect to the infant support 2 to effect gripping of the infant support 2 with gripping surfaces 234, 238 (FIG. 8B) when the infant support 2 is positioned on the support seat 211. The automatically actuable grip members 220, 225 actuating between the open position 230 and the closed position 240 captures and releases the mating support member 8 of the infant support 2. The automatically actuable grip members 220, 225 are automatically actuable between the open and closed positions 230, 240, by action of the movable support 210.

Figure 9B:
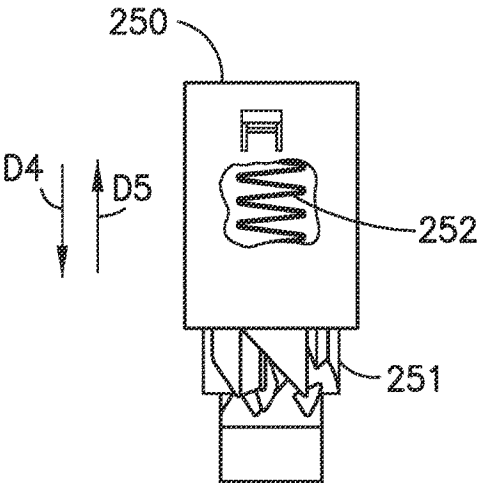
FIG. 9B is a side view of a portion of the infant care apparatus of FIG. 1 and/or FIG. 1 in accordance with aspects of the disclosed embodiment.
Figure 9C:
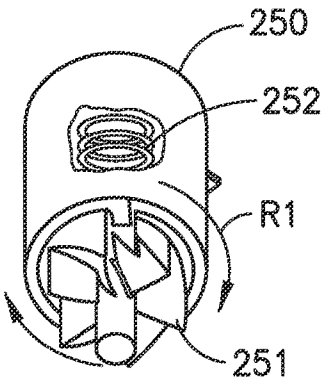
FIG. 9C is a bottom perspective view of a portion of the infant care apparatus of FIG. 1 and/or FIG. 1 in accordance with aspects of the disclosed embodiment.
Figure 9A:
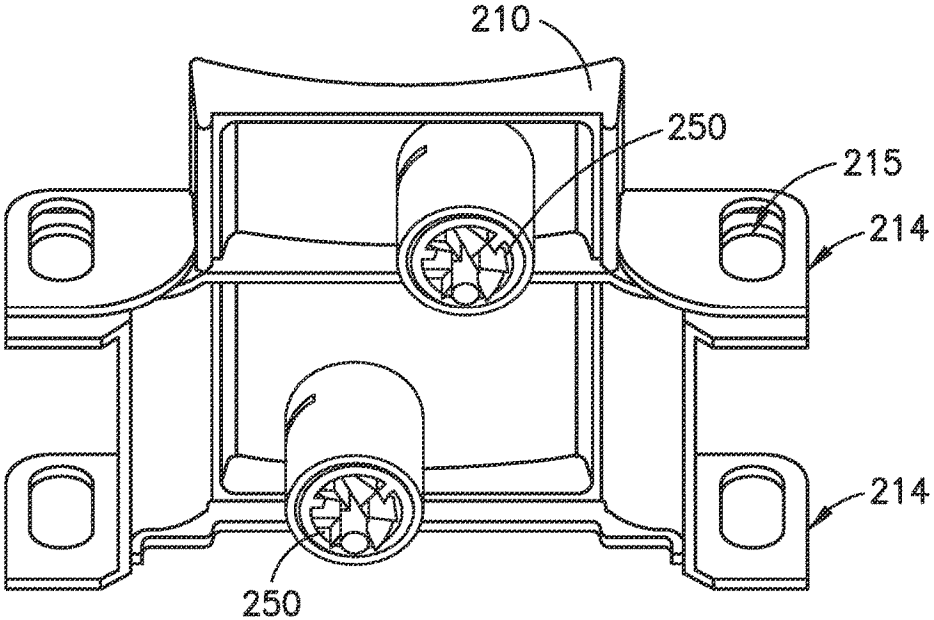
FIG. 9A is a bottom perspective view of a portion of the infant care apparatus of FIG. 1 and/or FIG. 1 in accordance with aspects of the disclosed embodiment.

For example, referring also to FIGS. 9A-9C, the infant care apparatus 1 may further include at least one toggle mechanism 250. In one aspect, the at least one toggle mechanism 250 may form an indicator to indicate the position of the movable support 210. For example, the at least one toggle mechanism 250 may emit an aural or tactile signal to indicate the position. In one aspect, the movable support 210 may be supported on at least one toggle mechanism 250 which is configured to toggle the movable support 210 between the first raised position 1150 and the second lowered position 1160. The at least one toggle mechanism 250 utilizes an angled tooth cam 251 and a spring 252 to toggle between first raised position 1150 and the second lowered position 1160. For example, when the movable support 210 is lowered in direction D4 (FIGS. 5A-5F and 9B) (such as when the infant support 2 is being coupled to the base 3), the at least one toggle mechanism 250 is compressed and the angled tooth cam 251 rotated in direction R1. In this position, the spring 252 within the at least one toggle mechanism 250 is loaded with the angled tooth cam 251 in a compressed and locked position. In this position both the at least one toggle mechanism 250 and the movable support 210 supported thereon are in the lowered state. When the movable support 210 is moved in direction D5 (FIGS. 5A-5F and 9B) again (such as when removing the infant support 2), the at least one toggle mechanism 250 is compressed which rotates the angled tooth cam 251 in direction R1 unlocking the at least one toggle mechanism 250 and allowing the spring 252 of the at least one toggle mechanism 250 to move the movable support 210 in direction D5 (FIGS. 5A-5F and 9B).

With the at least one toggle mechanism 250 (and thus the movable support 210) in the raised position 1150, the automatically actuable grip members 220, 225 are in and remain in the open position 230 through interaction between the camming mechanism 212 and the cam follower surfaces 222, 227 of the automatically actuable grip members 220, 225. With the automatically actuable grip members 220, 225 in the open position 230, the mating support member 8 of the infant support 2 is free to be removed or placed within the support seat 211 of the movable support 210 so as to mount the infant support 2 to the base 3. In order to bias the automatically actuable grip members 220, 225 in the open position 230, the cam follow surfaces 222, 227 of the automatically actuable grip members 220, 225 are configured to interface with the camming surfaces 213 of the camming mechanism 212. For example, without the infant support 2 present on the support seat 211, the movable support 210 is in the first raised position 1150 such that the camming surfaces 213 of the camming mechanism 212 are engaged with and biasing the cam follower surfaces 222, 227 of the automatically actuable grip members 220, 225 in direction T5 and direction T6, respectively, to the open position 230 against the biasing force of torsion springs 260. As the mating support member 8 of the infant support 2 is placed on the movable support 210 by a user and the movable support 210 is moved in direction D4 into the second lowered position 1160, the camming surfaces 213 of the camming mechanism 212 are disengaged from the cam follow surfaces 222, 227 (i.e., lowered such that the cam follow surfaces 222, 227 of the automatically actuable grip members 220, 225 follow or slide along the camming surfaces 213 of the camming mechanism 212 in respective direction D6 and direction D7). The torsion springs 260 of the respective automatically actuable grip members 220, 225 effects rotation of the respective automatically actuable grip members 220, 225 in respective direction T1 and direction T2. The respective torsion springs 260 biases the automatically actuable grip member 220 in direction T1 and the automatically actuable grip member 225 in direction T2 about respective pivot axes 221, 226 to place the automatically actuable grip members 220, 225 in the closed position 240.

Referring to FIGS. 3, 4, and 7A-7B in one aspect, the infant support coupling 200 includes a first recline locker 31 and a second recline locker 33 each including locking pads 35 which are configured to engage the mating support member 8 so as to lock a position of the mating support member 8 relative to the base 3 and setting the angle θ (FIG. 1). The first recline locker 31 and second recline locker 33 are substantially similar to the locking mechanism described in U.S. Pat. No. 10,231,555 previously incorporated herein by reference. The locking pads 35 may be manufactured from rubber or any other suitable material. The first recline locker 31 and the second recline locker 33 are configured to removably engage the locking pads 35 with the mating support member 8 positioned within the support seat 211 by movement of a Z-linkage (not shown). Movement of the Z-linkage causes movement of both the first recline locker 31 and the second recline locker 33 in direction D12 to lock and release the mating support member 8 relative to the base 3. For example, to lock the mating support member 8 relative to the base 3, the Z-linkage drives the first recline locker 31 in direction D9 and the second recline locker 33 in direction D8 such that the first recline locker 31 and the second recline locker 33 move toward a centerline CL of the infant support coupling 200. The mating support member 8 is released when the Z-linkage is actuated to drive the first recline locker 31 in direction D8 and the second recline locker 33 in direction D9 away from the centerline CL of the infant support coupling 200. The first recline locker 31 and the second recline locker 33 may include lock members 36 to lock the automatically actuable grip members 220, 225 in place. The lock members 36 are configured to move with the first recline locker 31 and the second recline locker 33 in direction D3. For example, when the second recline locker 33 is moved in direction D8 to lock the mating support member 8 relative to the base 3, the lock member 36 is also moved in direction D8 and positioned under the automatically actuable grip member 225. The automatically actuable grip member 225 includes a lock surface 36A (FIG. 7B) that interfaces with the lock member 36 and "locks" the automatically actuable grip member 225 (i.e., prevents rotation of the automatically actuable grip member 225). The lock members 36 are coupled to the movement linkage of the recline lockers 31, 33 so as to move between locked and unlocked positions coincident with the recline lockers 31, 33 being engaged and disengaged.

Figure 10:
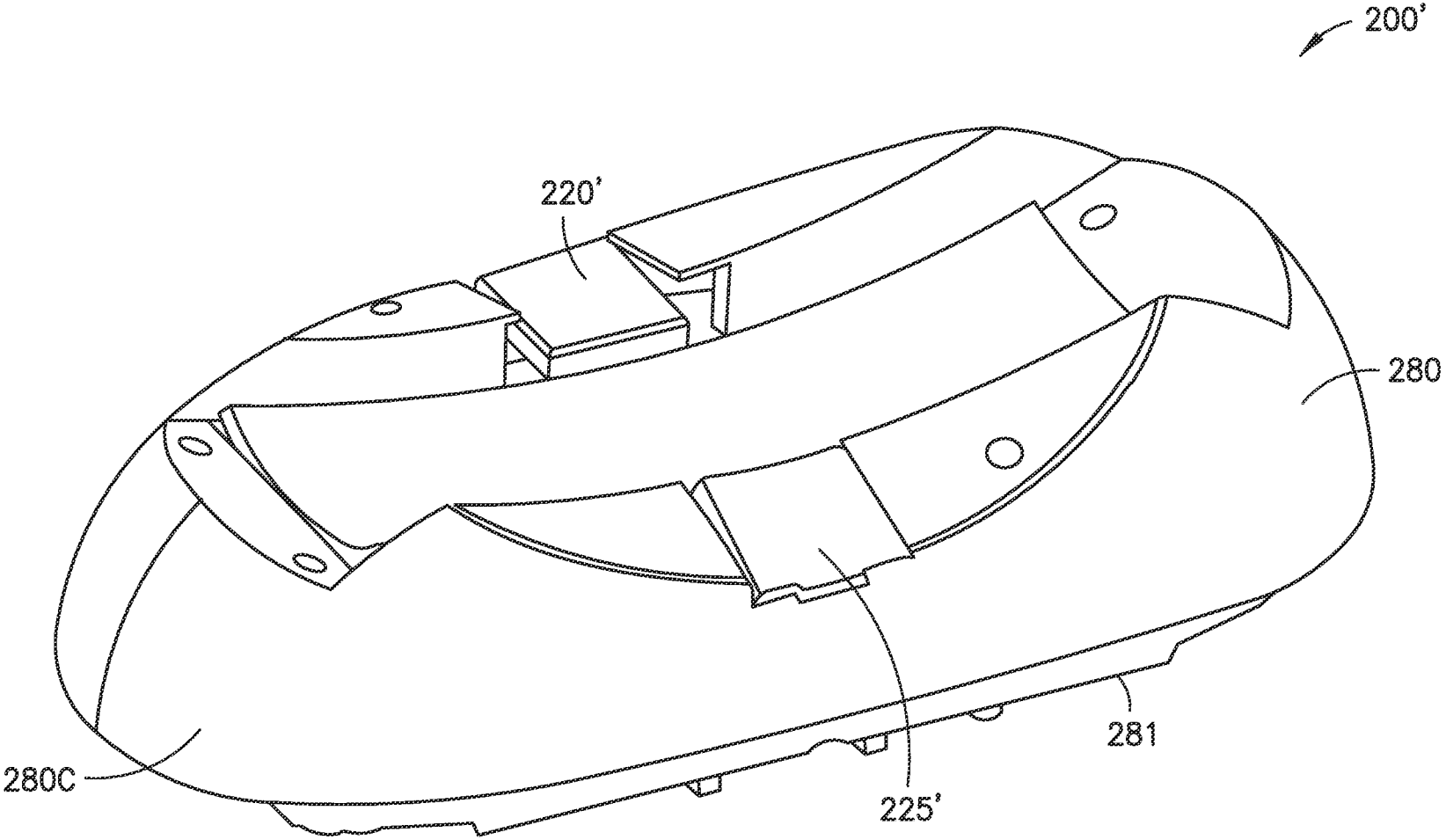
FIG. 10 is a perspective view of a portion of the infant care apparatus of FIG. 1 and/or FIG. 1 in accordance with aspects of the disclosed embodiment.
Figure 11:
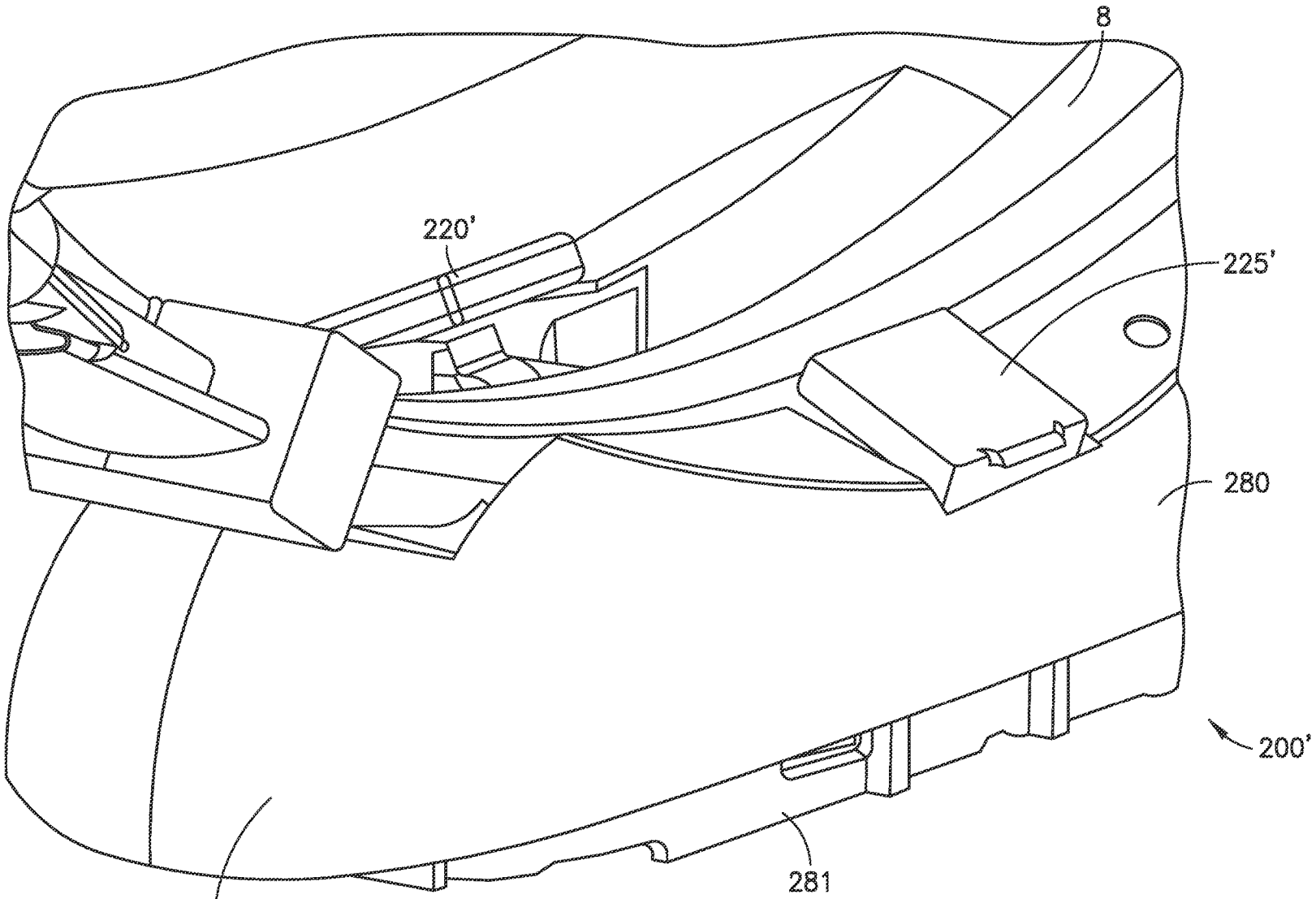
FIG. 11 is a perspective view of the portion of the infant care apparatus of FIG. 2 in accordance with aspects of the disclosed embodiment.
Figure 12:
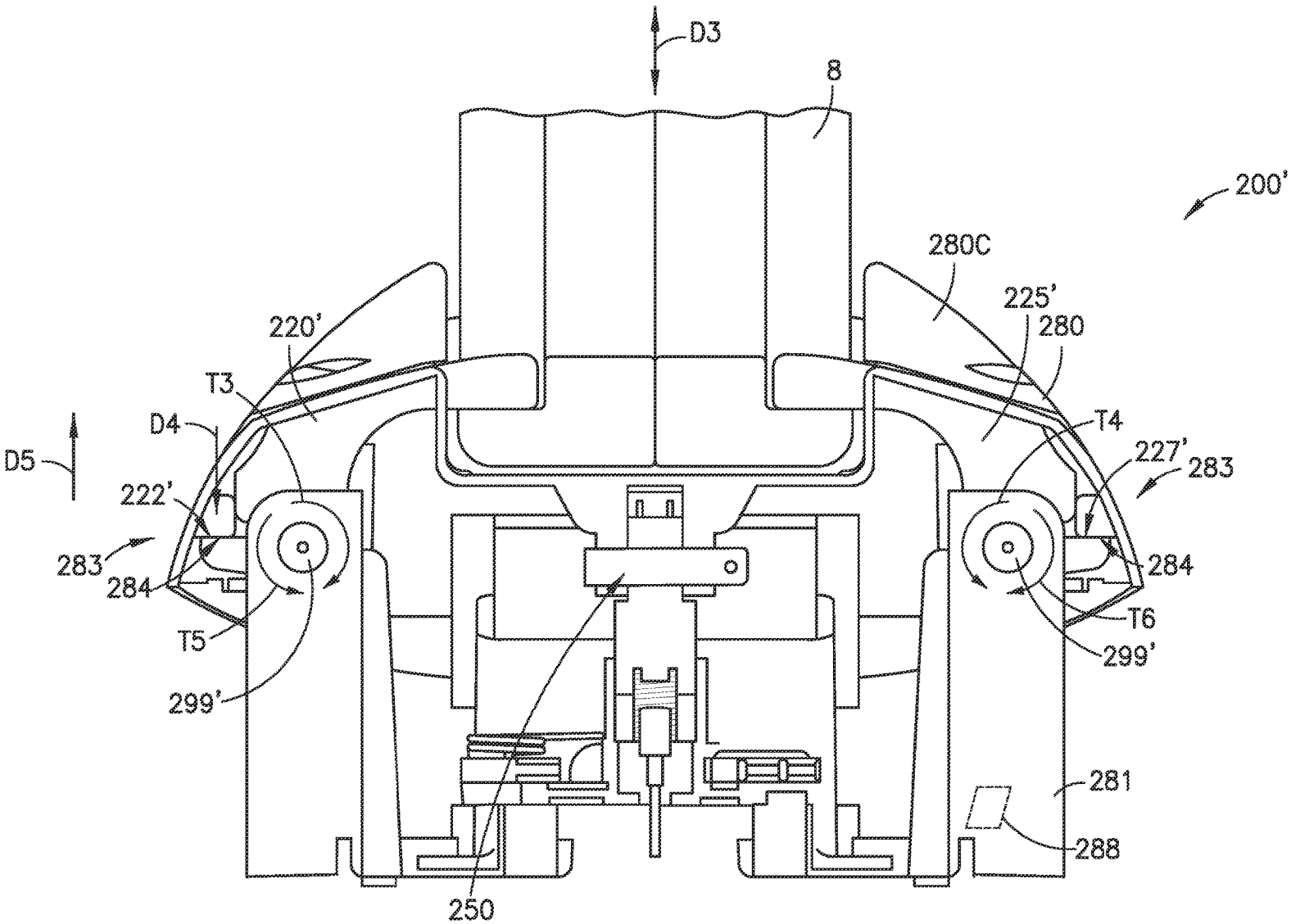
FIG. 12 is a cross-sectional view of the portion of the infant care apparatus of FIG. 2 in accordance with aspects of the disclosed embodiment.
Figure 12A:
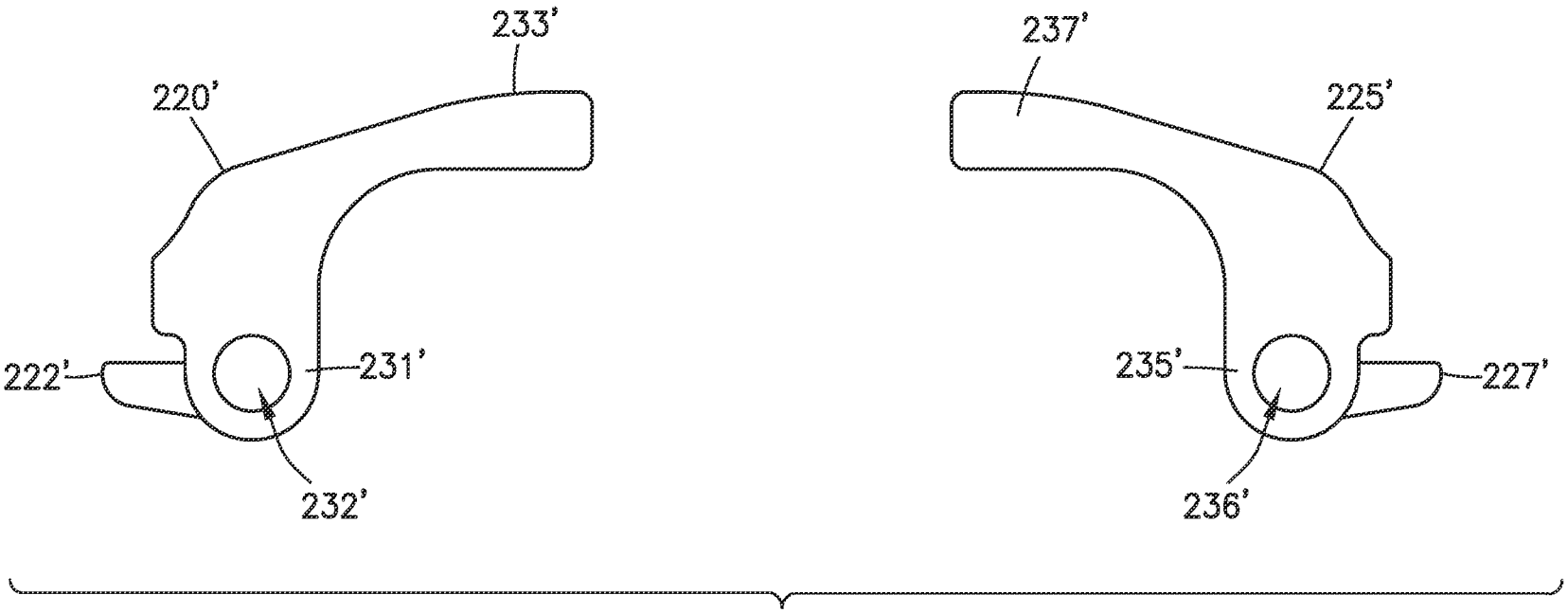
FIG. 12A is a front view of a portion of the portion of the infant care apparatus of FIG. 2 in accordance with aspects of the disclosed embodiment.

Referring now to FIGS. 10-12, infant support coupling 200' is illustrated in accordance with another aspect of the disclosed embodiment. The infant support coupling 200' is substantially similar to infant support coupling 200 unless where noted below. In this aspect, the infant support coupling 200' includes automatically actuable grip members 220', 225', and the housing cover 280C of the housing 280 acts as the movable support 210 described above. Here, the housing cover 280C is movably coupled to the base 3 in any suitable manner, such as, by the housing base 281 such that the housing cover 280C moves in direction D2 relative to the housing base 281 fixedly mounted to the base 3. It is noted that the skirt 280S is coupled to the housing base 281 independent of the housing cover 280C so that the housing cover 280C moves in direction D2 relative to the skirt 280S. The skirt 280S extends from the housing base 281 (or with respect to the infant support coupling 200') so as to circumscribe or surround at least a portion of the drive mechanism 10 that extends through the surface 5A. The housing cover 280C includes camming mechanism 283 with camming surfaces 284 to effect automatic actuation of the automatically actuable grip members 220', 225' as will be described below.

The automatically actuable grip members 220', 225' each include a base 231', 235' with an aperture 232', 236', through which a respective pin 299' extends, and cam followers 222', 227' extending from the base 231', 235'. Clamp arms 233', 237' extend from the base 231', 235' and include gripping surfaces 234', 238'. The automatically actuable grip members 220', 225' are coupled to the respective pins 299' so as to rotate relative to the housing cover 280C (and the base 3) between the open position 230 and the closed position 240. Here, the camming surfaces 284 of the camming mechanism 283 are engaged with and biasing the cam followers 222', 227' of the automatically actuable grip members 220', 225' in the open position 230 when the housing cover 280C is lowered in direction D4. As the mating support member 8 of the infant support 2 is placed on the movable support 210 by a user and the movable support 210 is lowered in direction D4 into the second position, the camming surfaces 284 of the camming mechanism 283 are lowered in direction D4 such that the cam followers 222', 227' of the automatically actuable grip members 220', 225' are rotated in respective directions T5 and direction T6 which forces the automatically actuable grip members 220', 225' into the open position 230. A torsion spring integrated into the automatically actuable grip members 220', 225' effects rotation of the automatically actuable grip members 220', 225' in respective direction T3 and direction T4 on the automatically actuable grip members 220', 225' to force them into the closed position 240 when the camming mechanism 283 is disengaged (i.e., the housing cover 280C is toggled into the raised position). The infant support coupling 200' may further include shock towers 288 to absorb any impacts and retain stability of the infant support coupling 200'.

Referring to FIGS. 1C, 1D, and 13A-15C, in one or more aspects as described herein, the infant seat 7 includes the articulated span member or infant support coupling 266 that is configured to couple with the infant support receiver coupling 200C. The infant support receiver coupling 200C is substantially similar to infant support coupling 200 unless noted otherwise and is configured to receive the infant support coupling 266 as described herein. Here, the infant support receiver coupling 200C includes a seating surface 2710 (FIG. 27) that is configured to receive the articulated span member 266. For example, as noted above, articulated span member 266 includes the base 2620 (which only a portion of which is illustrated in FIGS. 14A-14C) and articulating supports 2621, 2622 rotatably coupled to the base 2620. The base 2620 has a mating surface 2620B and the infant support receiver coupling 200C has a complimentary mating surface 200CS upon which the mating surface 2620B seats. Here, the complimentary mating surface 200CS is configured to locate the base 2620 in a predetermined location on the infant support receiver coupling 200C. For example, with specific reference to FIG. 15A, the complimentary mating surface 200CS includes a protrusion 2801 and the mating surface 2620B of the base 2620 includes a recess 2800, where the recess 2800 is placed over and mates with the protrusion 2801 to at least partially locate the base 2620 (and the infant seat 7) on the infant support receiver coupling 200C.

The base 2620 includes a locking post 2810 that extends from the mating surface 2620B. The complimentary mating surface 200CS of the infant support receiver coupling 200C includes an aperture 2820 that receives the locking post 2810 to at least partially locate the base 2620 (and the infant seat 7) on the infant support receiver coupling 200C. The locking post 2810 extends through the aperture 2820 to an interior of the infant support coupling where the locking post 2810 engages and disengages a movable locking arm 2830 of the infant support receiver coupling 200C. In one or more aspects, the locking post 2810 includes a groove 2840 and the locking arm 2830 includes a fork 2841 that extends into the groove 2840 when the locking arm is engaged with the locking post 2810. The fork 2841 within the groove 2840 substantially locks the base 2620 to the infant support receiver coupling 200C in the direction D28 while engagement of the locking post 2810 with the aperture 2820 substantially locks the base 2620 to the infant support receiver coupling 200C in the directions D26, D27 (see also FIG. 14C). In other aspects, the locking arm 2830, locking post 2810, and mating surfaces 2620B, 200CS may have any suitable configuration for locating and locking the base 2620 (and the infant seat 7) to the infant support receiver coupling 200C. The infant support receiver coupling 200C includes an anti-rotation surface 2710 (see FIGS. 14A-14C) that engages a side 2620A of the base 2620 so as to substantially prevent rotation of the base 2620 (and the infant seat 7) relative to the infant support receiver coupling 200C in direction D25; while in other aspects, the base 2620 and the infant support receiver coupling 200C include any suitable anti-rotation features (e.g., pins/recesses, mating grooves/protrusions, etc.) to substantially prevent rotation of the base 2620 (and the infant seat 7) relative to the infant support receiver coupling 200C in direction D25.

Figure 15A:
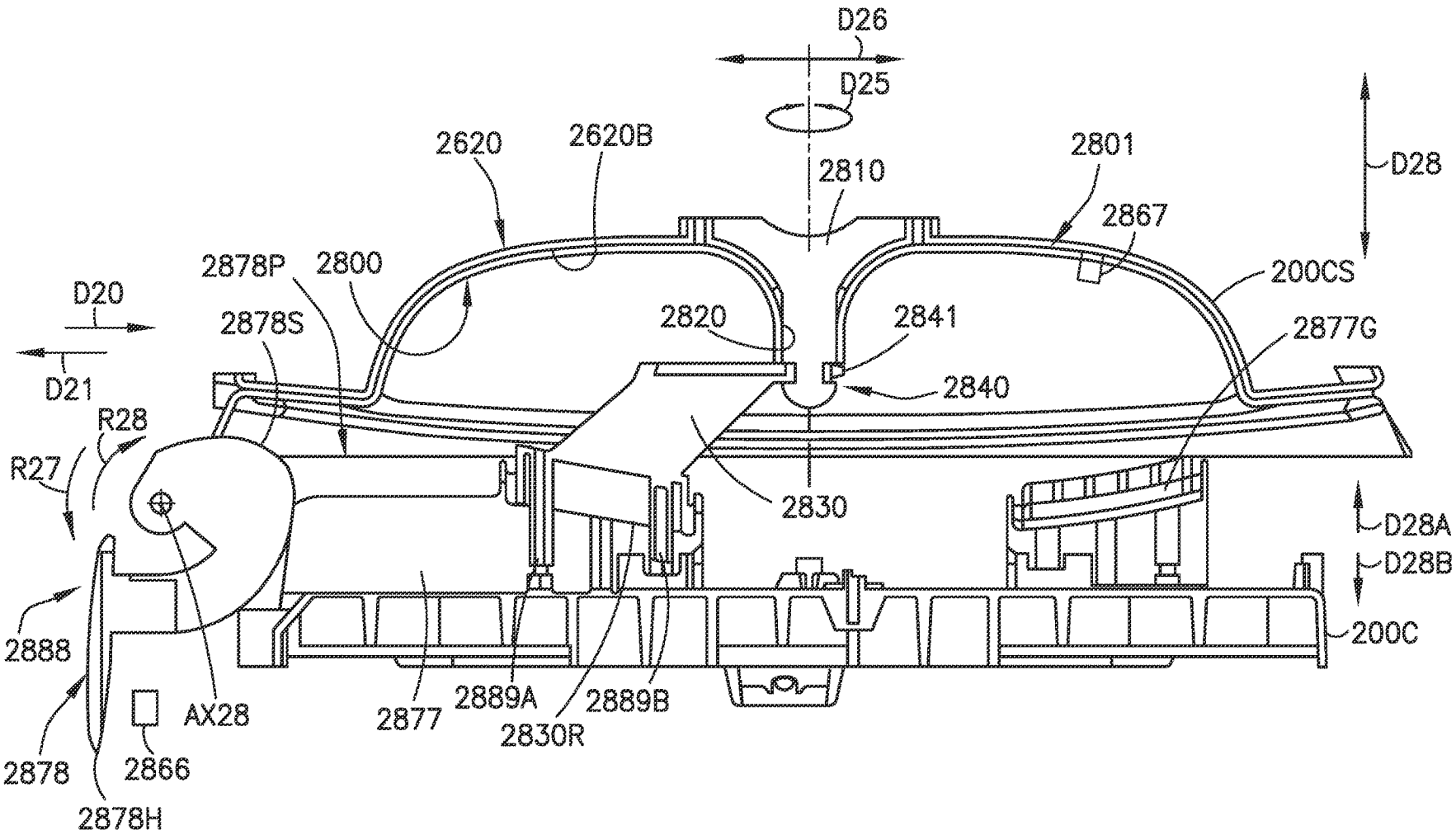
FIG. 15A is a schematic cross-sectional illustration of a portion of the infant care apparatus of FIG. 1C in accordance with aspects of the disclosed embodiment.
Figure 15B:
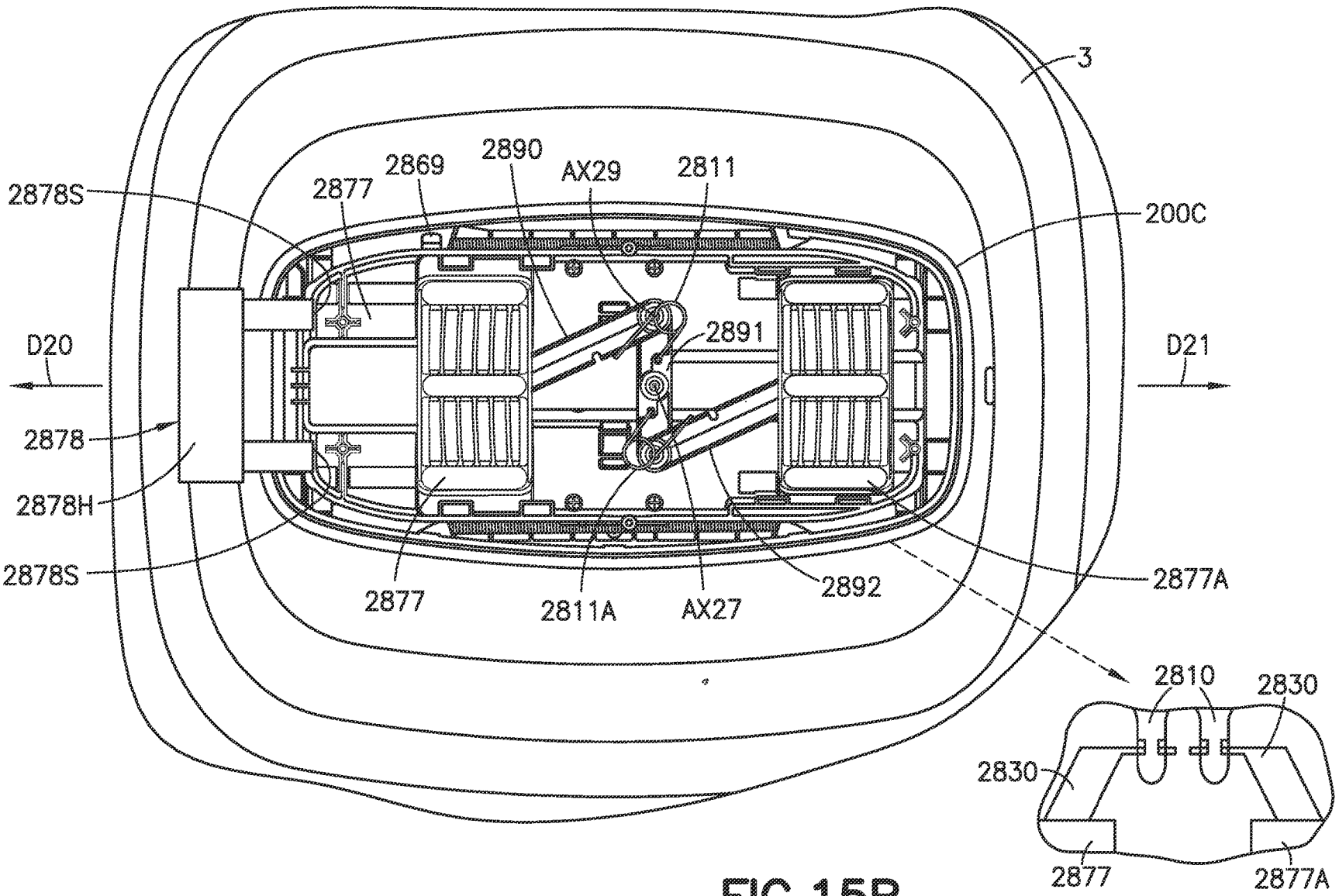
FIG. 15B is a schematic plan view of the portion of the infant care apparatus of FIG. 15A in a first orientation in accordance with aspects of the disclosed embodiment.
Figure 15C:
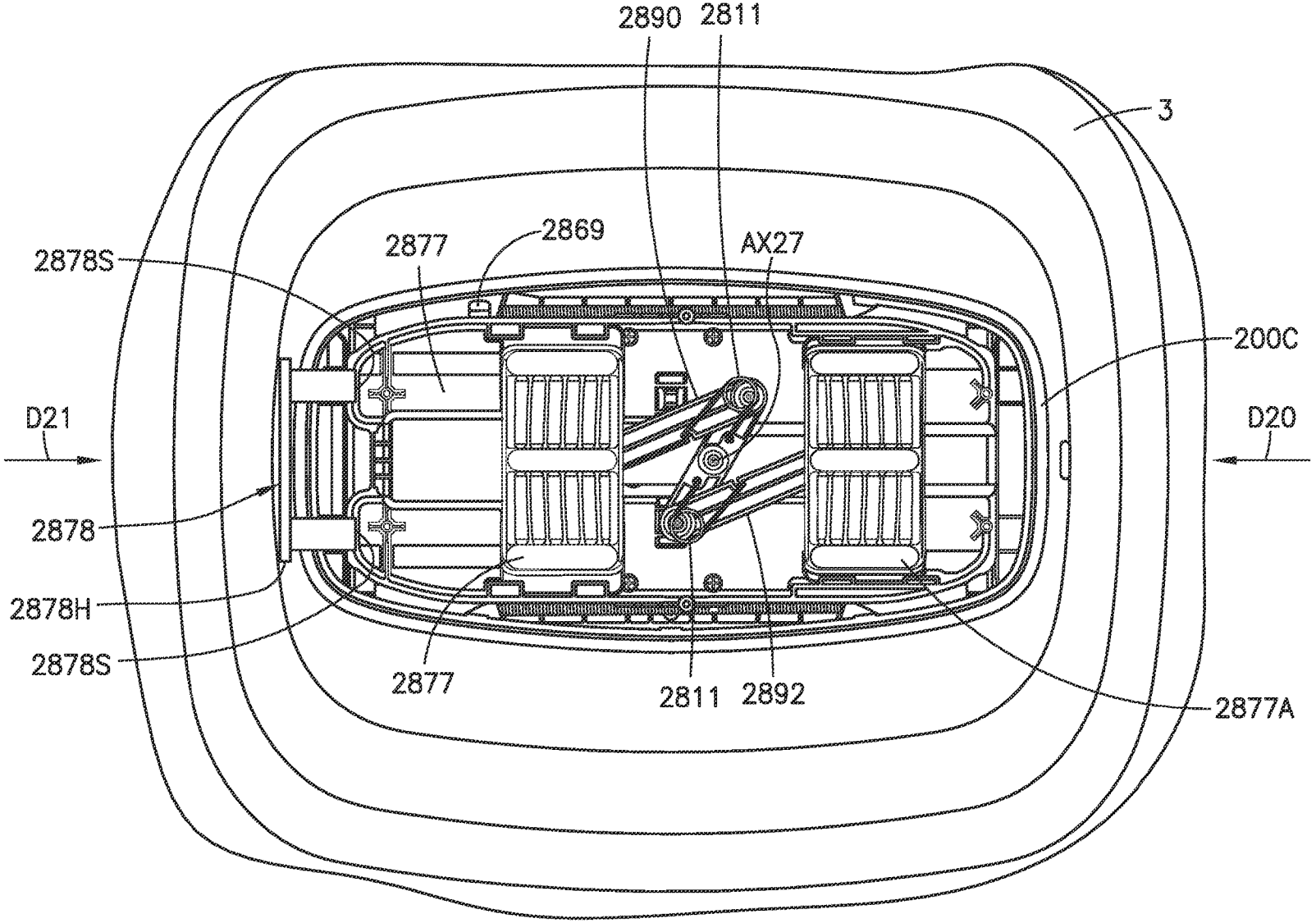
FIG. 15C is a schematic plan view of the portion of the infant care apparatus of FIG. 15A in a second orientation in accordance with aspects of the disclosed embodiment.

Still referring to FIGS. 15A-15C, as noted above the locking arm 2830 is movable so as to engage and disengage the locking post 2810. In one or more aspects the locking arm 2830 moves linearly in direction D20 to engage the locking post 2810 and linearly in direction D21 to disengage the locking post 2810; however, in other aspects the locking arm may be provided with a pivoting motion so that the fork 2841 travels along an arcuate path to engage and disengage the groove 2840 in the locking post 2810. In the example, shown in FIGS. 15A-15C, the locking arm 2830 forms part of a cam lock mechanism that includes cam lever 2878, locking arm 2830, and slide 2877. The locking arm 2830 is mounted to the slide 2877 in any suitable manner. For example, in one aspect, the locking arm 2830 is mounted to the slide 2877 so as to be slidable relative to the slide 2877.

Here the slide 2877 includes a ramp surface 2877R and the locking arm 2830 includes a mating ramp surface 2830R. The coupling between the slide 2877 and the locking arm 2830 is arranged so that the locking arm 2830 is able to move relative to the slide in directions D20, D21 where the engagement between the ramped surfaces 2877R, 2830R (as the locking arm 2830 is moved in directions D20, D21 relative to the slide 2877) causes the locking arm 2830 to move in direction D28. As an example, the slide includes a guide 2877G (e.g., a rail, protrusion, or any other suitable linear guide) to which the locking arm 2830 is coupled and slides along, e.g., slides in a plane defined by the engagement between the ramp surfaces 2877R, 2830R. Here the guide 2877G provides for movement of the locking arm 2830 in directions D20, D21 relative to the slide 2877 while maintaining coupling engagement between the locking arm 2830 and the slide 2877 (i.e., the movement of the locking arm 2830 in direction D28 is a result of the ramp surfaces 2877R, 2830R and not any lifting of the locking arm 2830 from the slide 2877). Any other suitable fasteners or guide pins 2889A, 2889B may be provided for guiding movement of the locking arm 2830 relative to the slider 2877 and/or for movably coupling the locking arm 2830 to the slider 2877.

The slide 2877 is biased (such as by any suitable resilient members 2811 such as springs) in direction D21. Movement of the slide 2877 (and the locking arm 2830) is controlled by the cam lever 2878 that is pivotally coupled, about pivot axis AX28, to one or more of the housing cover 280C, skirt 280S, or any other suitable frame member of the infant support receiver coupling 200C. The cam lever 2878 includes a cam surface 2878S that is configured, in combination with the bias exerted on the slide 2877, to effect movement of the slide 2877 (and the locking arm 2830) in directions D2, D21. For example, as the cam lever 2878 is rotated about pivot axis AX28 in direction R28 (e.g., a handle 2878H of the cam lever is moved away from the housing cover 280C and/or skirt 280S) the cam surface 2878S is a lobed surface having a lobe peak 2878P (i.e., the distance between the axis AX28 and the cam surface 2878S is greatest at the peak 2878P), where the cam surface 2878S is configured to effect movement of the slide 2877, in combination with the biasing of the slide 2877, in direction D21 so that the fork 2841 disengages the groove 2840 so as to release the infant seat 7 from the base 3. For example, as the cam lever 2878 is rotated in direction R28 the lobe peak 2878P causes an initial movement of the slider 2877 in direction D20, where when engagement between the cam surface 2878S and the slider 2877 is past the lobe peak 2878P, the cam surface 2878S causes a subsequent movement of the slider in direction D21 so that the fork 2841 disengages the groove 2840. The initial movement of the slider 2877 in direction D20 causes locking arm 2830 to ride up on the ramped surface 2877R which raises the locking arm 2830 in direction D28A to assist in the release of the seat 7 through vertical disengagement of mating surfaces of the fork 2841 and groove 2840. As the cam lever 2878 is rotated about pivot axis AX28 in direction R27 (e.g., the handle 2878H of the cam lever is moved towards the housing cover 280C and/or skirt 280S) the cam surface 2878S is configured to effect movement of the slide 2877, in combination with the biasing of the slide 2877, in direction D20 so that the fork 2841 engages the groove 2840 so as to lock the infant seat 7 to the base 3. Here, as the cam lever 2878 is rotated in direction R27 the initial movement of the slider 2877 is in direction D20, where when engagement between the cam surface 2878S and the slider 2877 is past the lobe peak 2878P, the cam surface 2878S causes a subsequent movement of the slider in direction D21 so that the fork 2841 engages the groove 2840. The subsequent movement of the slider 2877 in direction D21 causes locking arm 2830 to ride down on the ramped surface 2877R which lowers the locking arm 2830 in direction D28B to assist in the locking of the seat 7 through vertical engagement of mating surfaces of the fork 2841 and groove 2840. In other aspects, the locking arm 2830 may not move in the direction D28.

As described above, the bias on the slide 2878 is provided by resilient member 2811 illustrated in FIGS. 15B and 15C. In the example illustrated in FIGS. 15B and 15C the resilient member 2811 is a torsion spring that is configured so that the bias of the torsion spring tends to straighten torsion links 2890, 2891 relative to one another (i.e., resist bending of torsion links relative to each other about pivot axis AX29). Here, one end of the torsion link 2890 is pivotally coupled to the slide 2877 while the other end of the torsion link 2890 is pivotally coupled to one end of torsion link 2891 about pivot axis AX29. The other end of torsion link 2891 is pivotally coupled to the housing cover 280C, skirt 280S, or any other suitable frame member of the infant support receiver coupling 200C about axis AX27. As the cam lever is rotated in direction R28, the bias of the resilient member 2811 on the torsion links 2890, 2891 pushes the slide 2877 in direction D20 against the cam surface 2878S (causing the torsion links 2890, 2891 to unfold relative to each other) so that the locking arm 2830 disengages the locking post 2810. As the cam lever is rotated in direction R27, the cam surface 2878 pushes the slide 2877 in direction D21 against the bias of the resilient member 2811 on the torsion links 2890, 2891 (causing the torsion links 2890, 2891 to fold relative to each other) so that the locking arm 2830 engages the locking post 2810.

It is noted that while a single locking arm 2830 and locking post 2810 are illustrated in FIG. 15A, in other aspects, any suitable number of locking arms and locking posts may be provided. For example, as illustrated in FIGS. 15B and 15C, the infant support receiver coupling 200C can include more than one slider 2877, 2877A where more than one locking arm (substantially similar to locking arm 2830) can be mounted to each slider 2877, 2877A. Here, another torsion member 2892 is pivotally coupled at one end to torsion member 2891 and pivotally coupled at the other end to slider 2877A. Another resilient member 2811A (substantially similar to resilient member 2811) is provided to bias torsion member 2892 relative to torsion member 2891 in a manner substantially similar to that described above. In this aspect, as the cam lever 2878 is rotated in direction R28, slider 2877 moves in direction D20 while slider 2877A moves in direction D21 so that the sliders move in opposite directions away from each other to provide an opposing release movement of the respective locking arms from the respective locking posts (e.g., locking arms on slider 2877A oppose the locking arms on slider 2877—see FIG. 15B). As the cam lever 2878 is rotated in direction R27, slider 2877 moves in direction D21 while slider 2877A moves in direction D20 so that the sliders move in opposite directions towards each other to provide an opposing locking movement of the respective locking arms to the respective locking posts.

Figure 24:
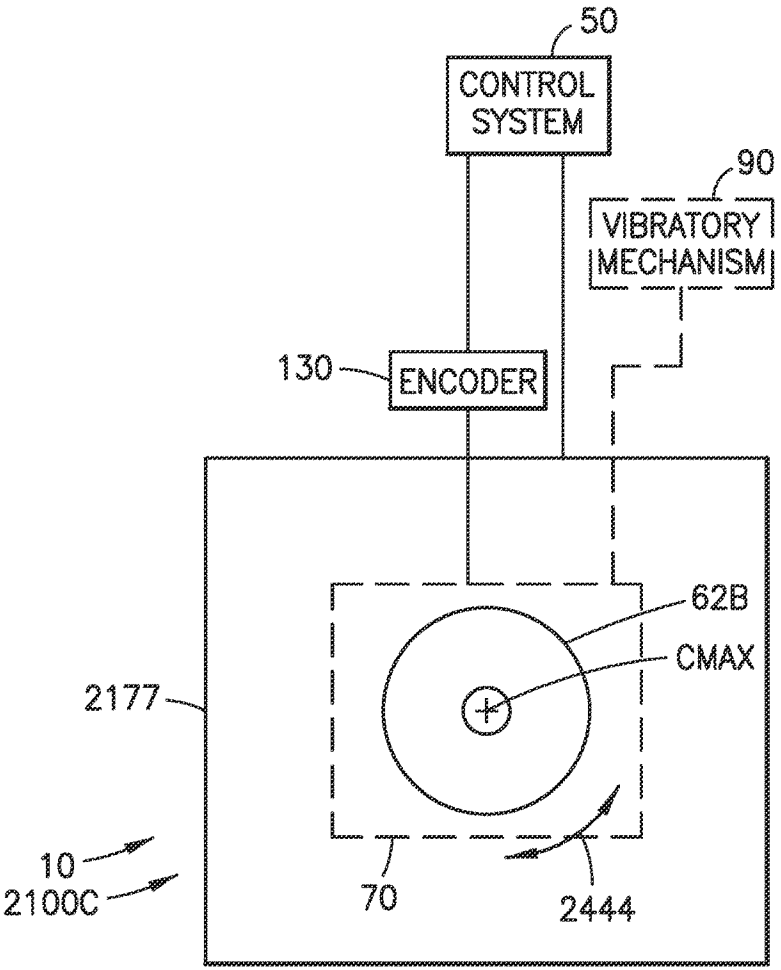
FIG. 24 illustrates a portion of a drive mechanism of the infant care apparatus in accordance with aspects of the disclosed embodiment.
Figure 23:
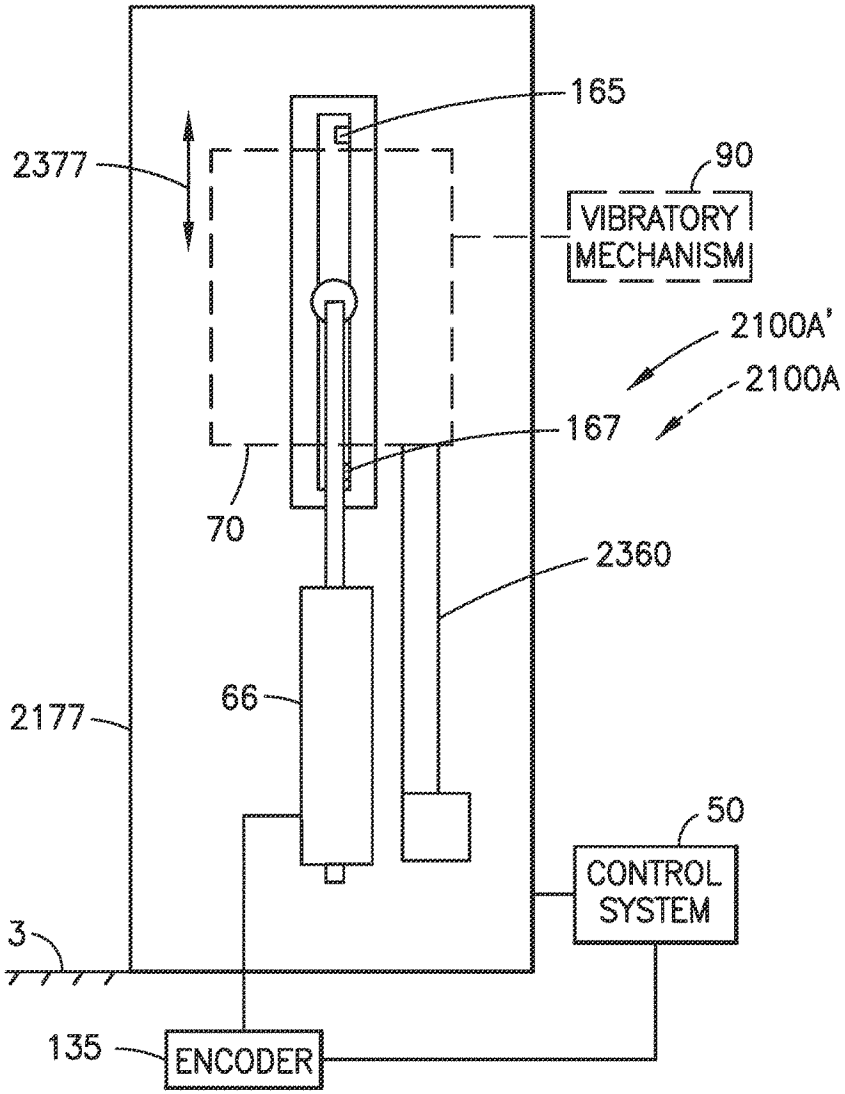
FIG. 23 illustrates a portion of a drive mechanism of the infant care apparatus in accordance with aspects of the disclosed embodiment.
Figure 25A:
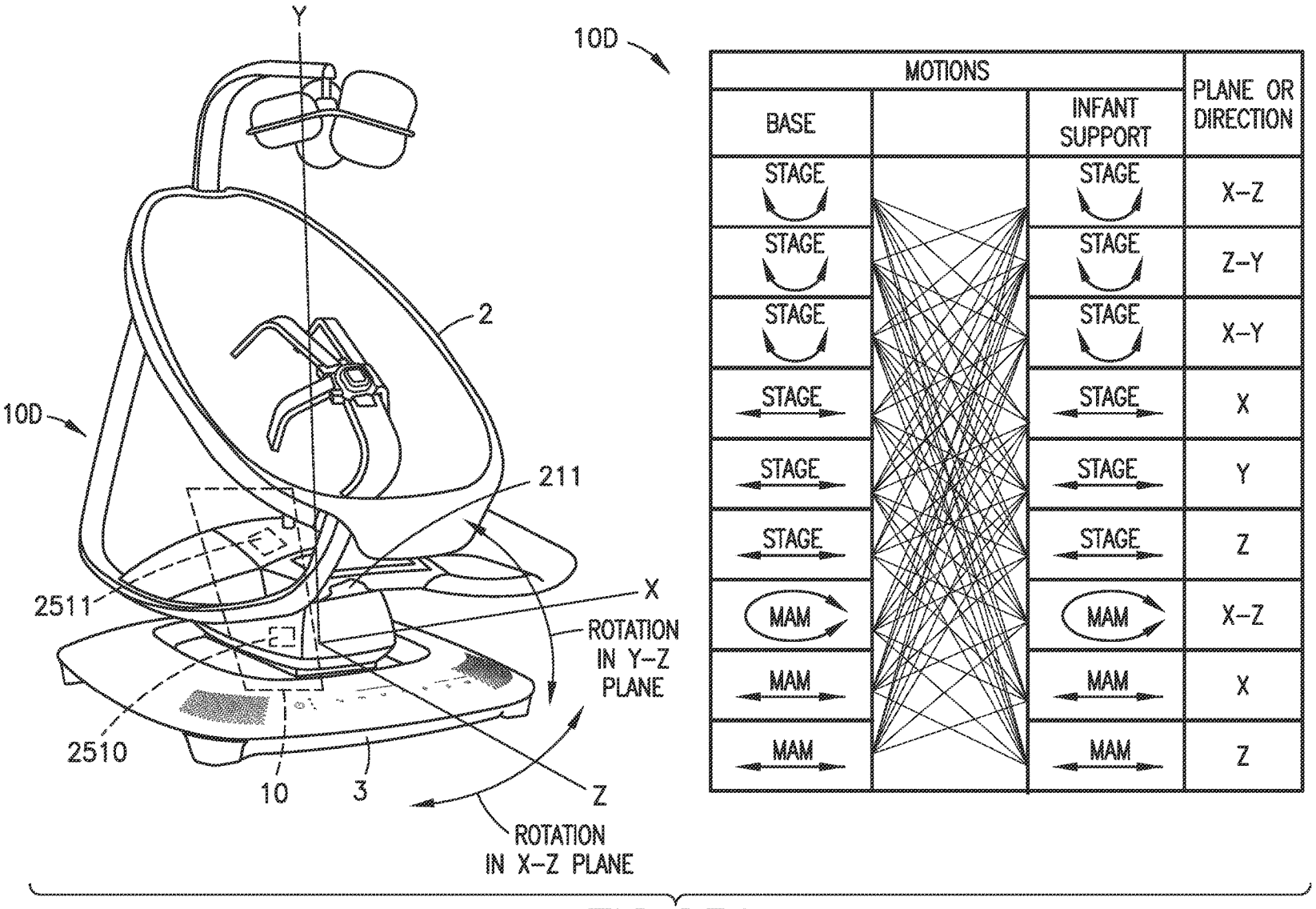
FIG. 25A illustrates motions of the infant care apparatus effected by the drive mechanisms described herein in accordance with aspects of the disclosed embodiments.
Figure 25B:
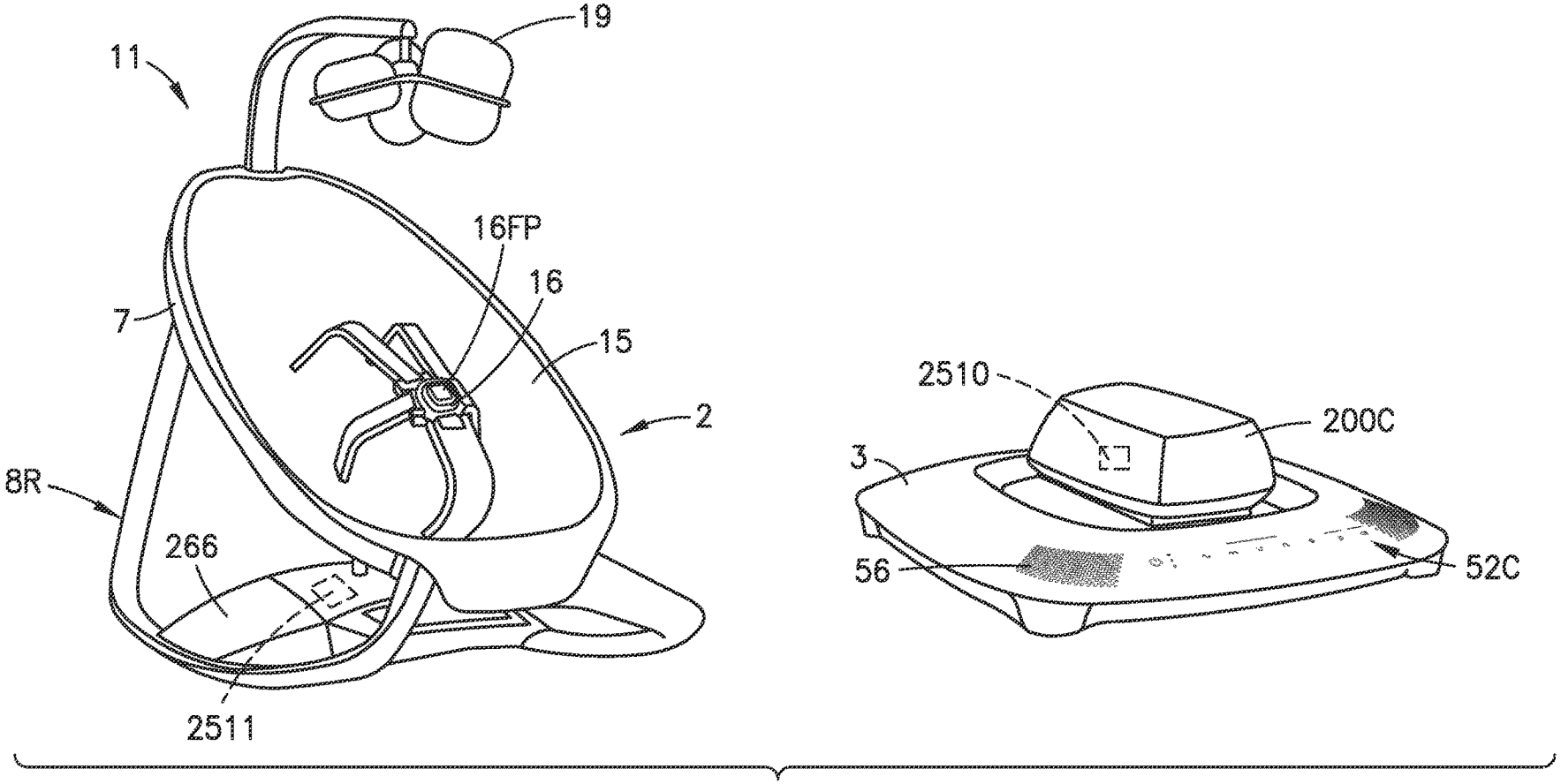
FIG. 25B is an exemplary illustration of the infant case apparatus having a distributed drive mechanism with an infant support separated from its base in accordance with aspects of the disclosed embodiment.

Referring now to FIGS. 1E, 25A, and 25B, in one aspect, the infant care apparatus 1 may include a drive mechanism 10 coupled to the base 3, a vibratory mechanism 90, 90A, and a control system 50 (including controller 51) communicably coupled to each of the drive mechanism 60 and the vibratory mechanism 90, 90A. In one aspect, referring also to FIGS. 16A-16C, 18A-19B, and 21A-24, the drive mechanism 10 is coupled to the base 3 in any suitable manner so that the infant support coupling 200 is coupled to and supported by the drive mechanism 10 (as described herein), and so that at least a portion of the drive mechanism 10 is shrouded by the housing cover 280C and/or skirt 280S. The drive mechanism 10 has a first electromechanical driver 2510 (e.g., one or more of a multi-actuator motion module 1600A, 1600B, 1600C and a reciprocating (or cyclic) motion stage 2100A, 2100A', 2100A", 2100B, 2100B', 2100B", 2100C) that defines at least a first degree of freedom forming at least a first axis of motion (e.g., a linear or rotational motion—see FIG. 25A) of a movable infant load seat surface 1690. As described herein, the movable infant load seat surface 1690 is dependent from and movable relative to the base 3.

The drive mechanism 10 is a distributed drive mechanism 10D distributed to the base 3 and the infant support 2, wherein the distributed drive mechanism 10D includes a second electromechanical driver 2511 integral with the infant support, the second electromechanical driver 2511 (e.g., another one or more of a multi-actuator motion module 1600A, 1600B, 1600C and a reciprocating motion stage 2100A, 2100A', 2100A", 2100B, 2100B', 2100B", 2100C) being separate and distinct from the first electromechanical driver 2510, and defining at least a second degree of freedom (i.e., that is independent of the first degree of freedom) forming at least a second axis of motion (e.g., a linear or rotational motion—see FIG. 25A) of the infant support 2. As will be described herein, one or more of the first electromechanical driver 2510 and the second electromechanical driver 2511 is at least one of a rotary motor, a linear motor, and a linear actuator (see FIGS. 20A-20D and 21A-24).

While, the distributed drive mechanism 10D has been described as having a first electromechanical driver 2510 located with the base 3 and a second electromechanical driver 2511 located with the infant support 2, each of the first and second electromechanical drivers 2510, 2511 may include more than one separate and distinct electromechanical driver that each define a respective degree of freedom and form a respective axis of motion of the infant support and/or the movable infant load seat surface 1690. For example, referring also to FIG. 25A the first electromechanical driver 2510 (of the base 3) includes more than one separate and distinct electromechanical driver (e.g., more than one of the multi-actuator motion module(s) 1600A, 1600B, 1600C and reciprocating motion stage(s) 2100A, 2100A', 2100A", 2100B, 2100B', 2100B", 2100C). Each of the more than one of the multi-actuator motion module(s) 1600A, 1600B, 1600C and reciprocating motion stage(s) 2100A, 2100A', 2100A", 2100B, 2100B', 2100B", 2100C (e.g., of the first electromechanical driver 2510) being separate and distinct from each other, and defines an independent degree of freedom forming an independent axis of motion (e.g., linear or rotational—see FIG. 25A), so that the first electromechanical driver 2510 defines two or more independent degrees of freedom. Similarly, the second electromechanical driver 2511 (of the infant support 2) includes more than one separate and distinct electromechanical driver (e.g., more than one of the multi-actuator motion module(s) 1600A, 1600B, 1600C and reciprocating motion stage(s) 2100A, 2100A', 2100A", 2100B, 2100B', 2100B", 2100C). Each of the more than one of the multi-actuator motion module(s) 1600A, 1600B, 1600C and reciprocating motion stage(s) 2100A, 2100A', 2100A", 2100B, 2100B', 2100B", 2100C (e.g., of the second electromechanical driver 2511) being separate and distinct from each other, and defines an independent degree of freedom forming an independent axis of motion (e.g., linear or rotational—see FIG. 25A), so that the second electromechanical driver 2511 defines two or more independent degrees of freedom. Each of the one or more multi-actuator motion module(s) 1600A, 1600B, 1600C and reciprocating motion stage(s) 2100A, 2100A', 2100A", 2100B, 2100B', 2100B", 2100C of the first electromechanical driver 2510 moves in a coordinated manner with the one or more multi-actuator motion module(s) 1600A, 1600B, 1600C and reciprocating motion stage(s) 2100A, 2100A', 2100A", 2100B, 2100B', 2100B", 2100C of the second electromechanical driver 2511 to provide the different combinations of linear and rotational motions illustrated in FIG. 25A (e.g., reciprocating rotational motions effected by a reciprocating motion stage are indicated in FIG. 25A with curved double-ended arrows and the "STAGE" identifier, substantially straight line linear motions effected by a reciprocating motion stage are indicated in FIG. 25A with straight double-ended arrow and the "STAGE" identifier, circular rotational motions along effected by a multi-actuator motion module are indicated in FIG. 25A with a circular double-ended arrow and the "MAM" identifier, and linear motions effected with a multi-actuator motion module are indicated in FIG. 25A with straight double-ended arrows and the "MAM" identifier).

Figure 16A:
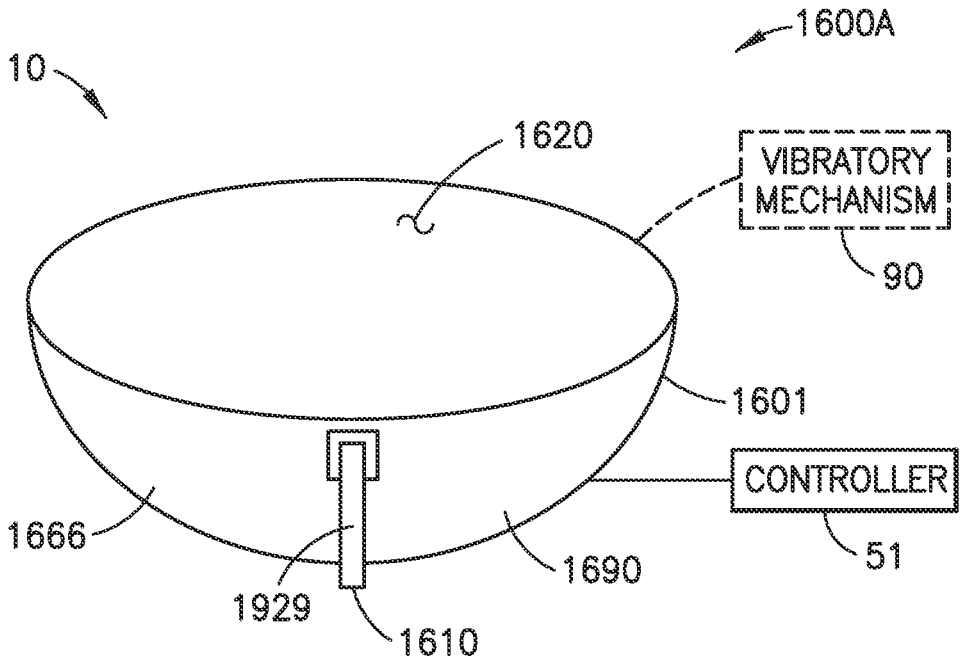
FIGS. 16A-16C illustrate a portion of a drive mechanism of the infant care apparatus in accordance with aspects of the disclosed embodiment.
Figure 16B:
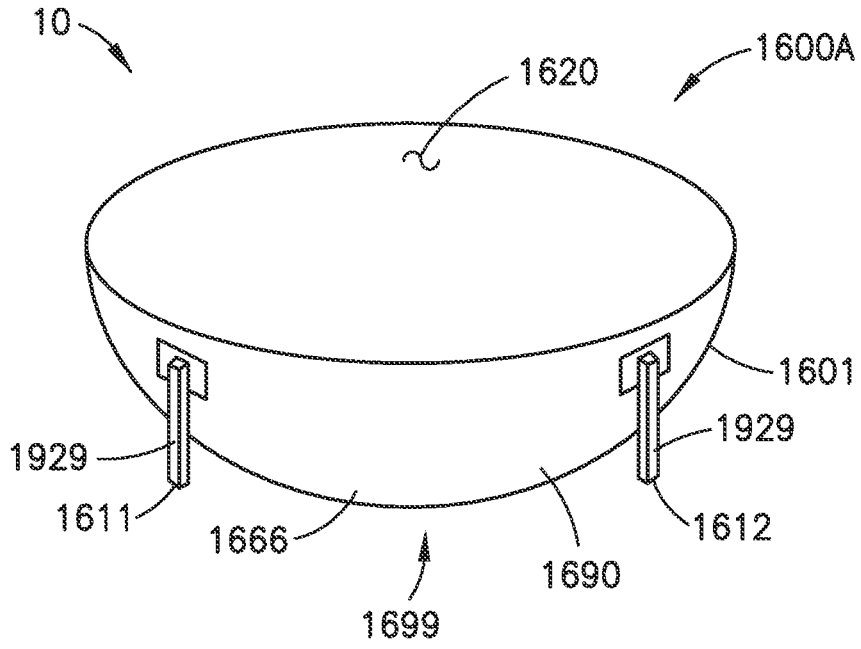
Figure 16C:
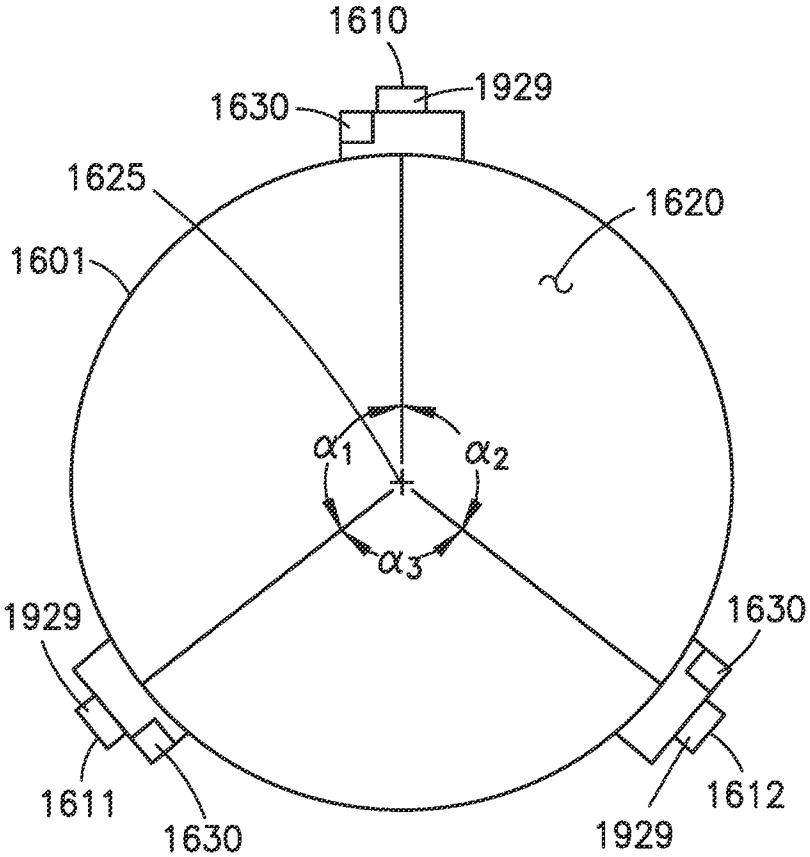

As can be seen in FIGS. 16A-16C the multi-actuator motion module 1600A, 1600B, 1600C includes a module base 1601 that has a hemispherical shape, hemi-spheroid shape, or any other suitable shape that forms a movable infant load seat surface 1690 and effects a substantially single point of contact (e.g., at an apex 1699 of the movable infant load seat surface 1690) with a support surface (e.g., a floor, table, coupling platform of a reciprocating motion stage, coupling surface of a another multi-actuator motion module, a substantially planar mating base surface 3B of the base (see FIG. 1A), etc.) on which the multi-actuator motion module 1600A, 1600B, 1600C is placed. Here, the infant load seat surface 1690 is a curved surface with the apex 1699 mated against, e.g., the substantially planar mating base surface 3B of the base 3. The movable infant load seat surface 1690 is disposed so that the apex moves relative to the base 3 under impetus imparted to the movable infant load seat surface by a first linear or rotational motion that is determined by the first axis of motion (see FIG. 25A). The base 1601 includes a coupling surface 1620 to which the infant support coupling 200 or another of the one or more multi-actuator motion module 1600A, 1600B, 1600C and a reciprocating motion stage 2100A, 2100A', 2100A", 2100B, 2100B', 2100B", 2100C is coupled.

The multi-actuator motion module 1600A, 1600B, 1600C includes at least two actuators coupled to the module base 1601 that are configured to effect, at least one axis of motion, which when located with the base 3 is the first axis of motion and when located with the infant support 2 is a second axis of motion. The motion provided by the at least one axis of motion of the multi-actuator motion module provides at least an inverted pendulum (e.g., rocking) movement of the module base 1601.

In the aspect illustrated in FIGS. 16A-16C the module base 1601 includes a hemispherical shape or hemi-spheroid shape 1666 with three actuators 1610-1612 coupled thereto. The surface of the hemispherical shape or hemi-spheroid shape 1666 forms the movable infant load seat surface 1690. The three actuators 1610-1612 are radially spaced about a centerline 1625 (e.g., the centerline 1625 extends substantially orthogonal from a center of the coupling surface 1620). Here the actuators 1610 and 1611 are spaced apart by angle $\alpha 1$, the actuators 1611 and 1612 are spaced apart by angle α3, and the actuators 1610 and 1612 are spaced apart by angle α2. In one aspect, the angles α1, α2, α3 are substantially the same, while in other aspects the angles α1, α2, α3 are any suitable angles for effecting the movements of the module base 1601 described herein.

Figure 17A:
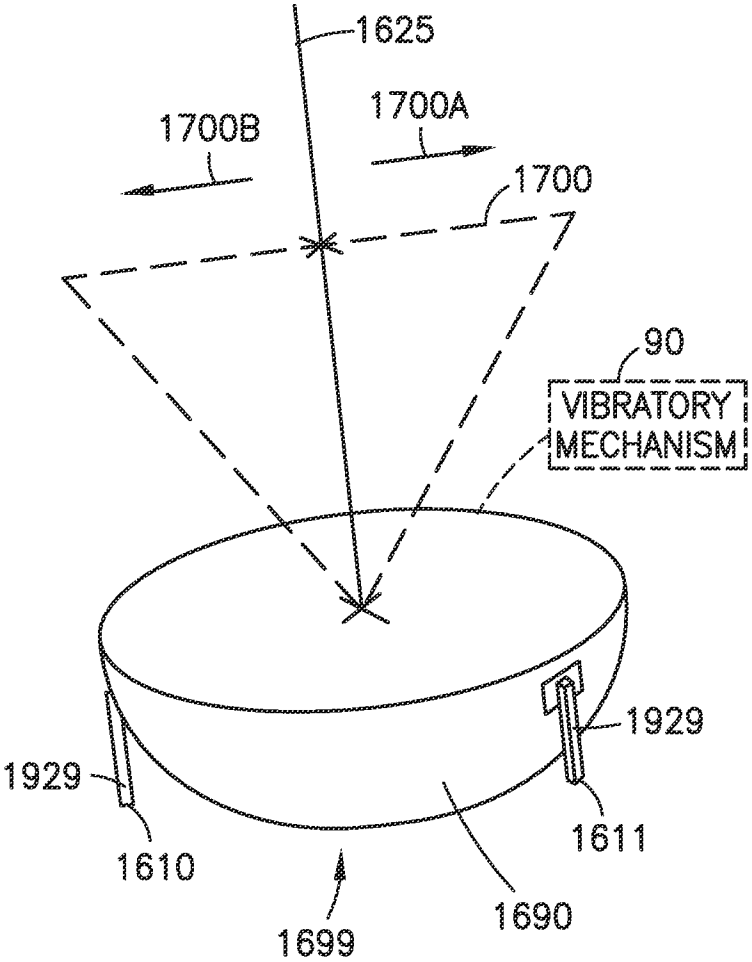
FIG. 17A illustrates an exemplary substantially linear motion path effected by the portion of the drive mechanism of FIGS. 16A-16C in accordance with aspects of the disclosed embodiment.
Figure 17C:
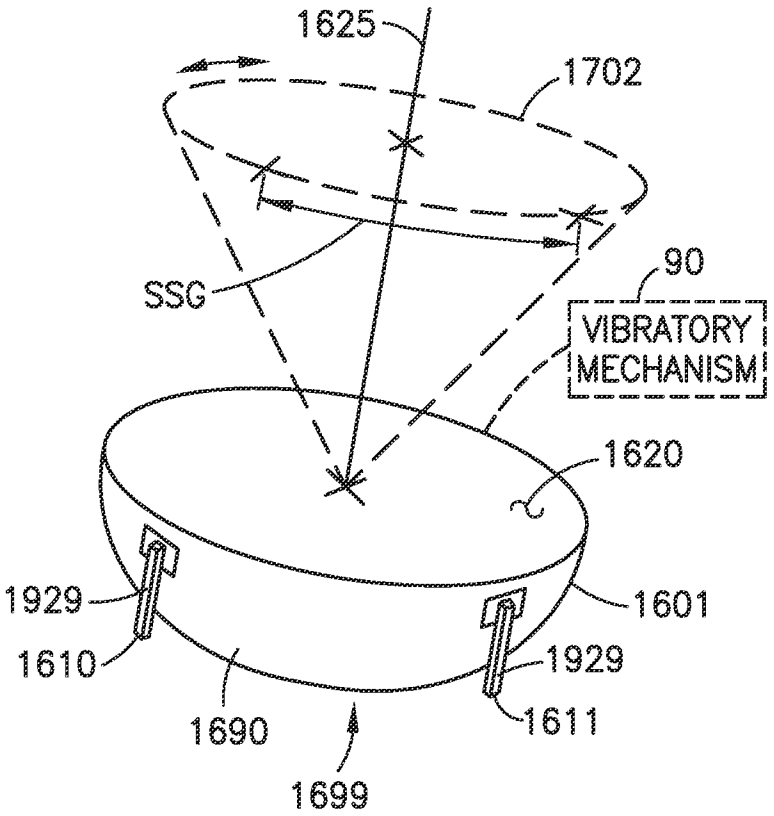
FIG. 17C illustrates an exemplary substantially ovoid motion path effected by the portion of the drive mechanism of FIGS. 16A-16C in accordance with aspects of the disclosed embodiment.
Figure 17B:
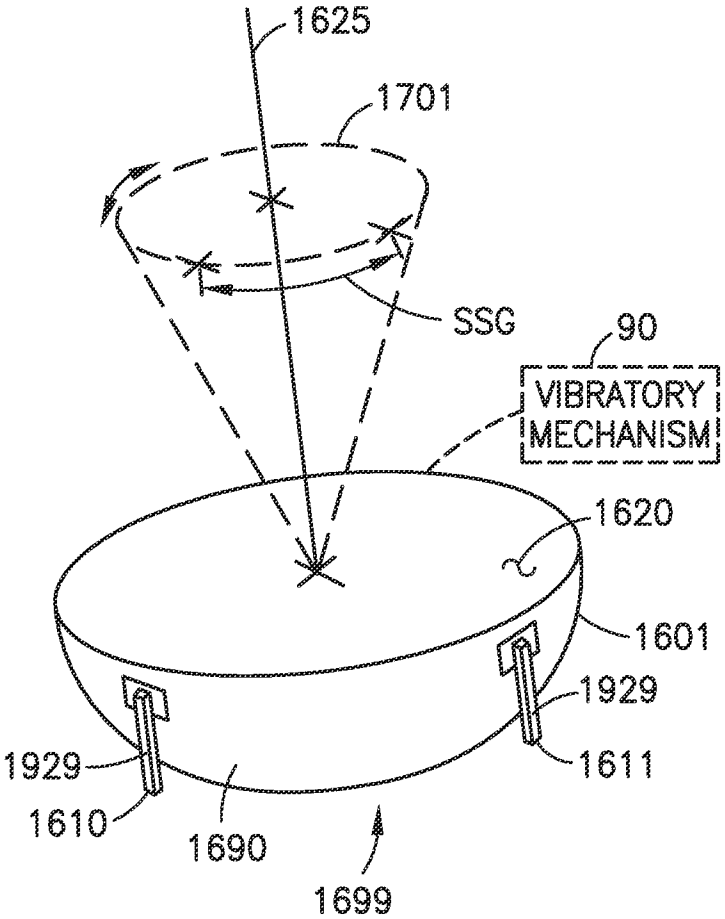
FIG. 17B illustrates an exemplary substantially circular motion path effected by the portion of the drive mechanism of FIGS. 16A-16C in accordance with aspects of the disclosed embodiment.

The actuators 1610, 1611, 1612 are coupled to and under control of, for example, the controller 51 so that each actuator 1610, 1611, 1612 is actuable independent of the other actuators 1610, 1611, 1612. The multi-actuator motion module 1600A, 1600B, 1600C also includes any suitable sensors 1630 (e.g., encoders, limit switches, etc. similar to those described herein) coupled to the controller 51 and a respective one of the actuators 1610, 1611, 1612. The sensors 1630 are configured to sense a position of the respective actuator 1610, 1611, 1612 and provide motion feedback to the controller 51. The controller 51 is configured with any suitable non-transitory program code so that the controller 51 receives the motion feedback from the sensors 1630 and effects movement of one or more of the actuators 1610, 1611, 1612 that corresponds to a predetermined motion path (the predetermined motion path being selected by a user from the control panel 52C or any other suitable user interface (as described herein). Exemplary motion paths/motions that are generated through controlled actuation (e.g., by the controller 51) of the actuators 1610, 1611, 1612 are illustrated in FIGS. 17A-17C, although other motion paths may be possible. FIG. 17A illustrates a substantially straight inverted pendulum (e.g., rocking motion in direction 1700) of the module base 1601 that is effected through a coordinated alternating actuation of, for example, actuator 1610 and an opposing actuation of both actuators 1611, 1612. For example, in an alternating manner, actuator 1610 is actuated to rock the module base 1601 in direction 1700A and both actuators 1611, 1612 are actuated to rock the module base 1601 in direction 1700B so as to effect the rocking motion in direction 1700. FIG. 17B illustrates a substantially circular (cyclic) motion path 1701 effected by, for example, coordinated sequential operation of the actuators 1610, 1611, 1612 (e.g., the actuators are independently actuated one after the other). Here the direction of the circular motion path (e.g. clockwise or counter-clockwise) is dependent on the sequential order in which actuators 1610, 1611, 1612 are actuated (noting that two or more of the actuators 1610, 1611, 1612 may be actuated at the same time but by different amounts of stroke to effect the circular motion path 1701). FIG. 17C illustrates a substantially ovoid (cyclic) motion path 1702 that is effected in a manner substantially similar to that described herein for the substantially circular motion path 1701.

Figure 18A:
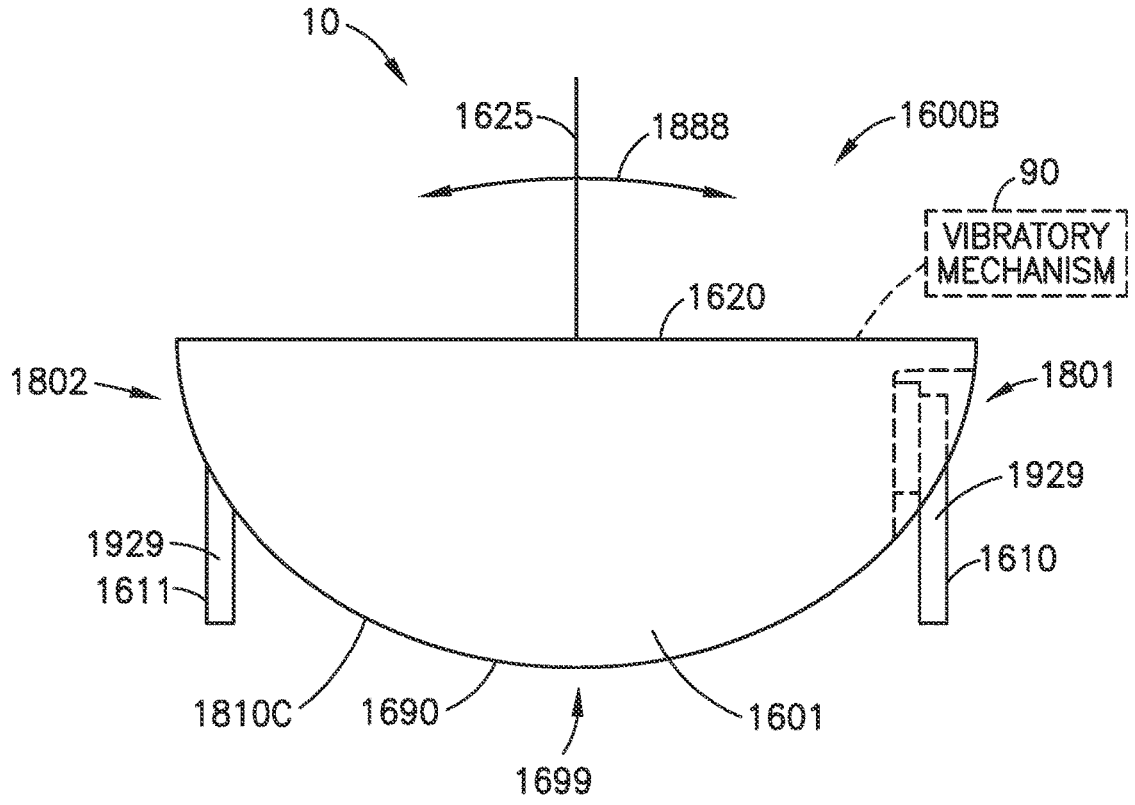
FIGS. 18A and 18B illustrate a portion of a drive mechanism of the infant care apparatus in accordance with aspects of the disclosed embodiment.
Figure 18B:
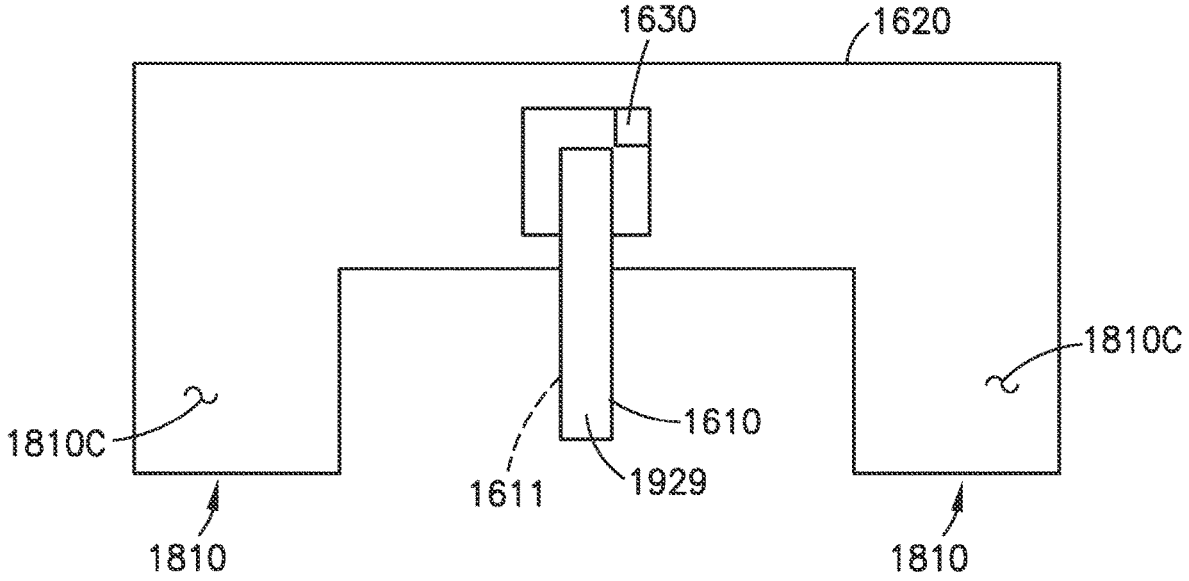

In the aspect illustrated in FIGS. 18A and 18B the module base 1601 includes at least one rocker 1810 (two are illustrated in FIGS. 18A and 18B for exemplary purposes only and in other aspects there may be one or more than two rockers) whose curved contact surface 1810C extends between opposite ends 1801, 1802 of the module base 1601. The curved contact surface 1810C of the at least one rocker 1810 forms the movable infant load seat surface 1690 having the apex 1699. The at least one rocker 1810 is configured to provide the module base 1601 with a linear rocking motion along a single axis that extends between ends 1801, 1802. In this aspect, there is at least one actuator 1610, 1611 disposed at or adjacent each end 1801, 1802.

As described above, the actuators 1610, 1611 are coupled to and under control of, for example, the controller 51 so that each actuator 1610, 1611 is actuable independent of the other actuator 1610, 1611. The controller 51 is configured with any suitable non-transitory program code so that the controller 51 receives the motion feedback from the sensors 1630 (described above) and effects movement of one or more of the actuators 1610, 1611 so that the coupling surface 1620 (and the infant support 2 coupled thereto) moves along the curved motion path 1888 which may be a component of a predetermined motion path being selected by a user from the control panel 52C or any other suitable user interface (as described herein).

Figure 19A:
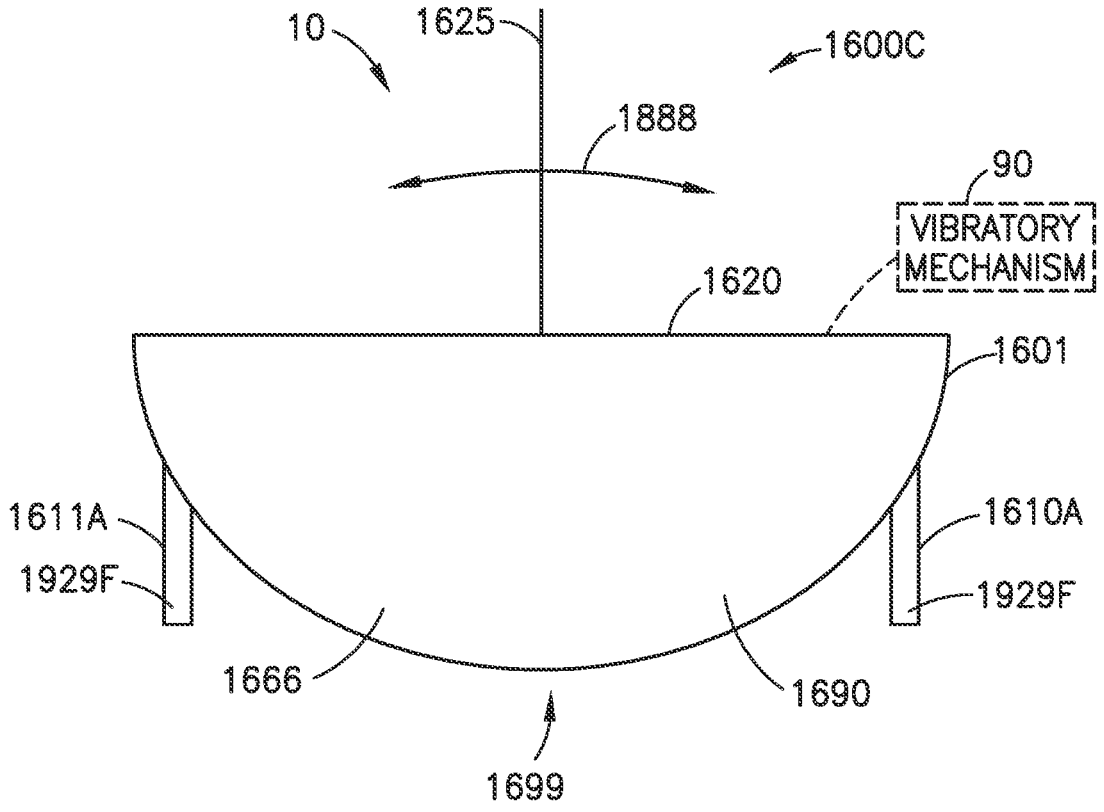
FIGS. 19A and 19B illustrate a portion of a drive mechanism of the infant care apparatus in accordance with aspects of the disclosed embodiment.
Figure 19B:
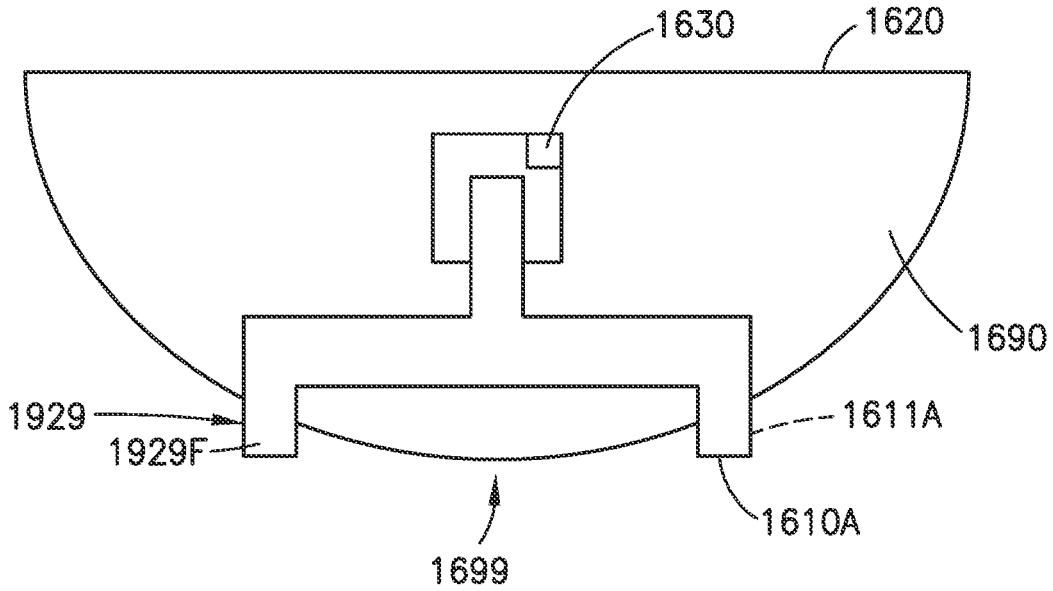

In the aspect illustrated in FIGS. 19A and 19B the module base 1601 includes the hemispherical shape or hemi-spheroid shape 1666 as in FIGS. 16A-16C; however, in this aspect there two actuators 1610A, 1611A that are coupled to the module base 1601 so that the actuators are diametrically opposite one another. The actuators 1610A, 1611A are substantially similar to actuators 1610, 1611; however, a pusher or leg 1929 of the actuators 1610A, 1611A is a forked pusher or leg 1929F so as to substantially confine movement of the coupling surface 1620 to a linear rocking movement that is substantially similar to that of FIGS. 18A and 18B.

As described above, the actuators 1610A, 1611A are coupled to and under control of, for example, the controller 51 so that each actuator 1610A, 1611A is actuable independent of the other actuator 1610A, 1611A. The controller 51 is configured with any suitable non-transitory program code so that the controller 51 receives the motion feedback from the sensors 1630 (described above) and effects movement of one or more of the actuators 1610A, 1611A so that the coupling surface 1620 (and the infant support 2 coupled thereto) moves along the curved motion path 1888 which may be a component of a predetermined motion path being selected by a user from the control panel 52C or any other suitable user interface (as described herein).

Figure 20A:
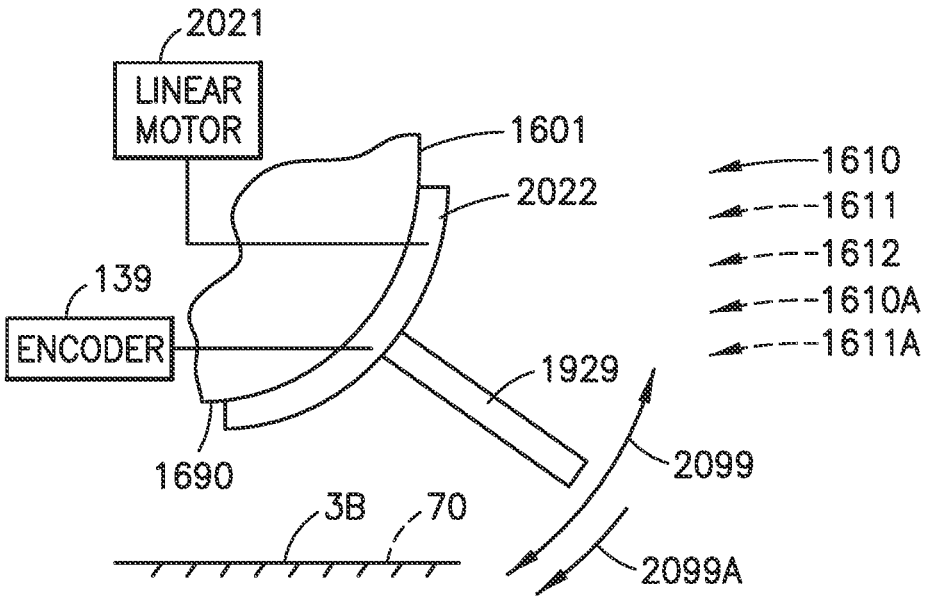
FIGS. 20A-20D illustrate exemplary actuators/motors of the portions of the drive sections illustrated in FIGS. 16A-19B in accordance with aspects of the disclosed embodiment.

Referring to FIGS. 16A-19B and 20A-20D, an exemplary actuator 1610 of the multi-actuator motion modules 1600A, 1600B, 1600C will be described, noting that the other actuators 1610A, 1611, 1611A, 1612 are substantially similar. The actuator 1610 includes a pusher or leg 1929 and one or more of a linear motor 2021 and a rotary motor 2031. The pusher 1929 is coupled to the module base 1601 in any suitable manner. For example, FIG. 20A illustrates a sliding coupling of the pusher 1929 to the module base 1601. Here the pusher 1929 is coupled to a rail or track 2022 of the linear motor 2021, where the rail 2022 follows the contour of the movable infant load seat surface 1920. The pusher 1929 extends from the rail 2022 in a direction that is substantially orthogonal to the movable infant load seat surface 1690. The linear motor 2021 is coupled to the controller 51 so that the controller 51 effects operation of the linear motor 2021 to drive the pusher 1929 in curvilinear direction 2099 along the track 2022. As the pusher 1929 moves in direction 2099A the pusher 1929 engages the base surface 3B (FIG. 1A) of the base 3 (or any other suitable substantially planar mating surface, such surface 1620 of another multi-actuator motion module or platform 70 of a reciprocating motion stage on which the module base 1601 is superposed) so as to effect movement of the apex 1699 relative to the base 3 under impetus imparted to the infant load seat surface 1690 by the pusher 1929 in accordance with a selected motion profile of the infant care apparatus 1.

Figure 20B:
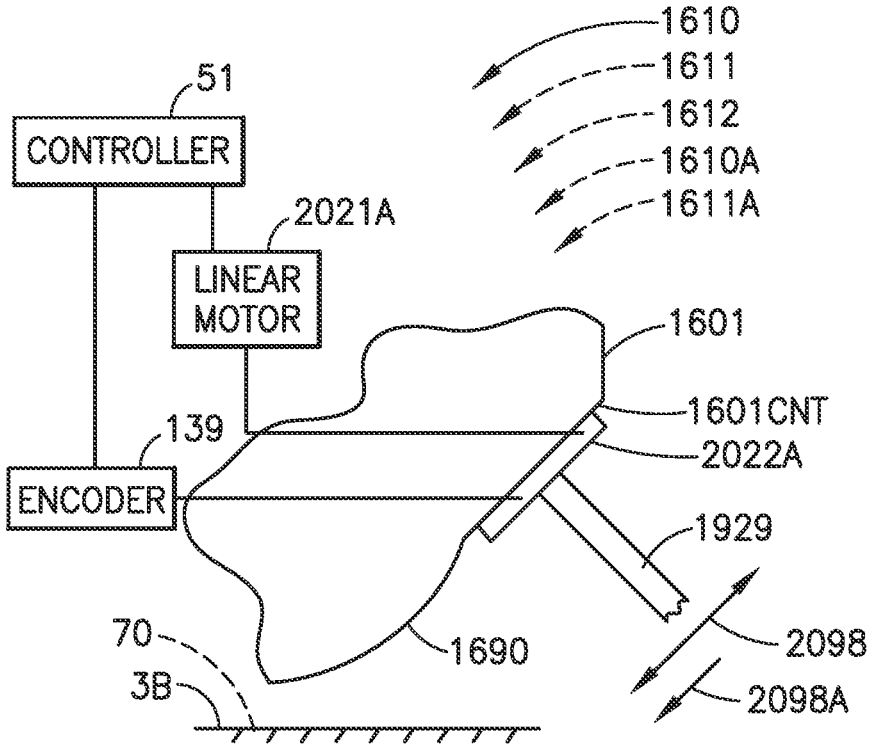

FIG. 20B illustrates a sliding coupling of the pusher 1929 to the module base 1601, where the module base 1601 has a contour surface 1601CNT (distinct from the movable infant load seat surface 1690) that at least in part defines a direction of motion of the pusher 1929. Here the pusher 1929 is coupled to a rail or track 2022A of the linear motor 2021A, where the rail 2022A seats against the contour surface 1601CNT of the module base 1601 so that the contour surface 1601CNT defines a distinct seating surface of the rail 2022A on the module base 1601. The pusher 1929 extends from the rail 2022A in a direction that is substantially orthogonal to the contour surface 1601CNT. The linear motor 2021A is coupled to the controller 51 so that the controller 51 effects operation of the linear motor 2021A to drive the pusher 1929 in linear direction 2098 along the track 2022A. As the pusher 1929 moves in direction 2098A the pusher 1929 engages the base surface 3B (FIG. 1A) of the base 3 (or any other suitable substantially planar mating surface, such surface 1620 of another multi-actuator motion module or platform 70 of a reciprocating motion stage on which the module base 1601 is superposed) so as to effect movement of the apex 1699 relative to the base 3 under impetus imparted to the infant load seat surface 1690 by the pusher 1929 in accordance with a selected motion profile of the infant care apparatus 1.

Figure 20C:
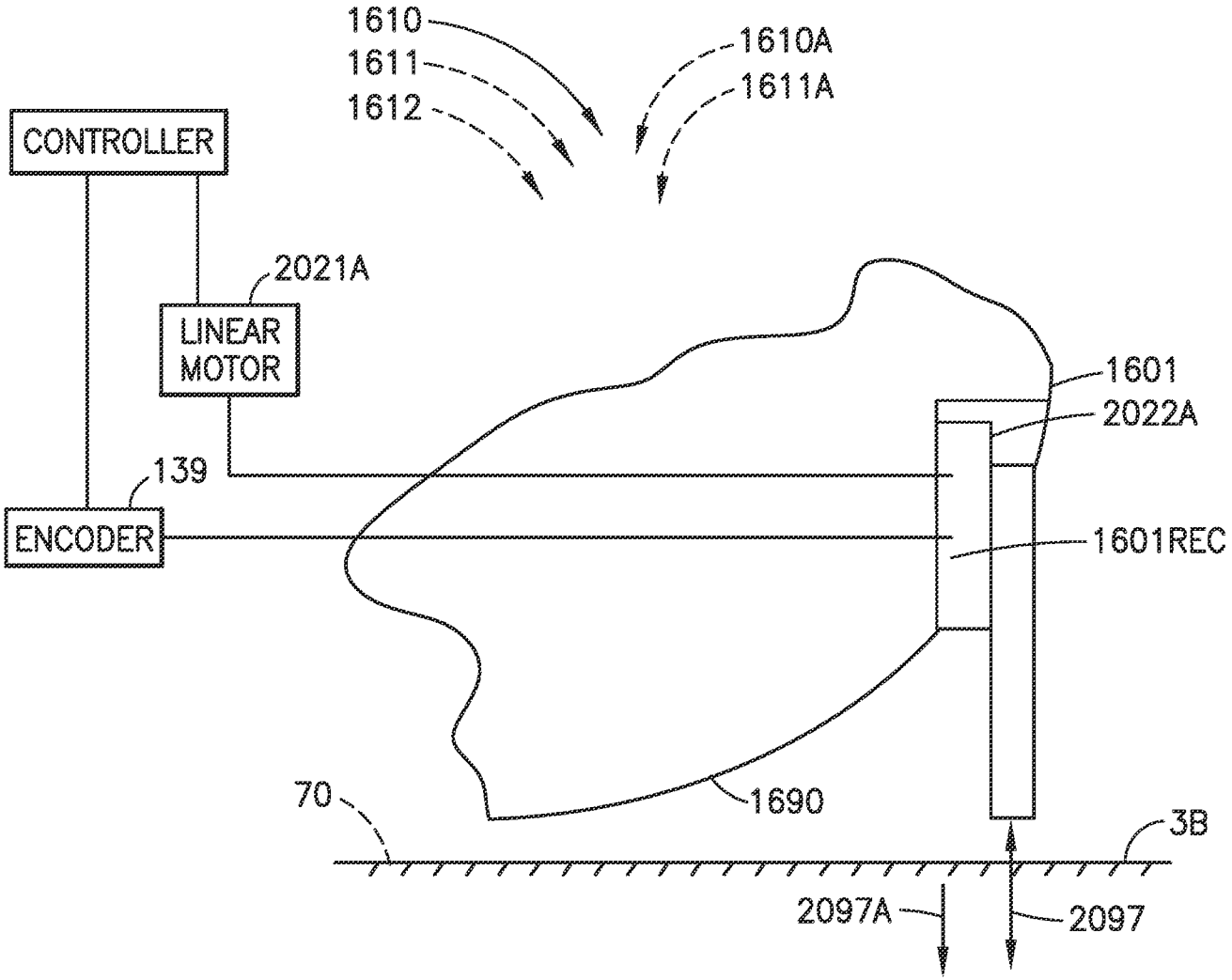

FIG. 20C illustrates another sliding coupling of the pusher 1929 to the module base 1601, where the module base 1601 has a recessed surface 1601REC (distinct from the movable infant load seat surface 1690 or recessed into to the movable infant load seat surface 1690) that at least in part defines a direction of motion of the pusher 1929. Here the pusher 1929 is coupled to a rail or track 2022A of the linear motor 2021A, where the rail 2022A seats against the recessed surface 1601REC of the module base 1601 so that the recessed surface 1601REC defines a distinct seating surface of the rail 2022A on the module base 1601. In this aspect, the pusher 1929 is coupled to the rail 2022A so as to extend in a direction substantially parallel with or along the rail 2022A in a direction that is substantially parallel to the recessed surface 1601REC. The linear motor 2021A is coupled to the controller 51 so that the controller 51 effects operation of the linear motor 2021A to drive the pusher 1929 in linear direction 2097 along the track 2022A. As the pusher 1929 moves in direction 2097A the pusher 1929 engages the base surface 3B (FIG. 1A) of the base 3 (or any other suitable substantially planar mating surface, such surface 1620 of another multi-actuator motion module or platform 70 of a reciprocating motion stage on which the module base 1601 is superposed) so as to effect movement of the apex 1699 relative to the base 3 under impetus imparted to the infant load seat surface 1690 by the pusher 1929 in accordance with a selected motion profile of the infant care apparatus 1.

Figure 20D:
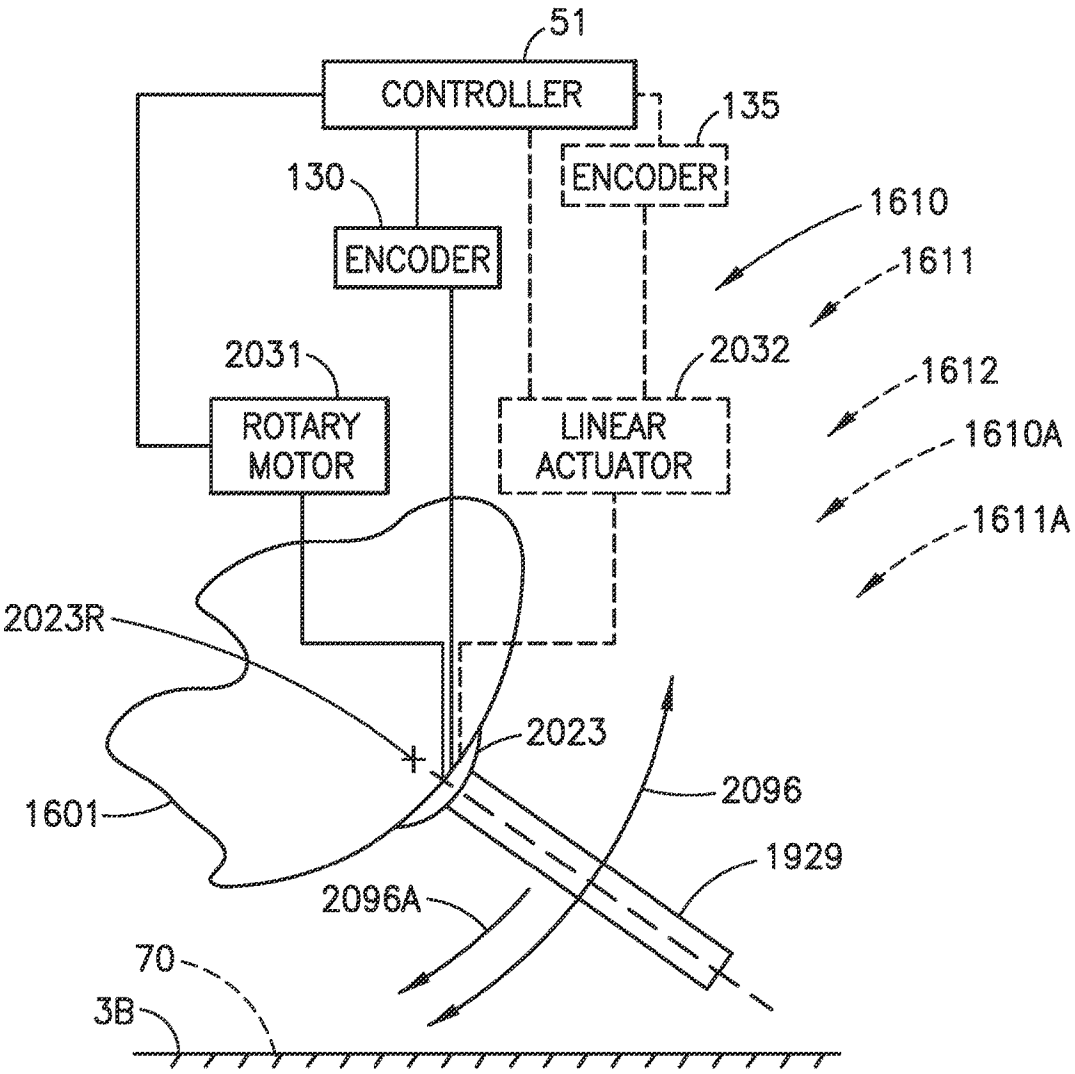

FIG. 20D illustrates another rotary or pivot coupling of the pusher 1929 to the module base 1601. Here the pusher 1929 is coupled to a pivot joint 2023 about pivot axis 2023R. The pivot axis is coupled to or otherwise extends through the movable infant load seat surface (or a distinct surface as described above with respect to FIGS. 20B and 20C). A rotary motor 2031 is coupled to the pusher 1929 in any suitable manner (e.g., directly where the rotary motor is bi-directionally driven or in any other suitable manner) so as to pivot the pusher 1929 about axis 2023R. In other aspects, a linear actuator 2032 may be employed to pivot the pusher 1929 about axis 2023R in any suitable manner (e.g., such as where the axis 2023R acts as a fulcrum for the pivoting movement of the pusher 1929). The rotary motor 2031 (or linear actuator 2032) is coupled to the controller 51 so that the controller 51 effects operation of the rotary motor 2031 (or the linear actuator 2032) to rotate the pusher 1929 about the axis 2023R in direction 2096. As the pusher 1929 pivots in direction 2096A the pusher 1929 engages the base surface 3B (FIG. 1A) of the base 3 (or any other suitable substantially planar mating surface, such surface 1620 of another multi-actuator motion module or platform 70 of a reciprocating motion stage on which the module base 1601 is superposed) so as to effect movement of the apex 1699 relative to the base 3 under impetus imparted to the infant load seat surface 1690 by the pusher 1929 in accordance with a selected motion profile of the infant care apparatus 1.

While different exemplary types of actuator configurations have been described separately with respect to FIGS. 20A-20D, it should be understood that the module base 1601 may include any combination of the different exemplary types of actuators. For example, the module base 1601 may include any suitable combination of the pivoting and linearly guided actuators described above with respect to FIGS. 20A-20D.

Referring to FIGS. 21A-24 the reciprocating motion stage(s) 2100A, 2100A', 2100A", 2100B, 2100B', 2100B", 2100C will be described. The reciprocating motion stages 2100A, 2100A', 2100A", 2100B, 2100B', 2100B", 2100C are each configured to effect a linear (e.g., straight line movement) or rotational movement of the infant support 2. As noted herein, the linear and rotational movements and the corresponding planes/axes thereof are indicated in FIG. 25A by the "STAGE" identifier accompanying the double ended arrows. In a manner similar to that of the multi-actuator motion modules 1600A, 1600B, 1600C, the reciprocating motion stage(s) 2100A, 2100A', 2100A", 2100B, 2100B', 2100B", 2100C may be disposed in one or more of the base 3 and infant support 2 as a component of the first and second electromechanical drivers 2510, 2511. Also, in a manner similar to that of the multi-actuator motion modules, each of the reciprocating motion stage(s) 2100A, 2100A', 2100A", 2100B, 2100B', 2100B", 2100C may be superposed on another of the reciprocating motion stage(s) 2100A, 2100A', 2100A", 2100B, 2100B', 2100B", 2100C and/or multi-actuator motion modules 1600A, 1600B, 1600C so as to provide a compound motion profile where at least one motion is superposed on another motion. As will be described herein, the reciprocating motion stages 2100A, 2100A', 2100A", 2100B, 2100B', 2100B", 2100C include one or more of a rotary actuator and reciprocating crank mechanism (see FIGS. 21A, 22A), a linear actuator (see FIGS. 21B, 22B, 23), a linear motor (see FIGS. 21C, 22C), and a bidirectional rotation rotary motor (see FIG. 24).

Figure 21A:
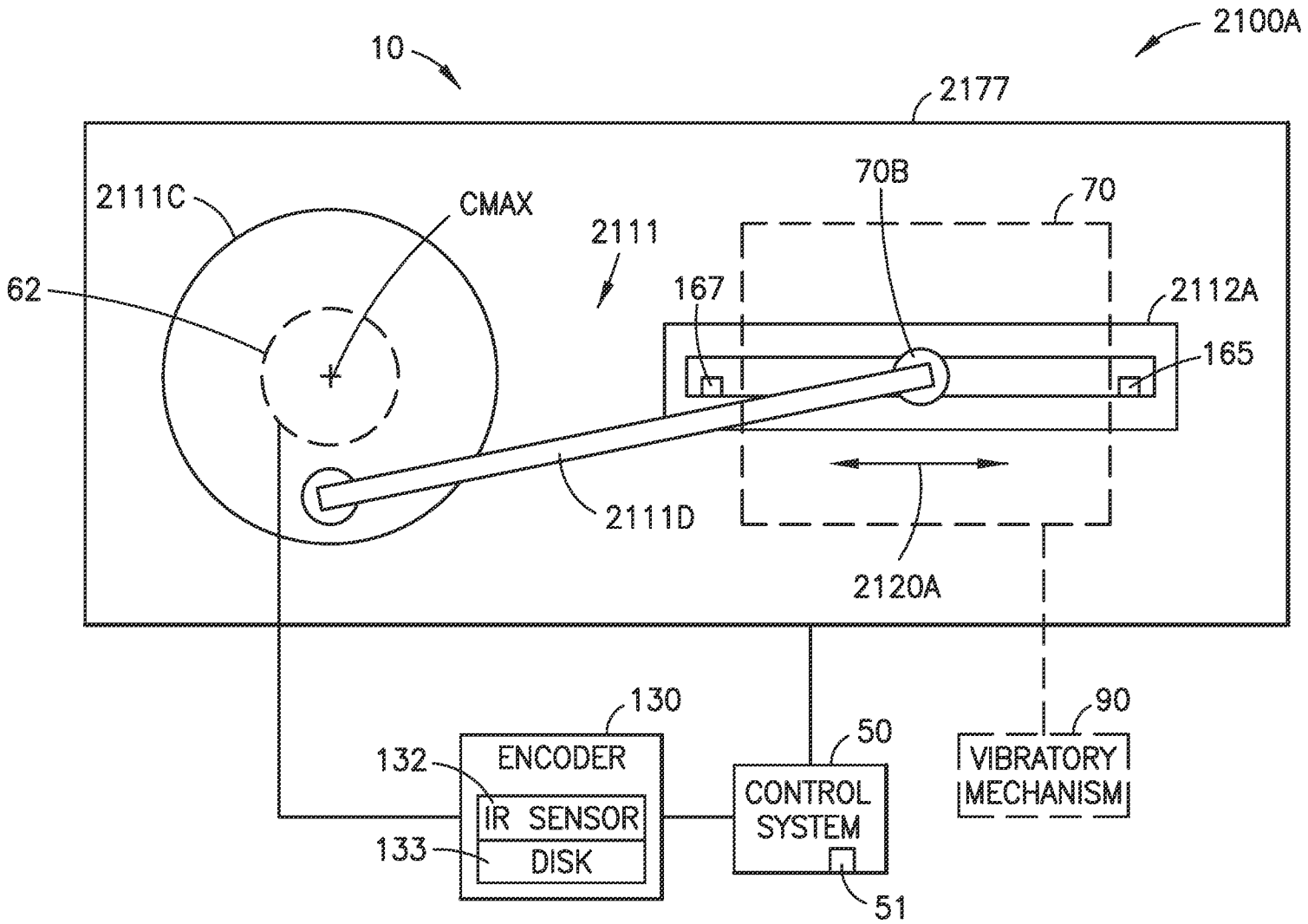
FIG. 21A illustrates a portion of a drive mechanism of the infant care apparatus in accordance with aspects of the disclosed embodiment.
Figure 22A:
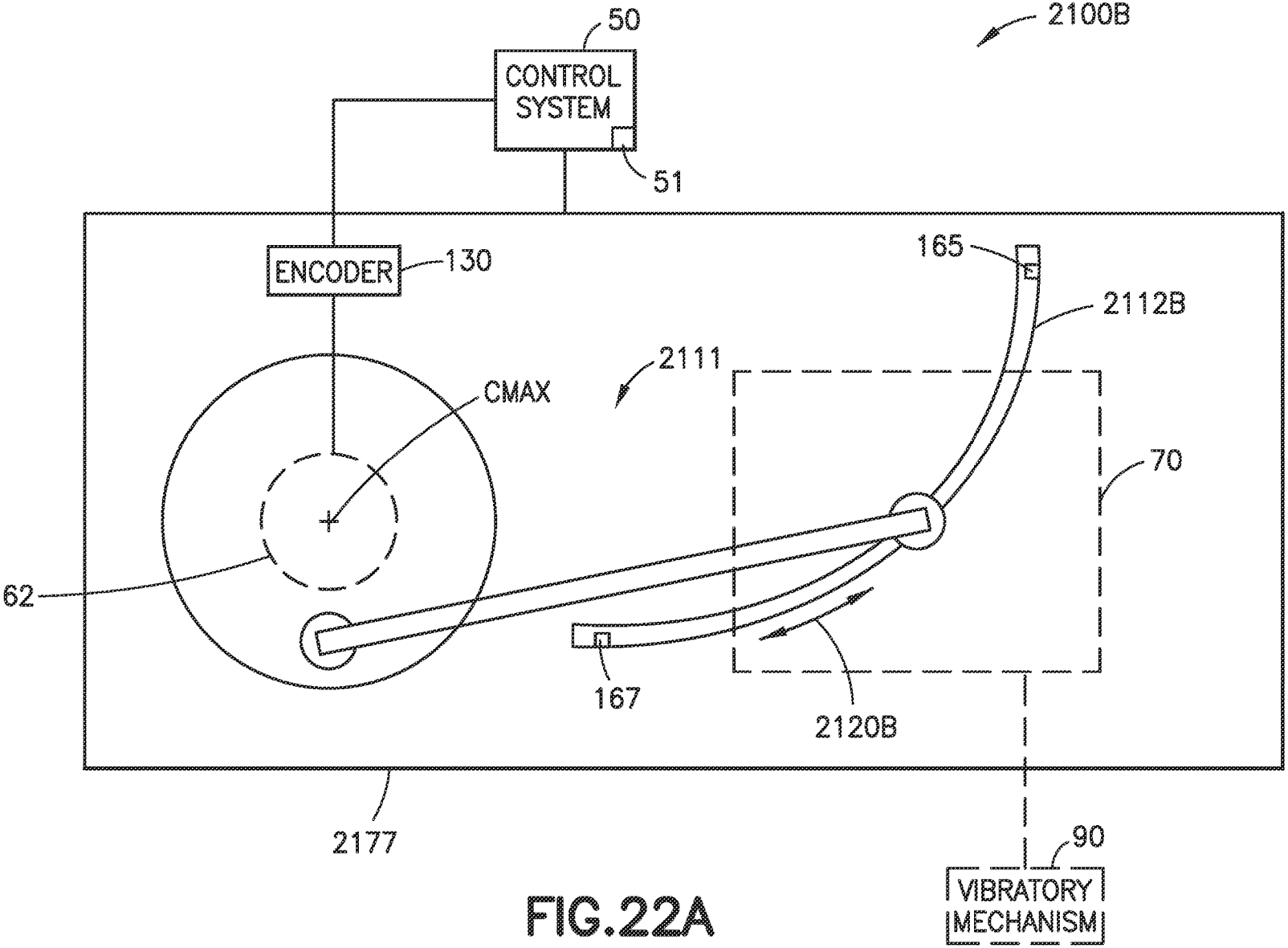
FIG. 22A illustrates a portion of a drive mechanism of the infant care apparatus in accordance with aspects of the disclosed embodiment.

Referring to FIGS. 21A, 22A, the reciprocating motion stages 2100A, 2100B include a base 2177, a rotary actuator (e.g., motor) 62 coupled to the base 2177, a movable platform 70, a crank mechanism 2111, and a track 2112A, 2112B. The track 2112A, 2112B is coupled to the base 2177 and is configured so that the platform 70 moves along and is guided by the track 2112A, 2112B along a predetermined motion path. The crank mechanism 2111 includes a crank member 2111C coupled to an output of the rotary actuator 62 and drive link 2111D. The drive link 2111D has is rotatably coupled at a first end to the crank member 2111C and is rotatably coupled at a second end to the platform 70 (such as at a base 70B of the platform or any other suitable location of the platform 70). Here, the rotary actuator 62 rotates the crank member 62 about a crank member axis of rotation CMAX which effects a reciprocating movement of the platform 70 that is guided by the track 2112A, 2112B and driven by the drive link 2111D. As illustrated in FIGS. 21A and 22A in one aspect the track 2112A is a substantially straight line track that guides the platform 70 in a substantially straight motion 2120A (e.g., that effects a linear motion of the infant support 2); while in other aspects, the track 2112B is a curved track that guides the platform 70 in a substantially curved motion 2120B (e.g., that effects a rotation motion of the infant support 2). The rotary actuators 62 are coupled to the controller 51 in any suitable manner (e.g., wired or wirelessly) so as to be driven in a predetermined manner, as described herein (and in some aspects in coordination with other ones of the multi-actuator motion modules 1600A, 1600B, 1600C and the reciprocating motion stages 2100A, 2100A', 2100A", 2100B, 2100B', 2100B", 2100C) to effect the motion profiles described herein. As described herein, the platform 70 is configured for coupling to another of the multi-actuator motion modules 1600A, 1600B, 1600C and the reciprocating motion stages 2100A, 2100A', 2100A", 2100B, 2100B', 2100B", 2100C or to the infant support 2.

Figure 21B:
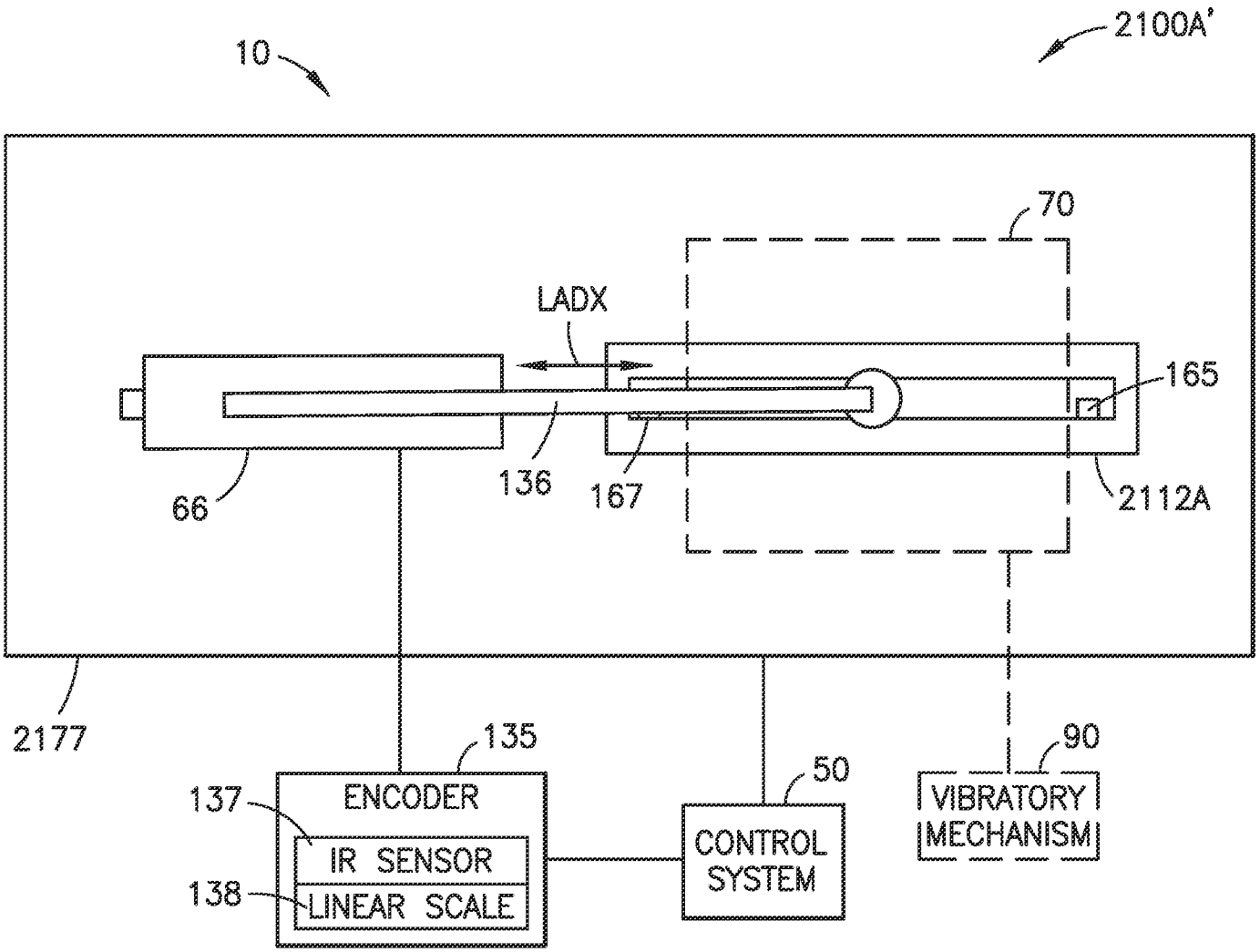
FIG. 21B illustrates a portion of a drive mechanism of the infant care apparatus in accordance with aspects of the disclosed embodiment.
Figure 22B:
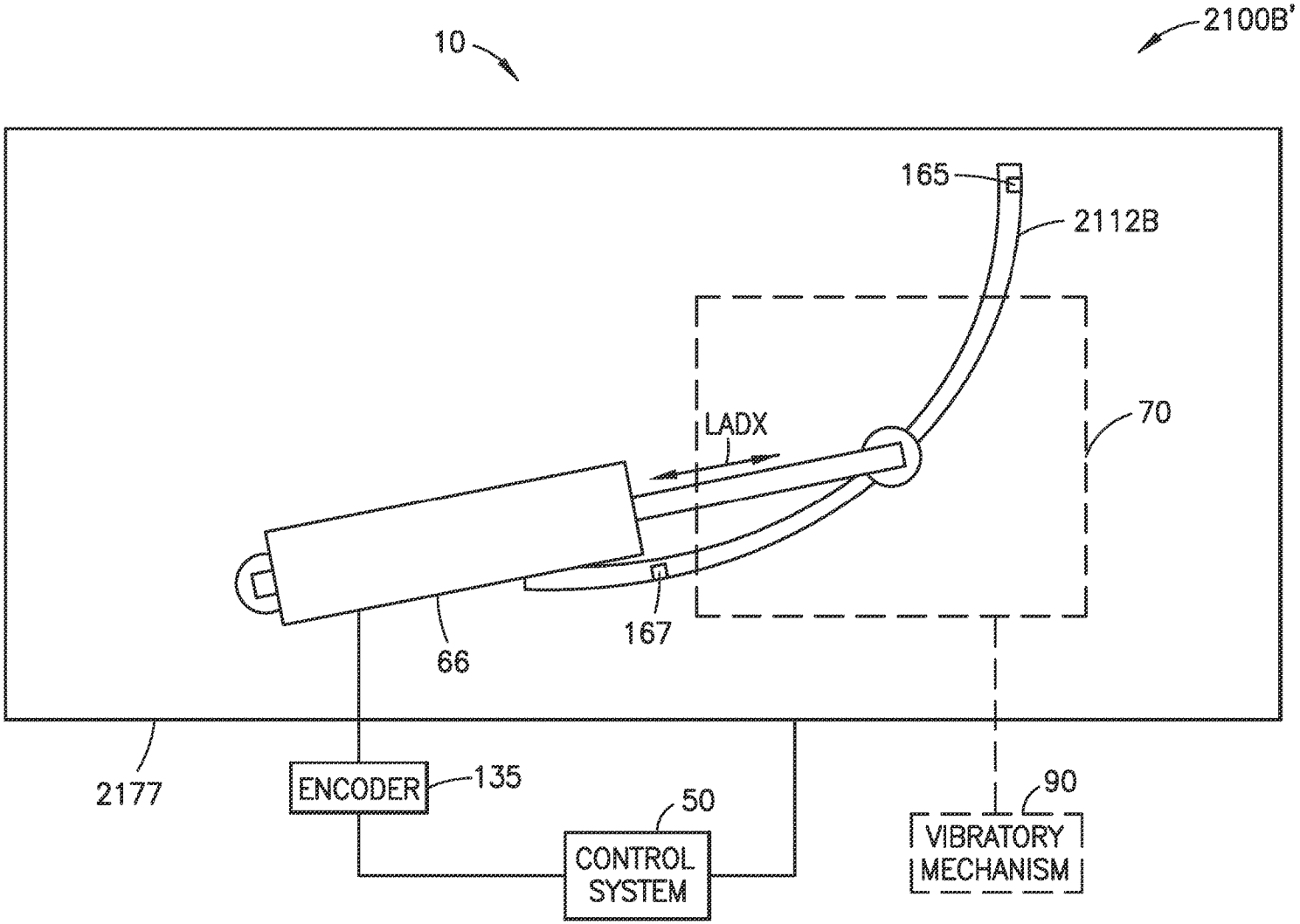
FIG. 22B illustrates a portion of a drive mechanism of the infant care apparatus in accordance with aspects of the disclosed embodiment.

Referring to FIGS. 21B and 22B, the reciprocating stages 2100A', 2100B' are substantially similar to reciprocating motion stages 2100A, 2100B described above; however, in this aspect a linear actuator 66 is coupled at one end to the base 2177 and at the other end to the platform 70. As the linear actuator 66 extends and retracts in direction LADX the extension/retraction of the linear actuator 66 effects a reciprocating motion of the platform 70 along the track 2112A, 2112B along a respective motion path (see, e.g., substantially straight motion 2120A and a substantially curved motion 2120B). The linear actuator 66 is coupled to the controller 51 in any suitable manner (e.g., wired or wirelessly) so as to be driven in a predetermined manner, as described herein (and in some aspects in coordination with other ones of the multi-actuator motion modules 1600A, 1600B, 1600C and the reciprocating motion stages 2100A, 2100A', 2100A", 2100B, 2100B', 2100B", 2100C) to effect the motion profiles described herein.

Figure 21C:
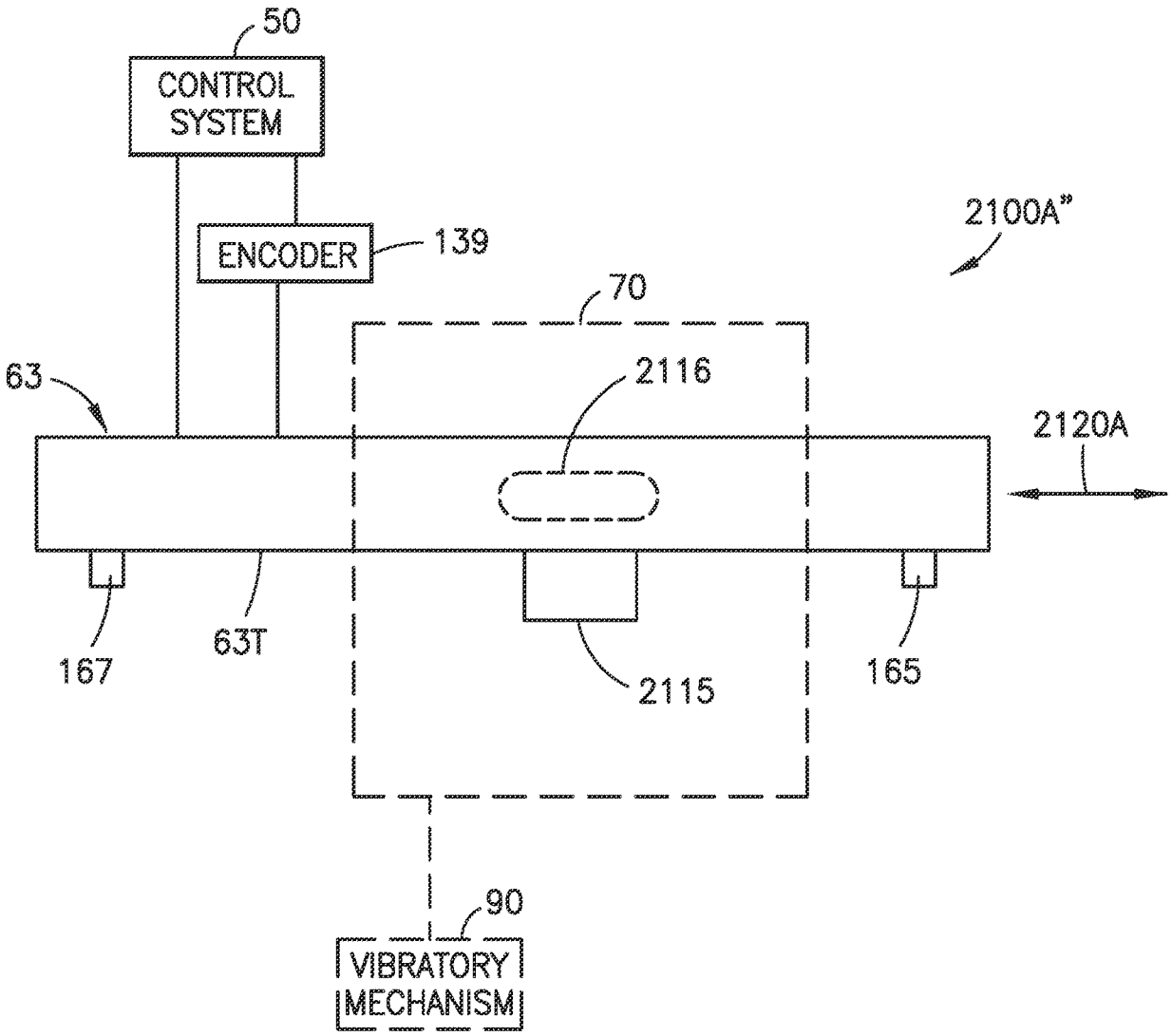
FIG. 21C illustrates a portion of a drive mechanism of the infant care apparatus in accordance with aspects of the disclosed embodiment.
Figure 22C:
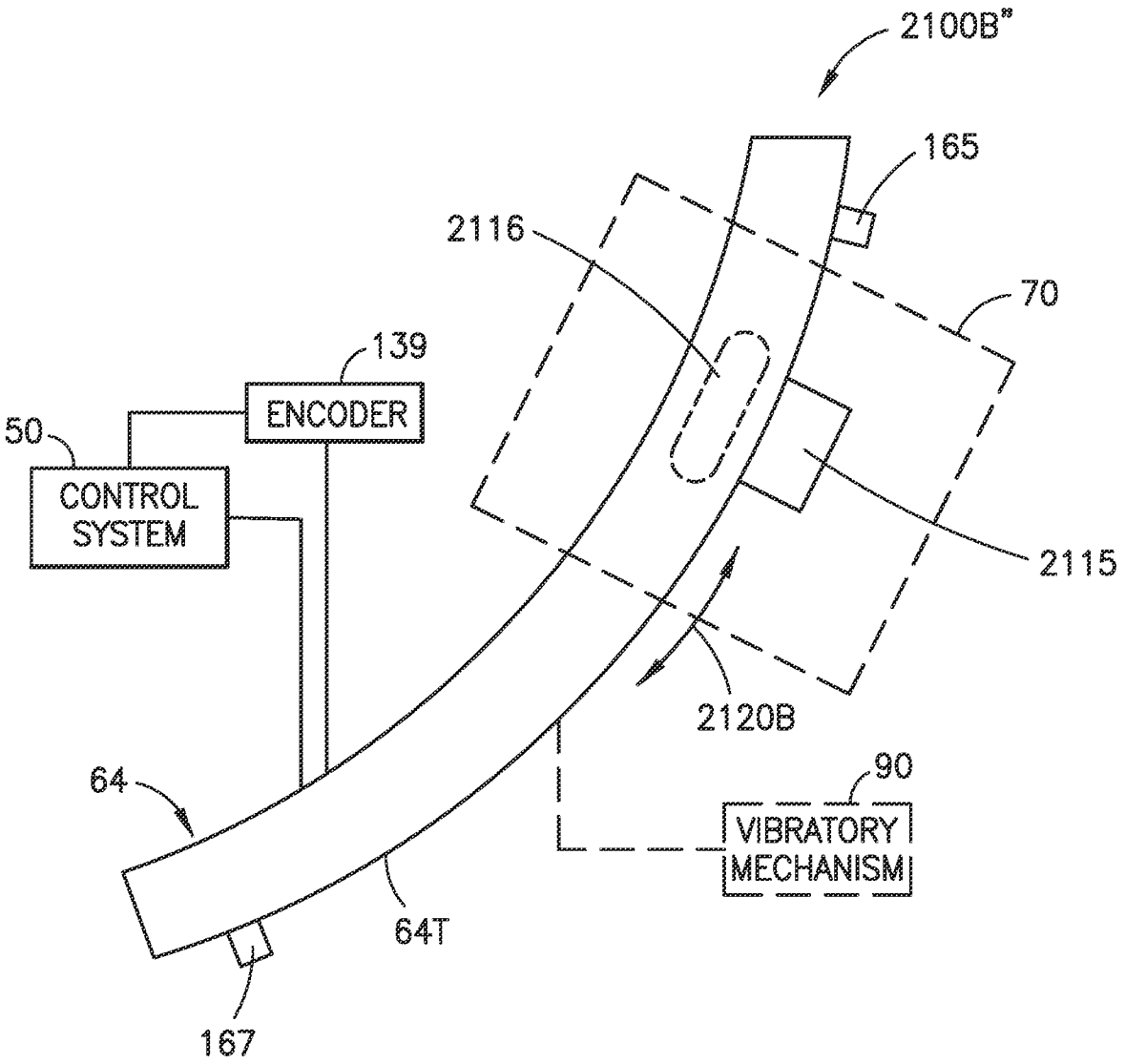
FIG. 22C illustrates a portion of a drive mechanism of the infant care apparatus in accordance with aspects of the disclosed embodiment.

Referring to FIGS. 21C and 22C, the reciprocating stages 2100A", 2100B" are substantially similar to reciprocating motion stages 2100A, 2100B described above; however, in this aspect a linear motor 63, 64 is coupled the base 2177. The linear motor includes a stator 2116, a track 63T, 64T, and a slider 2115 that moves along the track 63T, 64T, under impetus of the stator 2116, along a predetermined path of motion. The platform 70 is coupled to the slider 2115 so that as the slider moves along the track 63T, 64T the platform 70 moves with the slider 2115. In one aspect, the linear motor 63 is a substantially straight linear motor that is configured to move the slider 2115 (and the platform 70) in the substantially straight motion 2120A along the track 63T (e.g., and along a substantially straight motion path); while in other aspects the linear motor 64 is a curved linear motor that is configured to move the slider 2115 (and the platform 70) in the substantially curved motion 2120B along the track 64T e.g., and along a substantially curved motion path). The linear motors 63, 64 are coupled to the controller 51 in any suitable manner (e.g., wired or wirelessly) so as to be driven in a predetermined manner, as described herein (and in some aspects in coordination with other ones of the multi-actuator motion modules 1600A, 1600B, 1600C and the reciprocating motion stages 2100A, 2100A', 2100A", 2100B, 2100B', 2100B", 2100C) to effect the motion profiles described herein.

Referring to FIG. 24, the reciprocating motion stage 2100C includes a bi-directionally driven rotary actuator 62B. Here the platform 70 is coupled (e.g., directly or indirectly through a transmission) to an output of the rotary actuator 62B. The rotary actuator 62B is coupled to the controller 51 in any suitable manner (e.g., wired or wirelessly) so as to be driven in a predetermined oscillating manner about axis CMAX in direction 2444 (and in some aspects in coordination with other ones of the multi-actuator motion modules 1600A, 1600B, 1600C and the reciprocating motion stages 2100A, 2100A', 2100A", 2100B, 2100B', 2100B", 2100C) to effect the motion profiles described herein.

The reciprocating motion stages 2100A, 2100A', 2100A", 2100B, 2100B', 2100B", 2100C described herein may be coupled to the base 3 and/or infant support 2 in either a horizontal orientation (e.g., to provide motion of the infant support 2 in a horizontal plane) or in a substantially vertical orientation (or other suitable orientation that is angled relative to the horizontal plane to provide motion of the infant support 2 out of the horizontal plane—e.g., substantially vertical or any other suitable angle relative to the horizontal plane). For example, referring to FIG. 23, the linear motion stage 2100A', having the linear actuator 66 is coupled to (e.g., locate with) the base 3 or the infant support 2 (although any of the linear motion stages 2100A, 2100A', 2100A", 2100B, 2100B', 2100B", 2100C may be coupled to the base 3 and/or infant support 2 in the substantially vertical orientation illustrated in FIG. 23) so as to move the platform 70 in substantially vertical direction 2377. To reduce the size (e.g., power) of the linear actuator 66, the linear motion stage 2100A' includes a biasing member 2360 configured to reduce a weight (e.g., of the infant support 2 and infant held within the infant support 2) carried by the actuator. For example, the biasing member 2360 may be a compression spring, leaf spring, etc. configured to counter/oppose the weight of the infant support with the infant therein (so that the force provided by the biasing member 2360 is substantially equal to the weight of the infant support 2 with the infant therein) so that the load exerted on the linear actuator 66 is a reduced load (e.g., the linear actuator 66 is not lifting/lowering the full weight of the infant support with infant therein). It is noted that where one or more of the vertically oriented reciprocating motion stage, horizontally oriented reciprocating motion stage, and the multi-actuator motion module are located with the infant support 2, the reciprocating motion stage or multi-actuator motion module (or the most inferior stage or module in the superposed modules) includes a stand or foot (substantially similar to base 2620) that contacts a support surface (e.g., floor, etc.) on which the infant support 2 is to be placed. The foot may also effect coupling of the infant support to the base 3 in the manners described herein. Here the reciprocating motion stage or multi-actuator motion module is configured to provide a stable base of the infant support 2 on the support surface so that the stage or module stably imparts motion on the infant support.

Figure 25C:
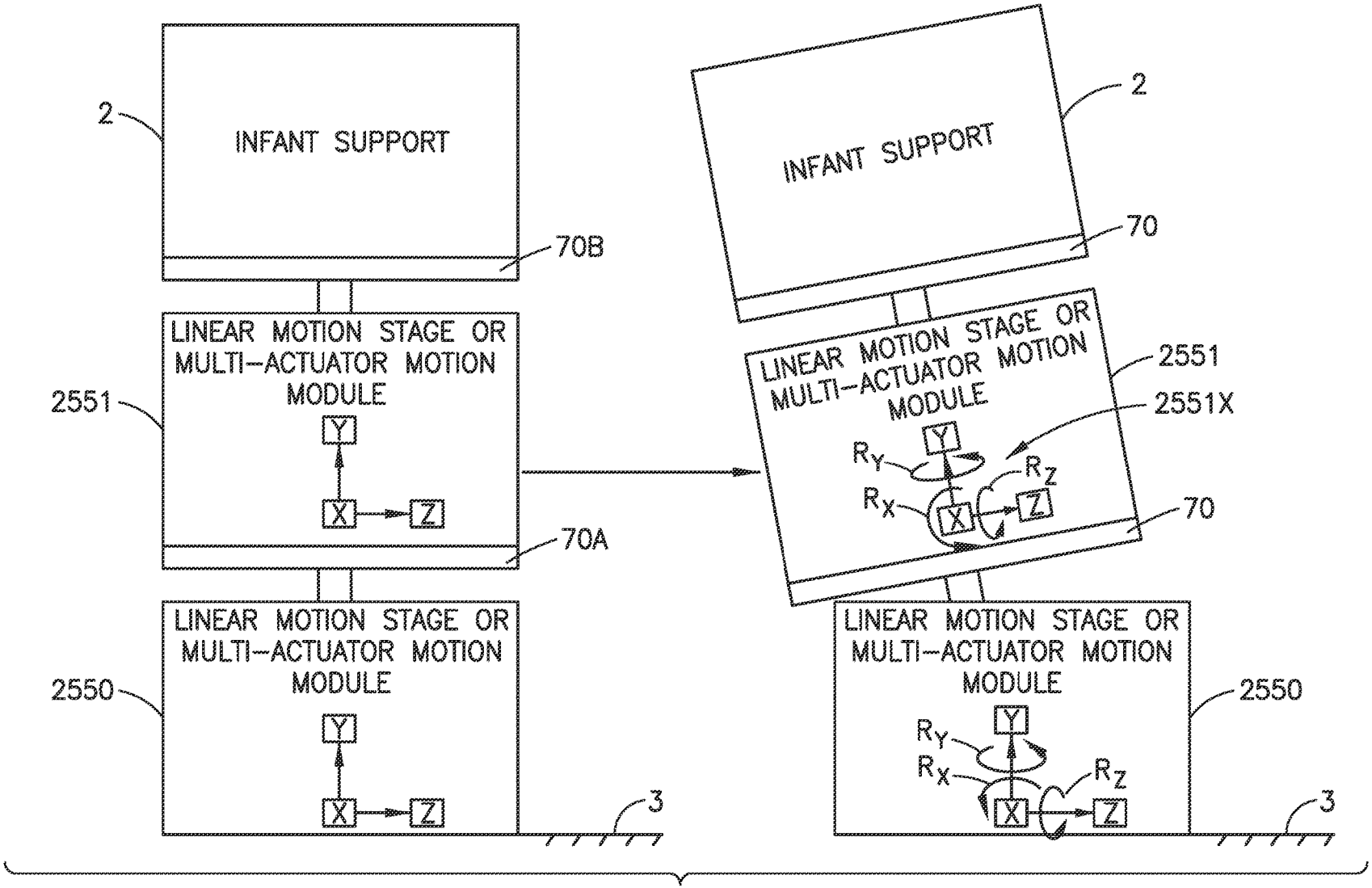
FIG. 25C is an exemplary illustration of relationships between coordinate systems of drive mechanism portions of the infant care apparats in accordance with aspects of the disclosed embodiment.
Figure 26A:
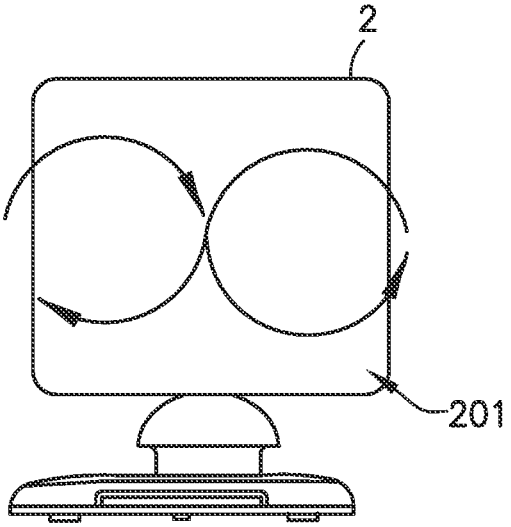
FIGS. 26A-26E are exemplary motion profiles of the infant care apparatus in accordance with aspects of the disclosed embodiments.
Figure 26B:
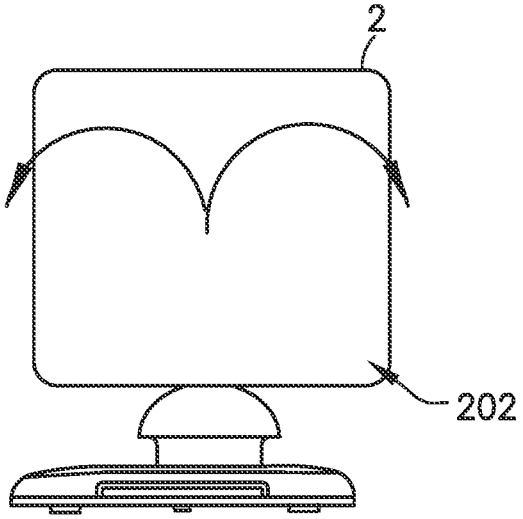
Figure 26C:
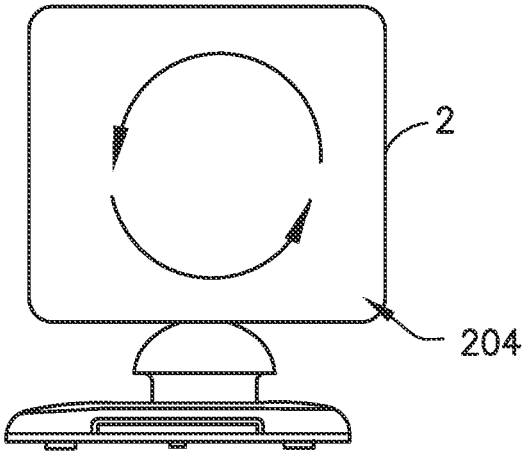
Figure 26D:
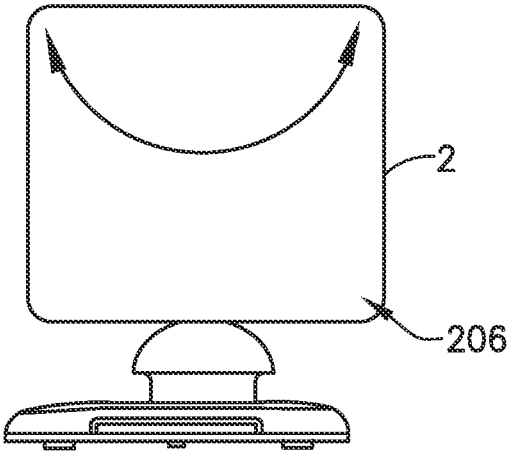
Figure 26E:
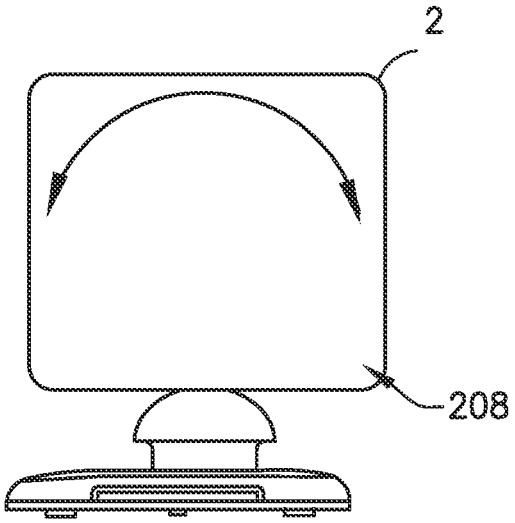

The infant care apparatus 1 described herein includes one or more multi-actuator motion module 1600A, 1600B, 1600C, one or more reciprocating motion stage 2100A, 2100A', 2100B, 2100B', 2100C, or any suitable combination of multi-actuator motion module(s) 1600A, 1600B, 1600C and reciprocating motion stage(s) 2100A, 2100A', 2100B, 2100B', 2100C to effect any suitable motion profile including the motions described herein, such as with respect to FIGS. 25A and 26A-26E. As described herein, one of the multi-actuator motion module 1600A, 1600B, 1600C, or reciprocating motion stage 2100A, 2100A', 2100B, 2100B', 2100C may be superposed on another multi-actuator motion module 1600A, 1600B, 1600C or reciprocating motion stage 2100A, 2100A', 2100B, 2100B', 2100C. Referring also to FIGS. 25C and 25D, the multi-actuator motion module 1600A, 1600B, 1600C and the reciprocating motion stage 2100A, 2100A', 2100B, 2100B', 2100C are generically referred to as motion modules 2550, 2551 such that each motion module 2550, 2551 may be any one of the multi-actuator motion module 1600A, 1600B, 1600C and the reciprocating motion stage 2100A, 2100A', 2100B, 2100B', 2100C. FIG. 25C illustrates the relative movement of the axes of each motion module 2550, 2551 when one motion module 2550, 2251 is superposed on another motion module 2550, 2551. As can be seen in FIG. 25C, and for exemplary purposes only, the motion module 2550 is configured to rotate its respective platform 70 about axis Rx (e.g., rotation about the X axis) (or in other aspects rotate the platform 70 about axis Ry (rotation about the Y axis) or Rz (rotation about the Z axis) or move the platform substantially linear along any of axes X, Y, or Z). The motion module 2551 superposed on motion module 2550 moves with the platform 70 and is also rotated about the X axis of motion module 2550. As the motion module 2551 rotates about the X axis of motion module 2550, the coordinate system 2551X rotates as well so that any movement of the infant support 2 provided by the motion module 2551 is made with respect to the coordinate system 2551X and is superposed on the movement effected by motion module 2550. As also described herein, the motion module 2551 may be carried with the base 3 as part of the first electromechanical driver 2510 or carried with the infant support 2 as part of the second electromechanical driver 2511 (see FIG. 25B). In accordance with the above, FIG. 25A illustrates the different combinations of motions that may be imparted to the infant support by the different combinations of the multi-actuator motion module 1600A, 1600B, 1600C and reciprocating motion stage 2100A, 2100A', 2100B, 2100B', 2100C provided with the infant care apparatus 1. A chart is provided in FIG. 25A that illustrates the one or more motions provided by the distributed drive mechanism 10D (e.g., by one or more of the multi-actuator motion module(s) (denoted by the identifier "MAM") and reciprocating motions stage(s) (denoted by the identifier "STAGE") located in one or more of the base 3 and infant support 2). Lines connect each motion of the base with corresponding combinations of motions of the infant support (and vice versa) where the plane of movement (e.g., for a rotational movement about an axis) or a direction of movement (e.g., for a linear movement along an axis) of the motion are identified in the chart. For example, a rotational movement (indicated by a curved arrow as described herein) in plane X-Z is a rotational movement Rx about the Y axis; and a linear movement (indicated by a straight arrow as described herein) in direction X is a linear movement along the axis X. It is noted that that the rotational movements of the multi-actuator motion modules 1600A, 1600B, 1600C illustrated in FIG. 25A may be the circular/ovoid motions shown in FIGS. 17B, 17C or a reciprocating arcuate motion that spans only a predetermined segment SSG of the circular/ovoid motion shown in FIGS. 17B, 17C.

Referring also to FIGS. 26A-26E, the control system 50 is configured so as to effect movement of the drive mechanism 10 in at least one motion profile in a manner substantially similar to that described in U.S. Pat. No. 10,231,555 issued on Mar. 19, 2019 and U.S. patent application Ser. No. 17/025,674 titled Infant Care Apparatus and filed on Sep. 18, 2020, the disclosures of which were previously incorporated herein by reference in their entireties. The at least one motion profile is/are pre-programmed selectably variable motion profiles, such as, Car Ride 201, Kangaroo 202, Ocean Wave 204, Tree Swing 206, and Rock-A-Bye 208, as examples, and which are generated with one or more (e.g., any suitable combination) of the rotational motions and a linear motions described herein and provided by one or more of the multi-actuator motion module(s) 1600A, 1600B, 1600C and/or reciprocating motion stage(s) 2100A, 2100A', 2100A", 2100B, 2100B', 2100B", 2100C of the first and second electromechanical drivers 2510, 2511. Here, each of the different selectably variable motion profiles includes at least one of horizontal movements, vertical movements, and rotational movements described herein (see, e.g., FIG. 25A). These selectably variable motion profiles are obtained by independently controlling the one or more horizontal movements, vertical movements, and rotational movements provided by the first electromechanical driver 2510 and the second electromechanical driver 2511 and then coordinating the horizontal, vertical and/or rotational movements to obtain visually distinctive motion profiles. However, these motion profiles are for exemplary purposes only and are not to be construed as limiting as any motion profile including horizontal, vertical, and/or rotational motions may be utilized. In one aspect, the different selectably variable motion profiles are deterministically defined by a selectably variable velocity characteristic of at least one of the horizontal, vertical, and/or rotational motions respectively of the first and second electromechanical drivers 2510, 2511, and a selectably variable velocity characteristic of at least one of the horizontal, vertical, and/or rotational motions respectively of the first and second electromechanical drivers 2510, 2511. The controller 51 of the control system 50 is configured to effect selection of the selectably variable motion profile by separate variance of motion characteristics of the separate respective first electromechanical driver 2510 and the second electromechanical driver 2511 (see, e.g., FIG. 1E) of the distributed drive mechanism 10D, with the infant support 2 coupled to the movable infant load seat surface 1690 (see FIG. 1A), from a common selection input to the controller (of the control system 50) selecting the selectably variable motion profile. As described herein, the controller 51 includes a user interface (e.g., such as control panel 52, 52C) configured to receive the common selection input from a user for selecting the selectably variable motion profile.

Referring again to FIGS. 1E, 16A, 17A-17C, 18A, 19A, and 21A-24, in one aspect, the vibratory mechanism 90, is connected to the base 3 and is arranged so as to cooperate with the drive mechanism 60, such as distributed drive mechanism 60D. In another aspect, the vibratory mechanism 90, 90A is coupled to one (or more) of the first and second electromechanical driver 2510, 2511 or any other suitable portion of the infant care apparatus 1, such as to the infant seat 7 as shown in FIG. 1E. In FIG. 1E the vibratory mechanism 90A is integral to one or more of the lower connector 14 and the upper connector 13. The vibratory mechanism 90A is substantially similar to vibratory mechanism 90; however, the vibratory mechanism 90A is coupled to the infant seat 7. In one aspect, the vibratory mechanism 90A includes controls that are separate and distinct from the controller 51. For example, the vibratory mechanism 90A includes any suitable switch 247 (e.g., similar to those switches described herein) that turns the vibratory mechanism 90A on and off. The switch 247, upon repeated presses/touches is also configured to cycle through different modes/patterns of vibration. In other aspects, the vibratory mechanism 90A (with or without the switch 247) is remotely coupled to the controller 51 through suitable wired or wireless connections so that the vibratory mechanism 90A is controlled through, for example, the control panel 52. Where a wired coupling is employed to couple the vibratory mechanism 90A to the controller 51, any suitable electrical couplings 248 are provided on the articulated span member 266 and base 3 that couple to each other (e.g., to provide communication between the vibratory mechanism 90A and the controller 51) when the infant seat 7 is coupled to the base 3 and decouple from each other when the infant seat 7 is decoupled from the base 3.

In the aspects shown in Figs. the vibratory mechanism 90 is mounted to a platform 70 or module base 1601 of one (or more) of the first and second electromechanical drivers 2510, 2511. The vibratory mechanism 90 is positioned to reduce vibratory impulse imparted to the actuators/motors of the first and second electromechanical drivers 2510, 2511. The vibratory mechanism 90 includes a vibration motor 91 separate and distinct from the actuators/motors of the first and second electromechanical drivers 2510, 2511. The vibration motor 91 is configured so as to vibrate a respective one of the first and second electromechanical driver 2510, 2511. The vibration motor 91 may be any suitable vibration mechanism, such as, a motor with an eccentric weight on the output shaft that rotates about the output shaft to effect vibration. In other aspects, the vibration motor may be any suitable oscillating linear motor or rotary motor. The vibration motor 91 effects vibration in different patterns and intensity so as to form vibration modes which may be selectably imparted on the respective first and second electromechanical driver 2510, 2511 as will be discussed in greater detail hereinafter. In one aspect, the vibration profile is superposed over the horizontal, vertical, and/or rotational motions of the first and/or second electromechanical driver 2510, 2511. For example, the vibratory mechanism 90 may be mounted to any of the multi-actuator motion module(s) 1600A, 1600B, 1600C and/or reciprocating motion stage(s) 2100A, 2100A', 2100A", 2100B, 2100B', 2100B", 2100C of the first and second electromechanical drivers 2510, 2511 of the first and second electromechanical drivers 2510, 2511, e.g., such as to platform(s) 70 and/or module base(s) 1601, to effect a desired vibration superposition. Alternatively, the vibratory mechanism 90 may be mounted to any of the respective driven portions of the first and second electromechanical drivers 2510, 2511. The portion of the multi-actuator motion module(s) 1600A, 1600B, 1600C and/or reciprocating motion stage(s) 2100A, 2100A', 2100A", 2100B, 2100B', 2100B", 2100C to which the vibratory mechanism 90 is attached may be selected freely from concern regarding coupling effecting respective reciprocal motions generated by the corresponding first and second electromechanical drivers 2510, 2511.

Figure 1F:
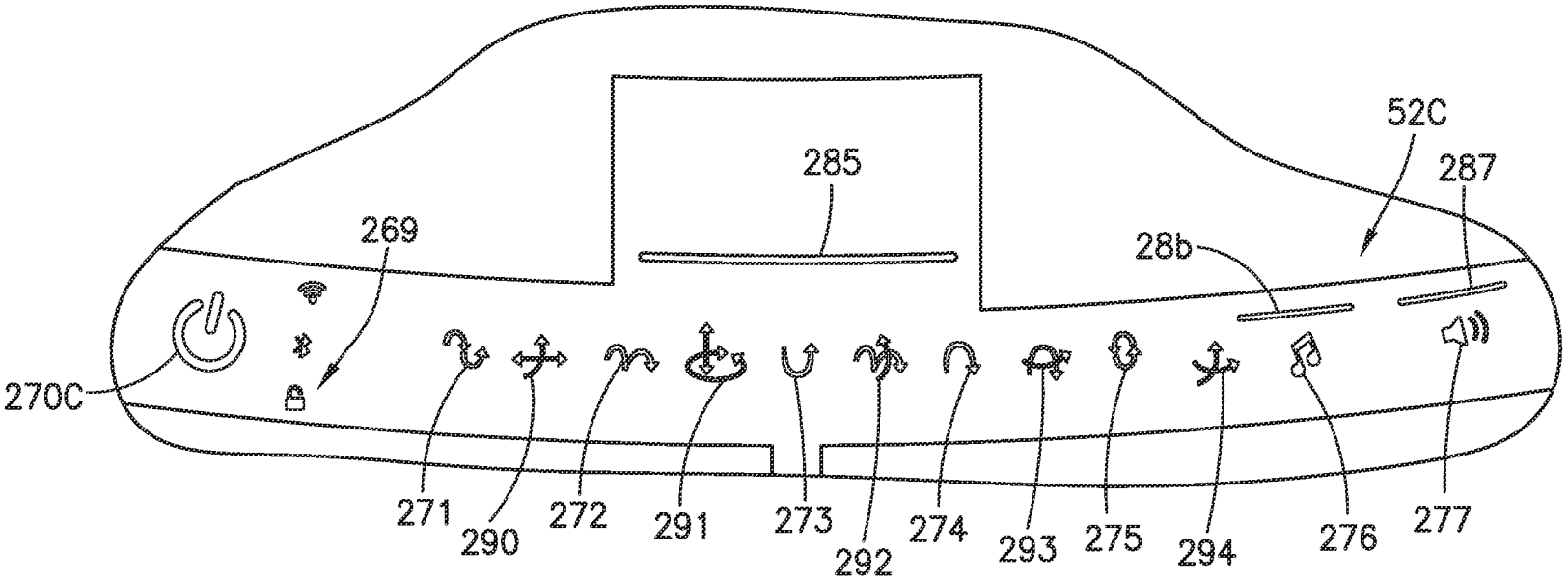
FIG. 1F is a schematic illustration of a portion of the infant care apparatus of FIGS. 1B and 1C in accordance with aspects of the disclosed embodiment.

With reference to FIGS. 1 and 1F, the control system 50 may be mounted in the base 3 and provided to effect the different selectably variable motion profiles imparted, by the drive mechanism 10, such as distributed drive mechanism 10D, and to effect, via the vibratory mechanism 90, the various vibration modes for each of the different variable motion profiles. The control system 50 includes any suitable controller 51, such as a microprocessor, a rheostat, a potentiometer, or any other suitable control mechanism to control movement of the drive mechanism 10. As noted above, the controller 51 is communicably coupled to the drive mechanism 10 and the vibratory mechanism 90 (and in one or more aspects coupled to vibratory mechanism 90A). The controller 51 is configured so as to effect movement of the infant support 2 in the selectably variable motion profiles with selectable vibration modes selected, with the controller 51, from different selectably variable motion profiles and selectably different vibration modes for each of the different selectable variable motion profiles. For example, the controller 51 is communicably coupled to the distributed drive mechanism 10D and is configured so as to move, via at least the first electromechanical driver 2510 and at least the second electromechanical driver 2511, the infant support 2 coupled to the movable infant load seat surface 1690 relative to the base 3. The distributed drive mechanism 10D is distributed from the base 3 and onto the infant support 2. The distributed drive mechanism 10D has the first electromechanical driver 2510 coupled to the base 3, the first electromechanical driver 2510 defining the first degree of freedom forming a first axis of (a linear or a rotational) motion between the base 3 and the infant support 2. The distributed drive mechanism 10D has the second electromechanical driver 2511 mounted to the infant support 2, and coupled to the base 3 with coupling of the infant support to the infant load seat surface 1690. The second electromechanical driver 2511 is separate and distinct from the first electromechanical driver 2511, and defines the second degree of freedom (independent of the first DOF) forming the second axis of (a linear or a rotational) motion of the infant support 2.

The controller 51 is configured so as to move the infant support 2 relative to the base 3, via the first electromechanical driver 2510 and the second electromechanical driver 2511, coupled to the movable infant load seat surface 1690. The controller 51 is configured so as to move the infant support 2 with separate impetus separately imparted to the infant support 2 by a first linear or rotational motion determined by the first axis of motion of the first degree of freedom (e.g., of the first electromechanical driver 2510), and by a second linear or rotational motion determined by the second axis of motion, of the second degree of freedom (e.g., of the second electromechanical driver 2511), with a selectably variable motion profile (see FIGS. 17A-17C, 25A, and 26A-26E—noting that any one or more of the motion profiles illustrated in FIGS. 17A-17C and 25A can be superposed over the motion profiles illustrated in FIGS. 26A-26E or vice versa and selected from the control panel 52, 52C so that the combined movement is selected with the common selection input (i.e., a single press/actuation of the corresponding motion switch) selected with the controller from different selectably variable motion profiles.

The control system 50 may further include a control panel for viewing and controlling speed and motion of the drive mechanism 10, one or more control switches or knobs (as described herein) for causing actuation of the drive mechanism 10, and a variety of inputs and outputs operatively coupled to the controller 51. For example, the controller 51 of the control system 50 is configured to determine a position of the infant support 2 based at least in part on information from one of more sensors (e.g., described herein) of the distributed drive mechanism 10D. The control system 50 may include one or more encoder 130 (FIGS. 21A, 22A) coupled to an output shaft of a (rotary) motor 62, 62B of a respective one of the reciprocating motion stage 2100A, 2100B, 2100C. The encoder 130 may include an infrared (IR) sensor 132 and a disk 133 with a single hole or slot positioned thereon (see FIGS. 21A, 22A, and 24). The encoder 130 is configured so that the controller 51 may determine the speed and number of revolutions of the motor 62. Where linear actuators 66 or motors 63, 64 are employed in a reciprocating motion stage 2100A', 2100A", 2100B', 2100B", encoder 135 (FIGS. 21B, 22B) may be provided and coupled to a shaft 136 of the linear actuator 66. The encoder 135, 136 may include an IR sensor 137 and a linear scale 138 positioned thereon. The encoder 135 is configured so that the controller 51 may determine the speed and number of reciprocations (or extension/retraction displacement) of the linear actuator 66. Position of the vibratory mechanism 90 may be selected as previously described so as to avoid generating noise to the position signal of the encoders 130, 135. Where linear motors 63, 64 are employed in a reciprocating motion stage 2100A", 2100B", encoder 139 (FIGS. 21C, 22C, which may be substantially similar to encoder 135) may be provided to detect/sense a position of a slider 2115 of the linear motor 63, 64, where the platform 70 is coupled to the slider 2115. The encoder 139 may be any suitable encoder such as optical, capacitive, and magnetic encoders. For example, encoder 139 may be provided and coupled to one or more of the track and 63T, 64T and slider 2115 of the linear motor 63, 34. The encoder 139 may include an IR sensor 137 and a linear scale 138 positioned thereon. The encoder 139 is configured so that the controller 51 may determine the speed and number of reciprocations (or displacement of the slider along the track) of the linear motor 63, 64.

In addition, while the encoders 130, 135, 139 were described hereinabove, this is not to be construed as limiting to magnetic encoders, as other types of encoders well known in the art may also be used. It may also be desirable to provide an arrangement in which two or more control switches associated with respective motors are required to both be actuated to effect speed control in the desired direction. Furthermore, while it was described that the encoder 130 only includes a single slot and that the encoder 135, 139 include a linear scale, this is not to be construed as limiting as encoders with a plurality of slots or a variety of scales may be utilized.

In one aspect, the control system 50 may further include horizontal and vertical limit switches 165, 167 (FIG. 14) to provide inputs to the controller 51. For example, the horizontal and vertical limit switches 165, 167 may be configured to indicate to the controller 51 that the respective platform 70 (e.g., to which another motion stage 2100A, 2100A', 2100B, 2100B', 2100C, a multi-actuator motion module 1600A, 1600B, 1600C, and/or the infant support 2 is coupled) has reached an end point of travel. The limit switches 165, 167 are configured so that the control system 50 may determine an initial position of drive mechanism 10 and to adjust the drive mechanism 10 accordingly. In one aspect, the limit switches 165, 167 may be optical switches or any other suitable switches. Position of the vibratory mechanism may be selected as previously described so as to avoid generating noise to the position signal of the limit switches 165, 167 (prevents errors overdriving motors).

Referring also to FIGS. 20A-20D, while the motion tracking of the reciprocating motion stages 2100A, 2100A', 2100A", 2100B, 2100B', 2100B", 2100C by the control system 50 have been described above, the movement actuators of the multi-actuator motion modules 1600A, 160B, 1600B is similarly tracked with encoders 130, 135, 139 and/or with limit switches (in a manner similar to that described above) by the control system 50 to effect the motion profiles described herein. In manner similar to that described above, in one or more aspects, the controller 51 is configured to determine an amount (e.g., distance) of actuation of the movement actuators to effect the reciprocating linear, reciprocating circular/ovoid segment, and/or circular/ovoid movements described herein.

The control panel 52 may also have display 53 to provide information to the user, such as, for example, motion profiles, volume of music being played through speakers 56, and speed of the reciprocation motion, etc. In one aspect, the control panel 52 may be a touch screen control panel, a capacitive control panel 52C (see FIG. 1F), or any suitable user interface configured to receive the common selection input from a user for selecting the different selectably variable motion profiles. Control switches (which may be capacitive switches 270-277, areas of a touch screen, toggle switches, buttons, etc.) may include user input switches such as a main power, a start/stop button 270, a motion increment button 278U, a motion decrement button 278D, a speed increment button 279U, a speed decrement button 279D, and the like. FIGS. 1B, 1C, and 1F illustrate aspects of the infant care apparatus 1 including an exemplary capacitive control panel 52C that includes a power switch 270C, motion switches 271-275, 290-294 (which correspond to the exemplary motion profiles described herein—noting that all motion profile combinations effected by the aspects of the disclosed embodiment are not illustrated by the motion switches such that the motion switches shown are exemplary only and there may be any number of motion switches that correspond with any corresponding number of the motion profile combinations described herein), a sound on/off switch 276, and a volume switch 277; however, it should be realized that in other aspects the capacitive control panel 52C may include any suitable function switches such as those noted above. The control panel 52, 52C can also include any suitable status lights/indicia 285-287 that are configured to indicate a status of the child care apparatus 1. For example, light 285 is configured to indicate a power status (i.e., on/off) of the child care apparatus 1. The light 286 is configured to indicate whether the sound is on or off and the light 287 is configured to indicate a volume level of the sound. The control panel 52, 52C can also include any other suitable lights indicia as noted herein. The controller 51 of the control system 50 may also include a variety of outputs. These outputs include, but are not limited to a Pulse Width Modulation (PWM) motors/actuators of the first and second electromechanical drivers 2510, 2511, and a display backlight.

In one or more aspects, the control system 50 is configured with any suitable "smart" connectivity features that provide for remote control of the infant care apparatus with smart home accessories/devices. For example, the control system 50 includes Wi-Fi connectivity and is configured with, for example, Alexa connectivity (available from Amazon.com, Inc.) and/or Google Assistant™ connectivity (available from Google LLC) so that the functions of the infant care apparatus 1 described herein are remotely operable through the Wi-Fi connectivity. The control system 50 includes any suitable short distance wireless communication, such as Bluetooth®, that enables audio streaming from a remote fungible device (e.g., cell phone, tablet, laptop computer, etc.) to the infant care device 1 for broadcast through the speakers 56. It is noted that the control system 50 is configured for, through the short distance wireless communication, remote control of the infant care apparatus 1 through the remote fungible device so that the functions of the infant care apparatus 1 described herein are remotely operable through remote fungible device.

The control system 50 is also configured with operational interlocks that prevent movement of the infant seat 7 such as when the cam lever 2878 is not locked (i.e., rotated fully to a predetermined stopping location in direction R27) and/or when the infant seat 7 is not seated on the base 3. For example, referring to FIGS. 14C, 15A and 15B at least one sensor (e.g., seat lock sensor(s)) 2866, 2869 is provided on the infant support receiver coupling 200C (or any suitable location on the base 3) to detect/sense a position of the cam lever 2878 and/or slider 2877, 2877A. For example, a sensor 2866 can be positioned on the housing cover 280C and/or skirt 280S so as to detect a position of the handle 2878H relative to the sensor 2866. For example, the sensor 2866 can be a proximity sensor, optical sensor, or other suitable sensor that detects the handle 2878H when in the locked position (e.g., rotated fully to a predetermined stopping location in direction R27). A sensor 2869 (similar to sensor 2866) can be located within the infant support receiver coupling 200C so as to detect the slider 2877 (and/or slider 2877A) when in the locked position (see FIG. 15C) or when in the unlocked position (see FIG. 15B). A sensor 2867 (similar to sensor 2866) can be located on the complimentary mating surface 200CS so as to detect the presence of the mating surface 2620B (i.e., detect the presence of the infant seat 7 on the base 3). A sensor 2868 (similar to sensor 2866) can be located on the housing cover 280C to detect the presence of the side 2620A of the base 2620. The sensors 2866, 2867, 2868, 2869 are configured to send signals, embodying information regarding the presence or absence of the infant seat on the base 3 and/or whether the cam lever 2878 (or sliders 2877, 2877A) are in the locked position, to the controller 51 where the controller 51 effects operation of the infant care apparatus 1 based on the sensor signals or prevents operation of the infant case apparatus based on the sensor signals.

The sensors (at least one sensor for detecting the state of the cam lever 2878 and at least one sensor for detecting the state of the infant seat 7 on the base 3) provide for detection of the following usage states: (1) infant seat 7 on the base 3 but unlocked, (2) the infant seat 7 on the base 3 and locked, (3) the infant seat 7 off the base 3 and unlocked, and (4) the infant seat 7 off the base and locked. For example, where the controller 51 determines the sensor signals indicate usage states 1, 3, and 4, the controller 51 prevents operation of the infant care apparatus 1 and causes an error or locked indicia/message to be presented on the control panel 52 (see the illumination of a lock indicia 269 on the control panel 52 in FIG. 1F). Where the controller 51 determines the sensor signals indicate usage state 2, the controller provides for operation of the infant care apparatus 1. In one or more aspects, where the infant seat 7 is not detected on the base 3 but the cam lever 2878 (and sliders) are detected in the locked position the lock indicia 269 may not be illuminated.

Figure 27:
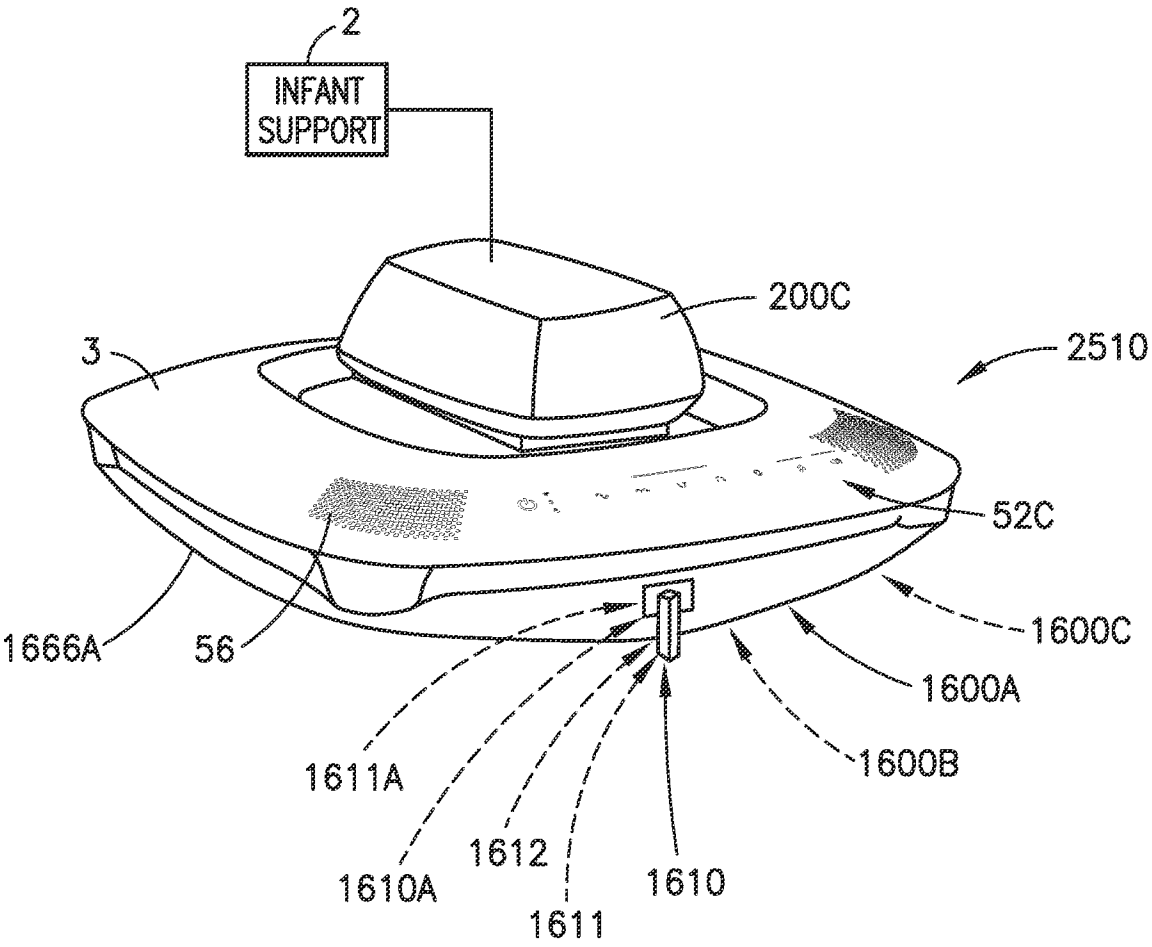
FIG. 27 is an exemplary illustration of a base of the infant care apparatus in accordance with aspects of the disclosed embodiment.

Referring to FIG. 27, the multi-actuator motion module 1600A, 1600B, 1600C may be integrally formed with support housing 4 of the base 3. Here the support housing 4 includes an integral hemispherical shape or hemi-spheroid shape 1666A (substantially similar to hemispherical shape or hemi-spheroid shape 1666 described above) to which the actuators 1610-1612 are coupled (in the manner described above with respect to module base 1601). In this aspect, any suitable number of additional multi-actuator motion module (s) 1600A, 1600B, 1600C and/or reciprocating motion stage (s) 2100A, 2100A', 2100A", 2100B, 2100B', 2100B", 2100C may be coupled to the base 3 so as to form with the integrally formed multi-actuator motion module of the base 3 the first electromechanical driver 2510. The infant support 2, with the second electromechanical driver 2511 is coupled to the base 3 in the manner described herein so that the controller 51 controls the first electromechanical driver 2510 and the second electromechanical driver 2511 as described herein to effect the motion profiles of the infant care apparatus 1 described herein. While the actuator configuration of the base 3 shown in FIG. 27 is substantially similar to that illustrated in FIGS. 16A-17C, in other aspects, the base and actuator configuration may be substantially similar to those illustrated in FIGS. 18A-18B or FIGS. 19A-19B.

Referring to FIGS. 1A-1F and 28 an exemplary method will be described in accordance with aspects of the disclosed embodiment. A base 3 is provided (FIG. 28, Block 28100), where the base 3 has a drive mechanism 10 coupled to the base 3. The drive mechanism 10 has a first electromechanical driver 2510 defining the first degree of freedom forming the first axis of (a linear or a rotational) motion (as described herein) of the movable infant load seat surface 1690 dependent from and movable relative to the base 3. An infant support 2 is provided (FIG. 28, Block 28110) where the infant support 2 is configured so as to be removably coupled to the movable infant load seat surface 1690. The drive mechanism 10 is a distributed drive mechanism 10D distributed to the base 3 and the infant support 2, wherein the distributed drive mechanism 10D includes a second electromechanical driver 2511 integral with the infant support 2. The second electromechanical driver 2511 is separate and distinct from the first electromechanical driver 2510, and defines the second degree of freedom (independent of the first degree of freedom) forming a second axis of (a linear or a rotational) motion of the infant support 2. The infant support 2 (e.g., coupled to the movable infant load seat surface 1690) is moved relative to the base (FIG. 28, Block 28120), with the controller 51 communicably coupled to the distributed drive mechanism 10D, via the first electromechanical driver and the second electromechanical driver.

Still referring to FIGS. 1A-1F and 28 another exemplary method will be described in accordance with aspects of the disclosed embodiment. A base 3 is provided (FIG. 28, Block 28100) having a drive mechanism 10, coupled to the base 3, that has a first electromechanical driver 2510 defining the first degree of freedom forming a first axis of (a linear or a rotational) motion (as described herein) of the movable infant load seat surface 1690 dependent from and movable relative to the base 3. An infant support 2 is provided (FIG. 28, Block 28110) where the infant support 2 is configured so as to be removably coupled to the movable infant load seat surface 1690. The drive mechanism 10 is a distributed drive mechanism 10D distributed to the base 3 and the infant support 2, wherein the distributed drive mechanism 10D includes a second electromechanical driver 2511 integral with the infant support 2. The second electromechanical driver 2511 is separate and distinct from the first electromechanical driver 2510, and defining a second degree of freedom (independent of the first degree of freedom) forming a second axis of (a linear or a rotational) motion of the infant support 2. The infant support 2 is moved relative to the base (FIG. 28, Block 28120), with the controller 51 communicably coupled to the distributed drive mechanism, via the first electromechanical driver 2510 and the second electromechanical driver 2511, coupled to the movable infant load seat surface 1690.

Figure 29:
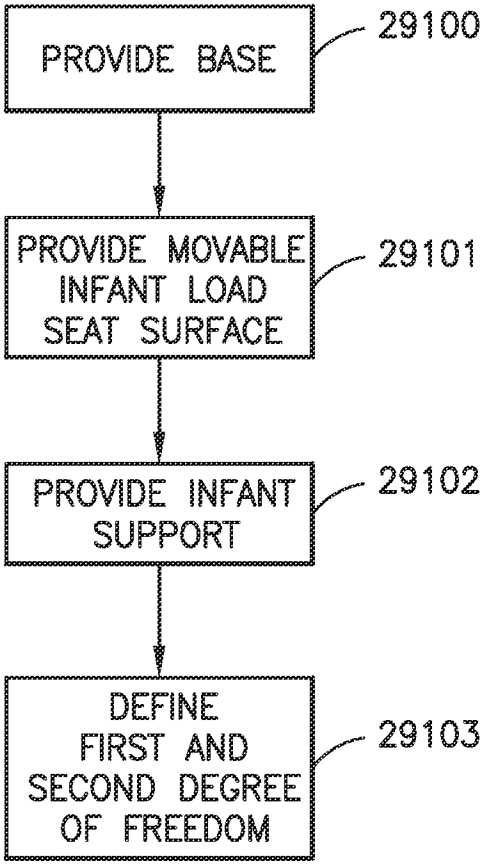
FIG. 29 is a flow diagram of an exemplary method in accordance with aspects of the disclosed embodiment.
Figure 28:
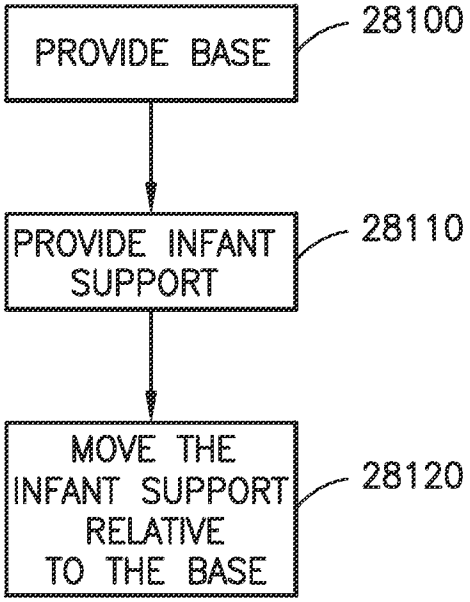
FIG. 28 is a flow diagram of an exemplary method in accordance with aspects of the disclosed embodiment.

Referring to FIGS. 1A-1F and 29, an exemplary method will be described in accordance with aspects of the disclosed embodiment. A base 3 is provided (FIG. 29, Block 29100). A movable infant load seat surface 1690 dependent from and movable relative to the base 3 is provided (FIG. 29, Block 29101). An infant support 2 is provided (FIG. 29, Block 29102) and is configured so as to be removably coupled to the infant load seat surface 1690. A first and second degree of freedom are defined (FIG. 29, Block 29103), with a distributed drive mechanism 10D distributed from the base 3 and onto the infant support 2. The first degree of freedom forms a first axis of (a linear or a rotational) motion of the infant support 2 and the second degree of freedom forms a second axis of (a linear or rotational) motion of the infant support 2. The distributed drive mechanism 10D has a first electromechanical driver 2510 coupled to the base 3. The first electromechanical driver 2510 defines the first degree of freedom forming the first axis of motion between the base 3 and the infant support 2. The distributed drive mechanism 10D has a second electromechanical driver 2511 mounted to the infant support 2, and coupled to the base 3 with coupling of the infant support to the infant load seat surface 1690. The second electromechanical driver 2511 being separate and distinct from the first electromechanical driver 2510, and defining the second degree of freedom forming the second axis of (a linear or a rotation) motion of the infant support 2.

In accordance with one or more aspects of the disclosed embodiment an infant care apparatus comprises: a base; a drive mechanism, coupled to the base, that has a first electromechanical driver defining a first degree of freedom forming a first axis of motion of a movable infant load seat surface dependent from and movable relative to the base; an infant support configured so as to be removably coupled to the infant load seat surface; wherein the drive mechanism is a distributed drive mechanism distributed to the base and the infant support, wherein the distributed drive mechanism includes a second electromechanical driver integral with the infant support, the second electromechanical driver being separate and distinct from the first electromechanical driver, and defining a second degree of freedom forming a second axis of motion of the infant support; and a controller communicably coupled to the distributed drive mechanism and configured so as to move, via the first electromechanical driver and the second electromechanical driver, the infant support coupled to the movable infant load seat surface relative to the base.

In accordance with one or more aspects of the disclosed embodiment, the controller is configured so as to move the infant support with separate impetus separately imparted to the infant support by a first motion determined by the first axis of motion, of the first degree of freedom, and by a second motion determined by the second axis of motion, of the second degree of freedom, with a selectably variable motion profile selected with the controller from different selectably variable motion profiles.

In accordance with one or more aspects of the disclosed embodiment, the controller is configured to effect selection of the selectably variable motion profile by separate variance of motion characteristics of the separate respective first electromechanical driver and the second electromechanical driver of the distributed drive mechanism, with the infant support coupled to the movable infant load seat surface, from a common selection input to the controller selecting the selectably variable motion profile.

In accordance with one or more aspects of the disclosed embodiment, the controller includes a user interface configured to receive a common selection input from a user for selecting the selectably variable motion profile.

In accordance with one or more aspects of the disclosed embodiment, each of the different selectably variable motion profiles includes at least one of horizontal movements, vertical movements, and rotational movements.

In accordance with one or more aspects of the disclosed embodiment, one or more of the first electromechanical driver and the second electromechanical driver is at least one of a rotatory motor, a linear motor, and a linear actuator.

In accordance with one or more aspects of the disclosed embodiment, the movable infant load seat surface is a curved surface with an apex mated against a substantially planar mating base surface of the base, the movable infant load seat surface being disposed so that the apex moves relative to the base under impetus imparted to the movable infant load seat surface by a first motion determined by the first axis of motion.

In accordance with one or more aspects of the disclosed embodiment, the first electromechanical driver includes more than one separate and distinct electromechanical driver, each of the more than one separate and distinct electromechanical driver being separate and distinct from each other, and defines an independent degree of freedom forming an independent axis of motion, so that the first electromechanical driver defines two or more independent degrees of freedom.

In accordance with one or more aspects of the disclosed embodiment, the controller is mounted within the base.

In accordance with one or more aspects of the disclosed embodiment, the controller determines position of the infant support based at least in part on information from one or more sensors distributed drive mechanism.

In accordance with one or more aspects of the disclosed embodiment, an infant care apparatus comprises: a base; a drive mechanism, coupled to the base, that has a first electromechanical driver defining a first degree of freedom forming a first axis of motion of a movable infant load seat surface dependent from and movable relative to the base; an infant support configured so as to be removably coupled to the movable infant load seat surface; wherein the drive mechanism is a distributed drive mechanism distributed to the base and the infant support, wherein the distributed drive mechanism includes a second electromechanical driver integral with the infant support, the second electromechanical driver being separate and distinct from the first electromechanical driver, and defining a second degree of freedom forming a second axis of motion of the infant support; and a controller communicably coupled to the distributed drive mechanism and configured so as to move the infant support relative to the base, via the first electromechanical driver and the second electromechanical driver, coupled to the movable infant load seat surface.

In accordance with one or more aspects of the disclosed embodiment, the controller is configured so as to move the infant support with separate impetus separately imparted to the infant support by a first motion determined by the first axis of motion, of the first degree of freedom, and by a second motion determined by the second axis of motion, of the second degree of freedom, with a selectably variable motion profile selected with the controller from different selectably variable motion profiles.

In accordance with one or more aspects of the disclosed embodiment, the controller is configured to effect selection of the selectably variable motion profile by separate variance of motion characteristics of the separate respective first electromechanical driver and the second electromechanical driver of the distributed drive mechanism, with the infant support coupled to the movable infant load seat surface, from a common selection input to the controller selecting the selectably variable motion profile.

In accordance with one or more aspects of the disclosed embodiment, the controller includes a user interface configured to receive a common selection input from a user for selecting the selectably variable motion profile.

In accordance with one or more aspects of the disclosed embodiment, each of the different selectably variable motion profiles includes at least one of horizontal movements, vertical movements, and rotational movements.

In accordance with one or more aspects of the disclosed embodiment, one or more of the first electromechanical driver and the second electromechanical driver is at least one of a rotatory motor, a linear motor, and a linear actuator.

In accordance with one or more aspects of the disclosed embodiment, the movable infant load seat surface is a curved surface with an apex mated against a substantially planar mating base surface of the base, the movable infant load seat surface being disposed so that the apex moves relative to the base under impetus imparted to the movable infant load seat surface by a first motion determined by the first axis of motion.

In accordance with one or more aspects of the disclosed embodiment, the first electromechanical driver includes more than one separate and distinct electromechanical driver, each of the more than one separate and distinct electromechanical driver being separate and distinct from each other, and defines an independent degree of freedom forming an independent axis of motion, so that the first electromechanical driver defines two or more independent degrees of freedom.

In accordance with one or more aspects of the disclosed embodiment, the controller is mounted within the base.

In accordance with one or more aspects of the disclosed embodiment, the controller determines position of the infant support based at least in part on information from one or more sensors distributed drive mechanism.

In accordance with one or more aspects of the disclosed embodiment, an infant care apparatus comprises: a base; a movable infant load seat surface dependent from and movable relative to the base; an infant support configured so as to be removably coupled to the infant load seat surface; and a distributed drive mechanism distributed from the base and onto the infant support, the distributed drive mechanism has a first electromechanical driver coupled to the base, the first electromechanical driver defining a first degree of freedom forming a first axis of motion between the base and the infant support, and the distributed drive mechanism has a second electromechanical driver mounted to the infant support, and coupled to the base with coupling of the infant support to the infant load seat surface, the second electromechanical driver being separate and distinct from the first electromechanical driver, and defining a second degree of freedom forming a second axis of motion of the infant support.

In accordance with one or more aspects of the disclosed embodiment, the infant care apparatus further comprises a controller communicably coupled to the distributed drive mechanism and configured so as to move, via the first electromechanical driver and the second electromechanical driver, the infant support coupled to the infant load seat surface relative to the base.

In accordance with one or more aspects of the disclosed embodiment, the controller is configured so as to move the infant support with separate impetus separately imparted to the infant support by a first motion determined by the first axis of motion, of the first degree of freedom, and by a second motion determined by the second axis of motion, of the second degree of freedom, with a selectably variable motion profile selected with the controller from different selectably variable motion profiles.

In accordance with one or more aspects of the disclosed embodiment, the controller is configured to effect selection of the selectably variable motion profile by separate variance of motion characteristics of the separate respective first electromechanical driver and the second electromechanical driver of the distributed drive mechanism, with the infant support coupled to the movable infant load seat surface, from a common selection input to the controller selecting the selectably variable motion profile.

In accordance with one or more aspects of the disclosed embodiment, the controller includes a user interface configured to receive a common selection input from a user for selecting the selectably variable motion profile.

In accordance with one or more aspects of the disclosed embodiment, each of the different selectably variable motion profiles includes at least one of horizontal movements, vertical movements, and rotational movements.

In accordance with one or more aspects of the disclosed embodiment, the controller is mounted within the base.

In accordance with one or more aspects of the disclosed embodiment, the controller determines position of the infant support based at least in part on information from one or more sensors distributed drive mechanism.

In accordance with one or more aspects of the disclosed embodiment, one or more of the first electromechanical driver and the second electromechanical driver is at least one of a rotatory motor, a linear motor, and a linear actuator.

In accordance with one or more aspects of the disclosed embodiment, the movable infant load seat surface is a curved surface with an apex mated against a substantially planar mating base surface of the base, the movable infant load seat surface being disposed so that the apex moves relative to the base under impetus imparted to the movable infant load seat surface by a first motion determined by the first axis of motion.

In accordance with one or more aspects of the disclosed embodiment, the first electromechanical driver includes more than one separate and distinct electromechanical driver, each of the more than one separate and distinct electromechanical driver being separate and distinct from each other, and defines an independent degree of freedom forming an independent axis of motion, so that the first electromechanical driver defines two or more independent degrees of freedom.

In accordance with one or more aspects of the disclosed embodiment, a method for an infant care apparatus is provided. The method comprises: providing a base having a drive mechanism, coupled to the base, the drive mechanism has a first electromechanical driver defining a first degree of freedom forming a first axis of motion of a movable infant load seat surface dependent from and movable relative to the base; providing an infant support configured so as to be removably coupled to the movable infant load seat surface, wherein the drive mechanism is a distributed drive mechanism distributed to the base and the infant support, wherein the distributed drive mechanism includes a second electromechanical driver integral with the infant support, the second electromechanical driver being separate and distinct from the first electromechanical driver, and defining a second degree of freedom forming a second axis of motion of the infant support; and moving, with a controller communicably coupled to the distributed drive mechanism, via the first electromechanical driver and the second electromechanical driver, the infant support coupled to the movable infant load seat surface relative to the base.

In accordance with one or more aspects of the disclosed embodiment, the controller is configured so as to move the infant support with separate impetus separately imparted to the infant support by a first motion determined by the first axis of motion, of the first degree of freedom, and by a second motion determined by the second axis of motion, of the second degree of freedom, with a selectably variable motion profile selected with the controller from different selectably variable motion profiles.

In accordance with one or more aspects of the disclosed embodiment, the controller is configured to effect selection of the selectably variable motion profile by separate variance of motion characteristics of the separate respective first electromechanical driver and the second electromechanical driver of the distributed drive mechanism, with the infant support coupled to the movable infant load seat surface, from a common selection input to the controller selecting the selectably variable motion profile.

In accordance with one or more aspects of the disclosed embodiment, the method further comprises receiving with a user interface, of the controller, a common selection input from a user for selecting the selectably variable motion profile.

In accordance with one or more aspects of the disclosed embodiment, each of the different selectably variable motion profiles includes at least one of horizontal movements, vertical movements, and rotational movements.

In accordance with one or more aspects of the disclosed embodiment, one or more of the first electromechanical driver and the second electromechanical driver is at least one of a rotatory motor, a linear motor, and a linear actuator.

In accordance with one or more aspects of the disclosed embodiment, the movable infant load seat surface is a curved surface with an apex mated against a substantially planar mating base surface of the base, the movable infant load seat surface being disposed so that the apex moves relative to the base under impetus imparted to the movable infant load seat surface by a first motion determined by the first axis of motion.

In accordance with one or more aspects of the disclosed embodiment, the first electromechanical driver includes more than one separate and distinct electromechanical driver, each of the more than one separate and distinct electromechanical driver being separate and distinct from each other, and defines an independent degree of freedom forming an independent axis of motion, so that the first electromechanical driver defines two or more independent degrees of freedom.

In accordance with one or more aspects of the disclosed embodiment, the controller is mounted within the base.

In accordance with one or more aspects of the disclosed embodiment, the method further comprises, determining, with the controller, a position of the infant support based at least in part on information from one or more sensors of the distributed drive mechanism.

In accordance with one or more aspects of the disclosed embodiment, a method for an infant care apparatus is provided. The method includes: providing a base having a drive mechanism, coupled to the base, that has a first electromechanical driver defining a first degree of freedom forming a first axis of motion of a movable infant load seat surface dependent from and movable relative to the base; providing an infant support configured so as to be removably coupled to the movable infant load seat surface, wherein the drive mechanism is a distributed drive mechanism distributed to the base and the infant support, wherein the distributed drive mechanism includes a second electromechanical driver integral with the infant support, the second electromechanical driver being separate and distinct from the first electromechanical driver, and defining a second degree of freedom forming a second axis of motion of the infant support; and moving the infant support, with a controller communicably coupled to the distributed drive mechanism, relative to the base, via the first electromechanical driver and the second electromechanical driver, coupled to the movable infant load seat surface.

In accordance with one or more aspects of the disclosed embodiment, the controller is configured so as to move the infant support with separate impetus separately imparted to the infant support by a first motion determined by the first axis of motion, of the first degree of freedom, and by a second motion determined by the second axis of motion, of the second degree of freedom, with a selectably variable motion profile selected with the controller from different selectably variable motion profiles.

In accordance with one or more aspects of the disclosed embodiment, the controller is configured to effect selection of the selectably variable motion profile by separate variance of motion characteristics of the separate respective first electromechanical driver and the second electromechanical driver of the distributed drive mechanism, with the infant support coupled to the movable infant load seat surface, from a common selection input to the controller selecting the selectably variable motion profile.

In accordance with one or more aspects of the disclosed embodiment, the controller includes a user interface configured to receive a common selection input from a user for selecting the selectably variable motion profile.

In accordance with one or more aspects of the disclosed embodiment, each of the different selectably variable motion profiles includes at least one of horizontal movements, vertical movements, and rotational movements.

In accordance with one or more aspects of the disclosed embodiment, one or more of the first electromechanical driver and the second electromechanical driver is at least one of a rotatory motor, a linear motor, and a linear actuator.

In accordance with one or more aspects of the disclosed embodiment, the movable infant load seat surface is a curved surface with an apex mated against a substantially planar mating base surface of the base, the movable infant load seat surface being disposed so that the apex moves relative to the base under impetus imparted to the movable infant load seat surface by a first motion determined by the first axis of motion.

In accordance with one or more aspects of the disclosed embodiment, the first electromechanical driver includes more than one separate and distinct electromechanical driver, each of the more than one separate and distinct electromechanical driver being separate and distinct from each other, and defines an independent degree of freedom forming an independent axis of motion, so that the first electromechanical driver defines two or more independent degrees of freedom.

In accordance with one or more aspects of the disclosed embodiment, the controller is mounted within the base.

In accordance with one or more aspects of the disclosed embodiment, the controller determines position of the infant support based at least in part on information from one or more sensors distributed drive mechanism.

In accordance with one or more aspects of the disclosed embodiment, a method for an infant care apparatus is provided. The method includes: providing a base; providing a movable infant load seat surface dependent from and movable relative to the base; providing an infant support configured so as to be removably coupled to the infant load seat surface; and defining, with a distributed drive mechanism distributed from the base and onto the infant support, a first degree of freedom forming a first axis of motion of the infant support and a second degree of freedom forming a second axis of motion of the infant support, wherein the distributed drive mechanism has a first electromechanical driver coupled to the base, the first electromechanical driver defining the first degree of freedom forming the first axis of motion between the base and the infant support, and the distributed drive mechanism has a second electromechanical driver mounted to the infant support, and coupled to the base with coupling of the infant support to the infant load seat surface, the second electromechanical driver being separate and distinct from the first electromechanical driver, and defining the second degree of freedom forming the second axis of motion of the infant support.

In accordance with one or more aspects of the disclosed embodiment, the method further comprises moving, with a controller communicably coupled to the distributed drive mechanism, via the first electromechanical driver and the second electromechanical driver, the infant support coupled to the infant load seat surface relative to the base.

In accordance with one or more aspects of the disclosed embodiment, the controller is configured so as to move the infant support with separate impetus separately imparted to the infant support by a first motion determined by the first axis of motion, of the first degree of freedom, and by a second motion determined by the second axis of motion, of the second degree of freedom, with a selectably variable motion profile selected with the controller from different selectably variable motion profiles.

In accordance with one or more aspects of the disclosed embodiment, the controller is configured to effect selection of the selectably variable motion profile by separate variance of motion characteristics of the separate respective first electromechanical driver and the second electromechanical driver of the distributed drive mechanism, with the infant support coupled to the movable infant load seat surface, from a common selection input to the controller selecting the selectably variable motion profile.

In accordance with one or more aspects of the disclosed embodiment, the controller includes a user interface configured to receive a common selection input from a user for selecting the selectably variable motion profile.

In accordance with one or more aspects of the disclosed embodiment, each of the different selectably variable motion profiles includes at least one of horizontal movements, vertical movements, and rotational movements.

In accordance with one or more aspects of the disclosed embodiment, the controller is mounted within the base.

In accordance with one or more aspects of the disclosed embodiment, the controller determines position of the infant support based at least in part on information from one or more sensors distributed drive mechanism.

In accordance with one or more aspects of the disclosed embodiment, one or more of the first electromechanical driver and the second electromechanical driver is at least one of a rotatory motor, a linear motor, and a linear actuator.

In accordance with one or more aspects of the disclosed embodiment, the movable infant load seat surface is a curved surface with an apex mated against a substantially planar mating base surface of the base, the movable infant load seat surface being disposed so that the apex moves relative to the base under impetus imparted to the movable infant load seat surface by a first motion determined by the first axis of motion.

In accordance with one or more aspects of the disclosed embodiment, the first electromechanical driver includes more than one separate and distinct electromechanical driver, each of the more than one separate and distinct electromechanical driver being separate and distinct from each other, and defines an independent degree of freedom forming an independent axis of motion, so that the first electromechanical driver defines two or more independent degrees of freedom.

It should be understood that the foregoing description is only illustrative of the aspects of the disclosed embodiment. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of any claims appended hereto. Further, the mere fact that different features are recited in mutually different dependent or independent claims does not indicate that a combination of these features cannot be advantageously used, such a combination remaining within the scope of the aspects of the disclosed embodiment.

What is claimed is:

1. An infant care apparatus comprising:

a base;

a drive mechanism, coupled to the base, that has a first electromechanical driver defining a first degree of freedom forming a first axis of motion of a movable infant load seat surface dependent from and movable relative to the base;

an infant support configured with a removable coupling so as to be removably coupled to the movable infant load seat surface, the removable coupling being arranged so that the removable coupling provides for docking and re-docking of the infant support as a unit to the movable infant load seat surface;

wherein the drive mechanism is a distributed drive mechanism distributed to the base and the infant support, wherein the distributed drive mechanism includes a second electromechanical driver integral with the infant support so as to depend from the infant support, the second electromechanical driver being separate and distinct from the first electromechanical driver, and defining a second degree of freedom forming a second axis of motion of the infant support; and a controller communicably coupled to the distributed drive mechanism and configured so as to move, via the first electromechanical driver and the second electromechanical driver, the infant support coupled to the movable infant load seat surface relative to the base.

2. The infant care apparatus of claim 1, wherein the controller is configured so as to move the infant support with separate impetus separately imparted to the infant support by a first motion determined by the first axis of motion, of the first degree of freedom, and by a second motion determined by the second axis of motion, of the second degree of freedom, with a selectably variable motion profile selected with the controller from different selectably variable motion profiles.

3. The infant care apparatus of claim 2, wherein the controller is configured to effect selection of the selectably variable motion profile by separate variance of motion characteristics of the separate respective first electromechanical driver and the second electromechanical driver of the distributed drive mechanism, with the infant support coupled to the movable infant load seat surface, from a common selection input to the controller selecting the selectably variable motion profile.

4. The infant care apparatus of claim 3, wherein the controller includes a user interface configured to receive a common selection input from a user for selecting the selectably variable motion profile.

5. The infant care apparatus of claim 2, wherein each of the different selectably variable motion profiles includes at least one of horizontal movements, vertical movements, and rotational movements.

6. The infant care apparatus of claim 1, wherein one or more of the first electromechanical driver and the second electromechanical driver is at least one of a rotatory motor, a linear motor, and a linear actuator.

7. The infant care apparatus of claim 1, wherein the movable infant load seat surface is a curved surface with an apex mated against a substantially planar mating base surface of the base, the movable infant load seat surface being disposed so that the apex moves relative to the base under impetus imparted to the movable infant load seat surface by a first motion determined by the first axis of motion.

8. The infant care apparatus of claim 1, wherein the first electromechanical driver includes more than one separate and distinct electromechanical driver, each of the more than one separate and distinct electromechanical driver being separate and distinct from each other, and defines an independent degree of freedom forming an independent axis of motion, so that the first electromechanical driver defines two or more independent degrees of freedom.

9. The infant care apparatus of claim 1, wherein the controller is mounted within the base.

10. The infant care apparatus of claim 1, wherein the controller determines position of the infant support based at least in part on information from one or more sensors of the distributed drive mechanism.

11. An infant care apparatus comprising:

a base;

a drive mechanism, coupled to the base, that has a first electromechanical driver defining a first degree of freedom forming a first axis of motion of a movable infant load seat surface dependent from and movable relative to the base;

an infant support with a removable coupling configured so as to be removably coupled to the movable infant load seat surface, the removable coupling being arranged so that the removable coupling provides for docking and re-docking of the infant support as a unit to the movable infant load seat surface;

wherein the drive mechanism is a distributed drive mechanism distributed to the base and the infant support, wherein the distributed drive mechanism includes a second electromechanical driver integral with the infant support so that the second electromechanical driver and the infant support form a unit and are removably coupled to the movable infant load seat surface as the unit, the second electromechanical driver being separate and distinct from the first electromechanical driver, and defining a second degree of freedom forming a second axis of motion of the infant support; and a controller communicably coupled to the distributed drive mechanism and configured so as to move the infant support relative to the base, via the first electromechanical driver and the second electromechanical driver, coupled to the movable infant load seat surface.

12. The infant care apparatus of claim 11, wherein the controller is configured so as to move the infant support with separate impetus separately imparted to the infant support by a first motion determined by the first axis of motion, of the first degree of freedom, and by a second motion determined by the second axis of motion, of the second degree of freedom, with a selectably variable motion profile selected with the controller from different selectably variable motion profiles.

13. The infant care apparatus of claim 12, wherein the controller is configured to effect selection of the selectably variable motion profile by separate variance of motion characteristics of the separate respective first electromechanical driver and the second electromechanical driver of the distributed drive mechanism, with the infant support coupled to the movable infant load seat surface, from a common selection input to the controller selecting the selectably variable motion profile.

14. The infant care apparatus of claim 13, wherein the controller includes a user interface configured to receive a common selection input from a user for selecting the selectably variable motion profile.

15. The infant care apparatus of claim 12, wherein each of the different selectably variable motion profiles includes at least one of horizontal movements, vertical movements, and rotational movements.

16. The infant care apparatus of claim 11, wherein one or more of the first electromechanical driver and the second electromechanical driver is at least one of a rotatory motor, a linear motor, and a linear actuator.

17. The infant care apparatus of claim 11, wherein the movable infant load seat surface is a curved surface with an apex mated against a substantially planar mating base surface of the base, the movable infant load seat surface being disposed so that the apex moves relative to the base under impetus imparted to the movable infant load seat surface by a first motion determined by the first axis of motion.

18. The infant care apparatus of claim 11, wherein the first electromechanical driver includes more than one separate and distinct electromechanical driver, each of the more than one separate and distinct electromechanical driver being separate and distinct from each other, and defines an independent degree of freedom forming an independent axis of motion, so that the first electromechanical driver defines two or more independent degrees of freedom.

19. The infant care apparatus of claim 11, wherein the controller is mounted within the base.

20. The infant care apparatus of claim 11, wherein the controller determines position of the infant support based at least in part on information from one or more sensors distributed drive mechanism.

21. A method for an infant care apparatus, the method comprising:

providing a base having a drive mechanism, coupled to the base, the drive mechanism has a first electromechanical driver defining a first degree of freedom forming a first axis of motion of a movable infant load seat surface dependent from and movable relative to the base;

providing an infant support, with a removable coupling, configured so as to be removably coupled to the movable infant load seat surface, the removable coupling being arranged so that the removable coupling provides for docking and re-docking of the infant support as a unit to the movable infant load seat surface, and wherein the drive mechanism is a distributed drive mechanism distributed to the base and the infant support, wherein the distributed drive mechanism includes a second electromechanical driver integral with the infant support so as to depend from the infant support, the second electromechanical driver being separate and distinct from the first electromechanical driver, and defining a second degree of freedom forming a second axis of motion of the infant support; and moving, with a controller communicably coupled to the distributed drive mechanism, via the first electromechanical driver and the second electromechanical driver, the infant support coupled to the movable infant load seat surface relative to the base.

22. The method of claim 21, wherein the controller is configured so as to move the infant support with separate impetus separately imparted to the infant support by a first motion determined by the first axis of motion, of the first degree of freedom, and by a second motion determined by the second axis of motion, of the second degree of freedom, with a selectably variable motion profile selected with the controller from different selectably variable motion profiles.

23. The method of claim 22, wherein the controller is configured to effect selection of the selectably variable motion profile by separate variance of motion characteristics of the separate respective first electromechanical driver and the second electromechanical driver of the distributed drive mechanism, with the infant support coupled to the movable infant load seat surface, from a common selection input to the controller selecting the selectably variable motion profile.

24. The method of claim 23, further comprising receiving with a user interface, of the controller, a common selection input from a user for selecting the selectably variable motion profile.

25. The method of claim 22, wherein each of the different selectably variable motion profiles includes at least one of horizontal movements, vertical movements, and rotational movements.

26. The method of claim 21, wherein one or more of the first electromechanical driver and the second electromechanical driver is at least one of a rotatory motor, a linear motor, and a linear actuator.

27. The method of claim 21, wherein the movable infant load seat surface is a curved surface with an apex mated against a substantially planar mating base surface of the base, the movable infant load seat surface being disposed so that the apex moves relative to the base under impetus imparted to the movable infant load seat surface by a first motion determined by the first axis of motion.

28. The method of claim 21, wherein the first electromechanical driver includes more than one separate and distinct electromechanical driver, each of the more than one separate and distinct electromechanical driver being separate and distinct from each other, and defines an independent degree of freedom forming an independent axis of motion, so that the first electromechanical driver defines two or more independent degrees of freedom.

29. The method of claim 21, wherein the controller is mounted within the base.

30. The method of claim 21, further comprising, determining, with the controller, a position of the infant support based at least in part on information from one or more sensors of the distributed drive mechanism.

31. A method for an infant care apparatus, the method comprising:

providing a base having a drive mechanism, coupled to the base, that has a first electromechanical driver defining a first degree of freedom forming a first axis of motion of a movable infant load seat surface dependent from and movable relative to the base;

providing an infant support, with a removable coupling, configured so as to be removably coupled to the movable infant load seat surface, the removable coupling being arranged so that the removable coupling provides for docking and re-docking of the infant support as a unit to the movable infant load seat surface, and wherein the drive mechanism is a distributed drive mechanism distributed to the base and the infant support, wherein the distributed drive mechanism includes a second electromechanical driver integral with the infant support so that the second electromechanical driver and the infant support form a unit and are removably coupled to the movable infant load seat surface as the unit, the second electromechanical driver being separate and distinct from the first electromechanical driver, and defining a second degree of freedom forming a second axis of motion of the infant support; and moving the infant support, with a controller communicably coupled to the distributed drive mechanism, relative to the base, via the first electromechanical driver and the second electromechanical driver, coupled to the movable infant load seat surface.

32. The method of claim 31, wherein the controller is configured so as to move the infant support with separate impetus separately imparted to the infant support by a first motion determined by the first axis of motion, of the first degree of freedom, and by a second motion determined by the second axis of motion, of the second degree of freedom, with a selectably variable motion profile selected with the controller from different selectably variable motion profiles.

33. The method of claim 32, wherein the controller is configured to effect selection of the selectably variable motion profile by separate variance of motion characteristics of the separate respective first electromechanical driver and the second electromechanical driver of the distributed drive mechanism, with the infant support coupled to the movable infant load seat surface, from a common selection input to the controller selecting the selectably variable motion profile.

34. The method of claim 33, wherein the controller includes a user interface configured to receive a common selection input from a user for selecting the selectably variable motion profile.

35. The method of claim 32, wherein each of the different selectably variable motion profiles includes at least one of horizontal movements, vertical movements, and rotational movements.

36. The method of claim 31, wherein one or more of the first electromechanical driver and the second electromechanical driver is at least one of a rotatory motor, a linear motor, and a linear actuator.

37. The method of claim 31, wherein the movable infant load seat surface is a curved surface with an apex mated against a substantially planar mating base surface of the base, the movable infant load seat surface being disposed so that the apex moves relative to the base under impetus imparted to the movable infant load seat surface by a first motion determined by the first axis of motion.

38. The method of claim 31, wherein the first electromechanical driver includes more than one separate and distinct electromechanical driver, each of the more than one separate and distinct electromechanical driver being separate and distinct from each other, and defines an independent degree of freedom forming an independent axis of motion, so that the first electromechanical driver defines two or more independent degrees of freedom.

39. The method of claim 31, wherein the controller is mounted within the base.

40. The method of claim 31, wherein the controller determines position of the infant support based at least in part on information from one or more sensors distributed drive mechanism.

* * * * *